US007697861B2

(12) United States Patent
Shindo et al.

(10) Patent No.: US 7,697,861 B2
(45) Date of Patent: Apr. 13, 2010

(54) PRINTING APPARATUS AND IMAGE FORMING APPARATUS

(75) Inventors: Nobuhiro Shindo, Ohta-ku (JP); Toshiya Suzuki, Ohta-ku (JP); Michiaki Nishinosono, Ohta-ku (JP); Hiroki Ohzaki, Ohta-ku (JP); Yutaka Matsumoto, Ohta-ku (JP); Saori Iura, Ohta-ku (JP)

(73) Assignee: Ricoh Company, Limited, Tokyo (JP)

( * ) Notice: Subject to any disclaimer, the term of this patent is extended or adjusted under 35 U.S.C. 154(b) by 553 days.

(21) Appl. No.: 11/616,549

(22) Filed: Dec. 27, 2006

(65) Prior Publication Data

US 2007/0147870 A1 Jun. 28, 2007

(30) Foreign Application Priority Data

| | | |
|---|---|---|
| Dec. 28, 2005 | (JP) | 2005-378173 |
| Jan. 24, 2006 | (JP) | 2006-014787 |
| Feb. 14, 2006 | (JP) | 2006-036794 |
| Feb. 15, 2006 | (JP) | 2006-037729 |

(51) Int. Cl.
*G03G 15/00* (2006.01)

(52) U.S. Cl. ..... 399/82; 399/83; 399/85

(58) Field of Classification Search ..... 399/72, 399/81, 82, 83, 85, 87
See application file for complete search history.

(56) References Cited

U.S. PATENT DOCUMENTS

| | | | | |
|---|---|---|---|---|
| 4,708,461 | A * | 11/1987 | Okuda et al. | 399/87 |
| 4,956,667 | A * | 9/1990 | Gartner | 399/183 |
| 5,668,936 | A * | 9/1997 | Motooka et al. | 358/1.15 |
| 5,689,765 | A | 11/1997 | Nishinozono | |
| 6,151,464 | A * | 11/2000 | Nakamura et al. | 399/79 |
| 6,160,629 | A * | 12/2000 | Tang et al. | 358/1.1 |
| 6,213,652 | B1 * | 4/2001 | Suzuki et al. | 358/1.15 |

FOREIGN PATENT DOCUMENTS

| | | |
|---|---|---|
| JP | 11-98332 | 4/1999 |
| JP | 2002-36675 | 2/2002 |
| JP | 2003-131828 | 5/2003 |
| JP | 2003-305928 | 10/2003 |
| JP | 2004-235769 | 8/2004 |
| JP | 3622670 | 12/2004 |
| JP | 2005-324471 | 11/2005 |

* cited by examiner

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

A printing apparatus receives a plurality of print jobs containing print data from a host computer connected thereto through a network. The printing apparatus temporarily stores the print job in a storage unit to print the print data. The printing apparatus receives a request to pause or restart printing of a print job, and controls execution of the print job in response to the request. Upon receiving a request to restart a print job being paused, the printing apparatus determines a printing order according to a predetermined condition to print the print job.

30 Claims, 42 Drawing Sheets

FIG. 3

| | JOB ID | USER ID | JOB STATE |
|---|---|---|---|
| JOB 1 | 1 | AAA | PRINTING |
| JOB 2 | 2 | BBB | PAUSED |
| JOB 3 | 3 | CCC | PRINT WAIT |
| JOB 4 | 4 | BBB | PRINT WAIT |
| JOB 5 | 5 | CCC | PAUSED |
| JOB 6 | 6 | DDD | PRINT WAIT |
| END | 0 | | |

⋮

| PRINT JOB | USER | SUBMISSION ORDER (MANAGEMENT NO.) | STATE |
|---|---|---|---|
| A | AAA | 1 | PAUSED |
| B | DDD | 2 | PRINTING |
| C | CCC | 3 | PAUSED |
| D | AAA | 4 | PRINT WAIT |
| E | EEE | 5 | LOADING |

| PRINT JOB | USER | SUBMITTED DATE AND TIME | STATE |
|---|---|---|---|
| A | AAA | 2005/11/1 8:00 | PAUSED |
| B | DDD | 2005/11/1 8:10 | PRINTING |
| C | CCC | 2005/11/3 8:15 | PAUSED |
| D | AAA | 2005/11/5 10:05 | PRINT WAIT |
| E | EEE | 2005/11/5 11:00 | LOADING |

| PRINT JOB | USER | OCCUPIED MEMORY SPACE | STATE |
|---|---|---|---|
| A | AAA | 100 | PAUSED |
| B | DDD | 150 | PRINTING |
| C | CCC | 50 | PAUSED |
| D | AAA | 200 | PRINT WAIT |
| E | EEE | | LOADING |

| PRINT JOB | USER | PRIORITY | STATUS |
|---|---|---|---|
| A | AAA | 1 | PAUSED |
| B | DDD | 2 | PRINTING |
| C | CCC | 3 | PAUSED |
| D | AAA | 1 | PRINT WAIT |
| E | EEE | 4 | LOADING |

| PRINT JOB ID | USER ID | JOB STATE | PRINT DATA |
|---|---|---|---|
| 1 | AAA | PRINTING | PRINT DATA 1 |
| 2 | BBB | PAUSED | PRINT DATA 2 |
| 3 | CCC | PRINT WAIT | PRINT DATA 3 |
| 4 | BBB | PRINT WAIT | PRINT DATA 4 |
| 5 | CCC | PAUSED | PRINT DATA 5 |
| 6 | DDD | PRINT WAIT | PRINT DATA 6 |
| 0 | | | |

| JOB ID | USER ID | JOB STATE |
|---|---|---|
| 2 | BBB | PAUSED |
| 4 | BBB | PRINT WAIT |
| ⋮ | ⋮ | ⋮ |

PRINTING APPARATUS AND IMAGE FORMING APPARATUS

CROSS-REFERENCE TO RELATED APPLICATIONS

The present document incorporates by reference the entire contents of Japanese priority documents, 2006-037729 filed in Japan on Feb. 15, 2006, 2006-036794 filed in Japan on Feb. 14, 2006, 2006-014787 filed in Japan on Jan. 24, 2006 and 2005-378173 filed in Japan on Dec. 28, 2005.

BACKGROUND OF THE INVENTION

1. Field of the Invention

The present invention relates to a printing apparatus and an image forming apparatus.

2. Description of the Related Art

Conventional network printers sequentially receive and store a plurality of print jobs, and process the print jobs in the order in which they are received. By assigning a priority to a print job, the print job can be preferentially printed. Besides, a print job can also be paused or restarted. When any print job is specified to be paused, the print job is suspended, and a subsequent print job is printed before the print job. When the restart of printing is specified, the order of print jobs is rearranged according to a predetermined method that varies depending on the type of printer, and the print jobs are printed in the order.

Japanese Patent Application Laid-Open No. 2002-157098 discloses print-job management device which increases a variation of states upon management of print jobs to improve printer usability. In a printing system structured via a network, a job management device is provided in a printer to manage states of the print jobs according to international standards. In this case, a create control unit is provided in addition to function blocks for processing the print jobs according to the standards. When a user sends an "create" instruction for the print job of which execution is held, the create control unit newly generates a slave job using the print job instructed as a master job, and executes printing of either one of the jobs. At least one of the print jobs is kept in its held state and stored as it is, and a document stored can thereby be repeatedly printed at any time.

Japanese Patent Application Laid-Open No. 2003-131828 discloses image forming apparatus which controls a process order of a plurality of print jobs which are requested from a plurality of uses. A job control unit acquires job attribute information in a print queue. When the state is a "wait for completion of preceding job" state, the job control unit determines that the print job is not a target for print order control, and acquires job attribute information for a next print job. When the state is not the "wait for completion of preceding job" state, the job control unit determines whether the start of execution is held. If the state is changed to the "wait for completion of preceding job" state or to a "Sprint wait" state, the job control unit acquires job attribute information for a next print job. Furthermore, when the print job subjected to the process of "determination whether to hold the start of execution" is changed to "printing", the job control unit determines that the start of printing process is possible and starts execution. The job control unit repeats the print order control until any print job which is not in the "wait for completion of preceding job" state or in the "print wait" state is detected.

Japanese Patent Application Laid-Open No. 2003-305928 discloses image forming apparatus which holds a job, with which an error occurs, in the apparatus and can specify restart of the job whenever a user wants it. The image forming apparatus can process a plurality of continuous jobs. The image forming apparatus includes an operation panel, a storage unit, a set-contents management unit that manages various set contents, and a data processing unit. When the printing process is suspended due to an error during printing, the print data from a relevant page to the last page of the job being paused is stored in the storage unit as a print-uncompleted document by entry of an instruction through the operation panel, and the printing process of the relevant job is terminated. By entry of a restart instruction of the document stored in the storage unit, printing of the job interrupted due to the error is restarted from the page where the error has occurred.

In the conventional printers, however, to restart a print job being paused, the execution order of the print job is not considered at all. Therefore, the user does not know when the print job is printed. In another case, the execution order of the print job to be restarted is fixed and cannot be changed.

In recent years, networking of personal computers (PCs) is progressed, and a network-type image forming system is structured in such a manner that an image forming apparatus such as a printer is connected to not only one PC but a plurality of PCs via a network to enable sharing of the printer with the PCs.

The image forming apparatus used in the network-type image forming system incorporates a spooler function, and hence, it is configured to accept a subsequent print job before completion of a preceding print job.

The spooler has a function of temporarily storing print data of a plurality of print jobs received via the network in the image forming apparatus, and a function of managing the printing order of the print jobs. When a subsequent print job is received before the preceding print job is not completed, the subsequent print job is changed to the "print wait" state in the spooler.

Each print job can be provided with an attribute of preferential printing. When the print jobs in which a higher-priority print job and an ordinary print job are mixed are in the print wait state, the higher-priority print job can also be preferentially printed. Moreover, some of the printers have a function of estimating a printing time.

Japanese Patent Application Laid-Open No. 2005-324471 discloses an image forming apparatus capable of preferentially printing a higher-priority print job and accepting a subsequent print job before completion of a preceding print job. The image forming apparatus includes a setting unit that sets a maximum printing time for each user or each print job; an estimating unit that estimates the time when the print job is received, the time when the process is started, or the amount of time required from start of printing to completion of the printing; and a control unit that controls so as to delay the start of printing of the print job when the time required is shorter than the maximum printing time of the print job. This allows the image forming apparatus to preferentially print the higher-priority print job or to print another print job in parallel or preferentially. In the image forming apparatus, however, if "memory full" occurs in the image forming apparatus when print data of a plurality of print jobs are temporarily stored therein, this causes occurrence of such a state that a subsequent printing process or the like cannot be performed.

The printing process has been performed by image forming apparatuses. Recently, in particular, an increase in printing speed has been demanded of the image forming apparatuses.

For example, Japanese Patent Application Laid-Open No. H11-098332 discloses an image forming apparatus capable of continuing facsimile reception without disconnecting a line even if the printer is in the copying operation when the memory full occurs during facsimile reception.

Japanese Patent Application Laid-Open No. 2004-235769 discloses an image forming apparatus that causes another image forming apparatus connected to a network to form an image when the image forming apparatus has run out of memory.

In the conventional examples, however, to preferentially print an urgent job, the image forming apparatuses can pause a job to cause a subsequent job to be processed before the process of the job, but if the image forming apparatus has run out of storage space due to jobs being paused, a next process cannot be performed.

As for conventional printers for printing print data received, there is known a technology of executing print jobs in the order in which the print data is received. In the technology, once reception of one print data is started, the printer cannot receive another print data until the reception is completed. If a large amount of print data is received or if a print job is paused due to shortage of paper or so, a print job subsequently instructed cannot be printed until a print job previously instructed is completed.

As a printer configured to solve the problems, Japanese Patent Application Laid-Open No. 2002-36675 discloses a printer as follows. When a print job is instructed so as to be printed preferentially to the printing process of a print job currently performed, the printer stores print pages created from print data being currently received, and completes the printing process of the print job to be preferentially output, and then prints the print pages stored. In the conventional technology, however, if the print job of which printing has been started is once paused, some printed results are output by the time the print job is paused, and thereafter, a preferentially printed result is output. Therefore, the printed results for one print job cannot continuously be output. This may sometimes lead to a case where the printed result of the user gets mixed with other printed results.

Moreover, because the pause can be instructed for all the print jobs which are in the print wait in a certain printer, if a user is about to pause the printing process, the user may erroneously pause a print job of another user, or another user may erroneously indicate "print restart" or "print pause". These sorts of failures may sometimes happen.

Furthermore, because the operation for printing is required for each print job, if a plurality of print requests are made, instructions to pause the printing and instructions to restart the printing of the print jobs are complicated, which imposes heavy workloads on users.

SUMMARY OF THE INVENTION

It is an object of the present invention to at least partially solve the problems in the conventional technology.

According to an aspect of the present invention, a printing apparatus includes a receiving unit that receives a plurality of print jobs including print data from a host computer connected through a network to the printing apparatus, a storage unit that temporarily stores therein the print jobs, a printing unit that prints the print data contained in the print job stored in the storage unit, a request receiving unit that receives a pause request and a restart request to pause and restart printing of a print job, and a print-job control unit that controls execution of the print job in response to the pause request and the restart request, and, upon receiving the restart request for a print job being paused, determines a printing order according to a predetermined condition to print the print job.

According to another aspect of the present invention, an image forming apparatus includes an acquisition unit that acquires a print job, a storage unit that temporarily stores therein the print job, a determining unit that determines whether data to be temporarily stored in the storage unit will cause an overflow in the storage unit, a pausing unit that pauses storing of the print job in the storage unit when the data will cause an overflow in the storage unit, and a deleting unit that deletes at least one of print jobs stored in the storage unit when the data will cause an overflow in the storage unit.

According to still another aspect of the present invention, an image forming apparatus includes a receiving unit that receives a print job, a storage unit that temporarily stores therein the print job, a print-job control unit that sequentially processes print jobs temporarily stored in the storage unit and pauses a print job in response to a pause request, and a determining unit that determines whether it is permitted to pause the print job based on a physical quantity related to the print jobs stored in the storage unit. When it is not permitted to pause the print job, the print-job control unit does not accept the pause request.

According to still another aspect of the present invention, an image forming apparatus includes a job storage unit that stores therein print-job identification information that identifies a print job in association with job state information indicating a current state of the print job, the job state information indicating printing state when printing of the print job is started, an instruction receiving unit that receives a pause instruction to pause a print job corresponding to the print-job identification information stored in the job storage unit, a job-state identifying unit that refers to the job state information associated with the print-job identification information to identify the current state of the print job in response to the pause instruction, and a print-job control unit that does not pause the print job when the print job is in the printing state.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is an example of contents of a job management table of the printing apparatus;

FIG. 35 is a block diagram of a multifunction product (MFP) according to a twenty-first embodiment of the present invention;

DETAILED DESCRIPTION OF THE PREFERRED EMBODIMENTS

Exemplary embodiments of the present invention are explained in detail below with reference to the accompanying drawings.

Figure 1:
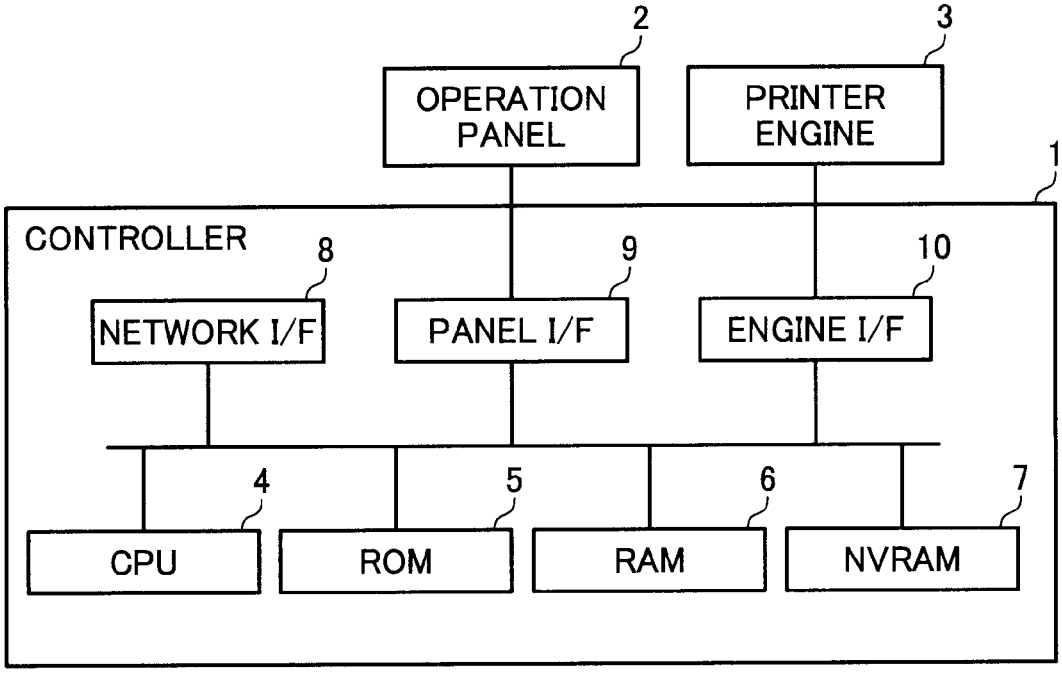
FIG. 1 is a functional block diagram of a printing apparatus according to a first embodiment of the present invention.

FIG. 1 is a functional block diagram of a printing apparatus according to a first embodiment of the present invention. The printing apparatus is capable of determining the processing order of a print job to be restarted (hereinafter, "restart print job or restart job") differently from the conventional printing apparatuses. In the first embodiment, upon receiving a restart request for a print job being paused, the printing apparatus processes the print job in an original order in which the print job has been received from a host computer. The printing apparatus includes a controller 1, an operation panel 2, and a printer engine 3. The controller 1 includes a Central Processing Unit (CPU) 4, Read Only Memory (ROM) 5, Random Access Memory (RAM) 6, Non-Volatile RAM (NVRAM) 7, a network interface (I/F) 8, a panel I/F 9, and an engine I/F 10.

The function and operation of the printing apparatus according to the first embodiment configured as above are explained below. First, the outline of the function of the printing apparatus is explained with reference to FIG. 1. The controller 1 receives print data from the network I/F 8 connected to a host computer via a Local Area Network (LAN) and generates a print image. The print image is transmitted to the printer engine 3 through the engine I/F 10, and the printer engine 3 transfers the print image to a sheet of paper and prints it. The panel I/F 9 is connected to the operation panel 2 and displays the state of the printing apparatus on the operation panel 2.

Figure 2:
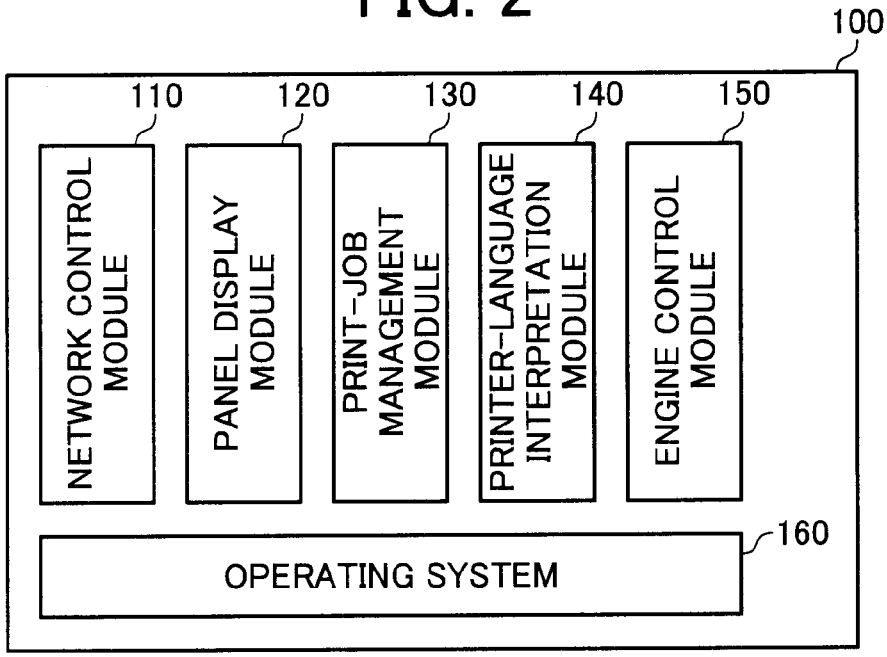
FIG. 2 is a schematic of a module structure of software stored in ROM of a controller shown in FIG. 1.

FIG. 2 is a schematic of a module structure 100 of software stored in the ROM 5 of the controller 1. A network control module 110 controls the network I/F 8 to perform communication with the host computer. A panel display module 120 controls the panel I/F 9 to display the state of the printing apparatus on the operation panel 2. A print-job management module 130 manages print jobs containing print data received through the network control module 110. The print-job management module 130 also receives a pause instruction and a restart instruction of a print job from the network control module 110. A printer-language interpretation module 140 generates a print image from the print data. An engine control module 150 receives a print job from the print-job management module 130 and sequentially transmits print images contained in the print job to the printer engine 3 through the engine I/F 10. The print-job management module 130 manages the print jobs using a job management table and a print job queue. An operating system 160 provides basic functions to control the modules.

FIG. 3 is an example of contents of the job management table. The job management table manages information on the print jobs. The order of jobs registered in the job management table is basically an order in which the jobs have been received from the network I/F 8, but the order of the jobs on the table is sometimes changed by the restart operation of a job. The job management table contains information such as job IDs, user IDs, and job states. The job ID is a number to identify a job, and is uniquely assigned to each job by the print-job management module 130. The user ID is an ID to identify a user who submits a job, and is added to a print job by the host computer. The job state represents a state of each job and includes three states such as "print wait" (stat before paper feeding is started), "printing" (stat after the paper feeding), and "paused". The "paused" state represents a state where a pause request is received. When a new print job is created, the state is set to "print wait". When all the pages are completely printed, a relevant job is deleted from the job management table.

Figure 4:
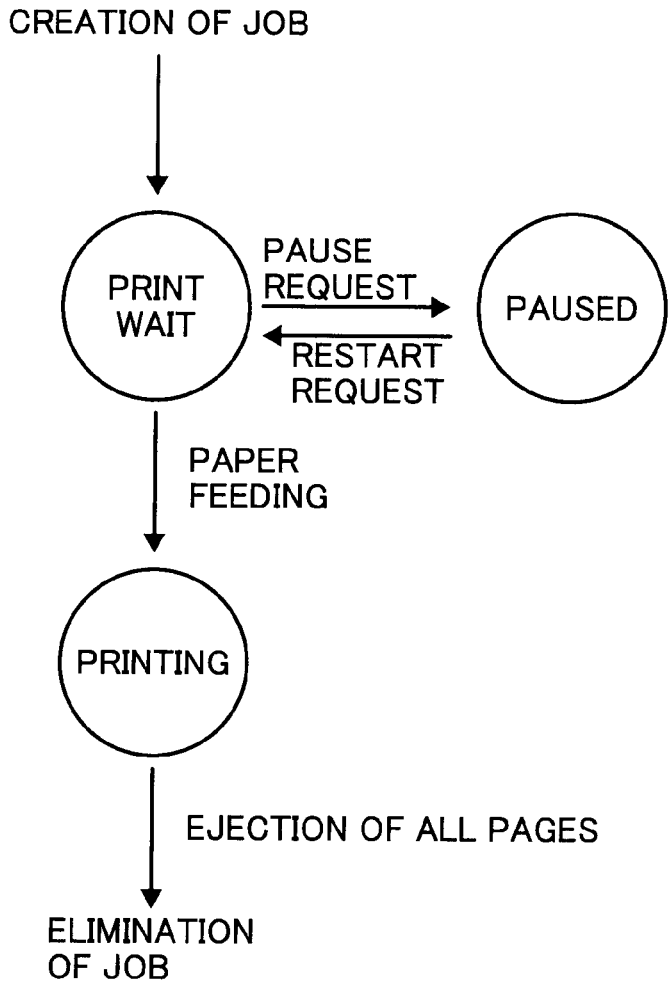
FIG. 4 is a job-state transition diagram of the printing apparatus.
Figure 5:
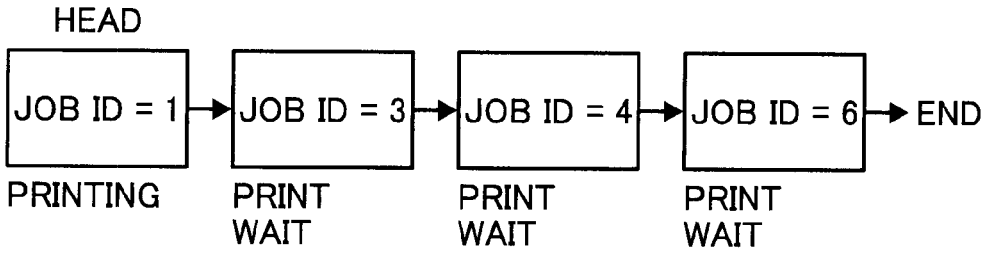
FIG. 5 is a schematic of a print job queue in the printing apparatus.

FIG. 4 is a job-state transition diagram. FIG. 5 is a schematic of the print job queue. The print job queue controls and manages the order of printing jobs. The print-job management module 130 requests printing of a job from the engine control module 150 based on the print job queue. The print job queue is recreated based on the job management table upon pause or restart of a job.

Figure 6:
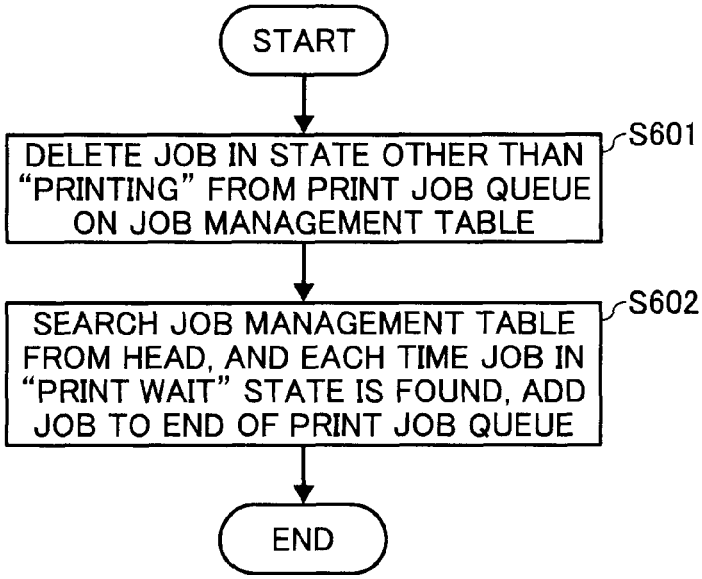
FIG. 6 is a flowchart of an algorithm used for recreating the print job queue.

FIG. 6 is a flowchart of an algorithm for recreating the print job queue. First, the print-job management module 130 deletes a job in a state other than "printing" from the print job queue in the job management table (step S601). Then, the print-job management module 130 searches the job management table, starting from the head thereof, and each time a job in a "print wait" state is found, the print-job management module 130 adds the job to the end of the print job queue (step S602). With this algorithm, the job being currently printed is followed by a job in "print-wait" in the order in which the jobs are recorded in the job management table. For the print job queue and the job management table, the following processes are executed upon creation of jobs, upon start of printing, and upon completion of the printing.

When a job is created, job information is created at the end of the job management table, and the job state is set to "print wait". The print job is inserted into the end of the print job queue. When the printing (paper feeding) is started, the print-job management module 130 searches for a job from the job management table using a job ID, and changes the job state of the job found to "printing". When the printing is completed, the print-job management module 130 searches for the job from the job management table using the job ID, and deletes the content of the job found. The job information on the job and thereafter is moved upward in the job management table. The job retrieved using the job ID is deleted from the print job queue.

Figure 7:
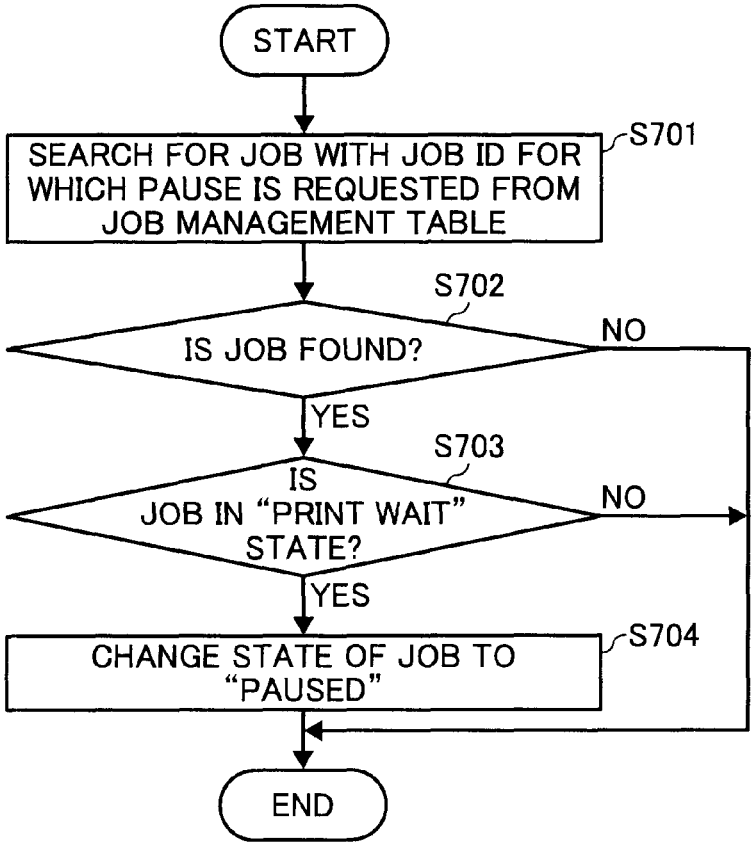
FIG. 7 is a flowchart of an algorithm for a job-pause requesting process in the printing apparatus.
Figure 8:
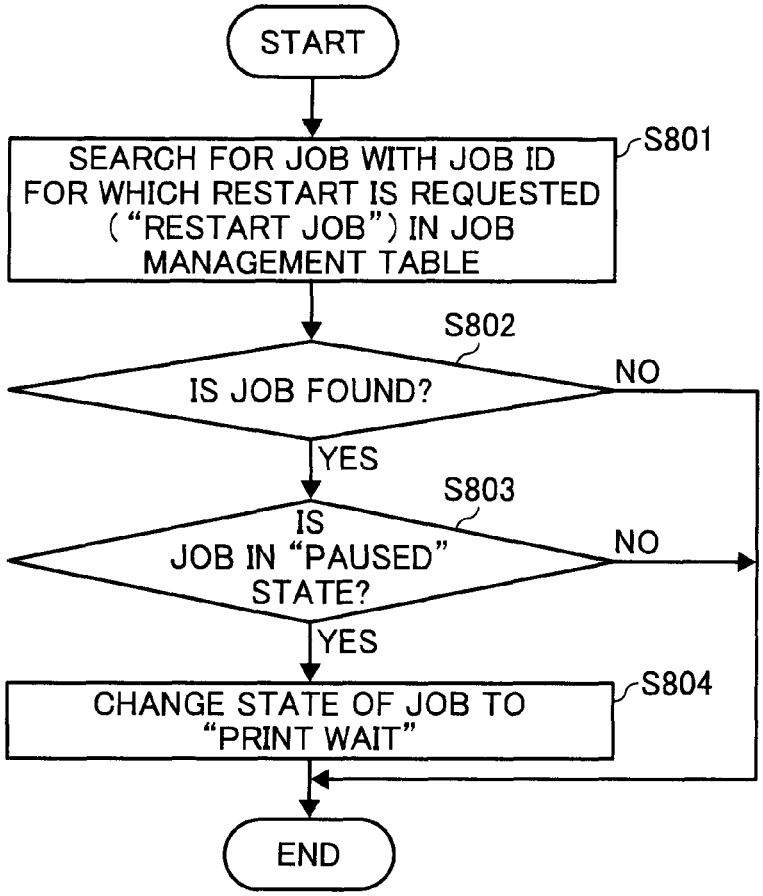
FIG. 8 is a flowchart of an algorithm for a job-restart requesting process in the printing apparatus.

FIG. 7 is a flowchart of an algorithm for a job-pause requesting process. FIG. 8 is a flowchart of an algorithm for a job-restart requesting process. The print-job management module 130 updates the job management table by the following process upon suspending or restarting the job, and recreates the print job queue based on the job management table according to an algorithm in FIG. 6.

When a pause request for a job specified by a job ID is accepted, the pause request is processed by an algorithm in FIG. 7. First, in response to the pause request, the print-job management module 130 searches for the job with the job ID from the job management table (step S701). The print-job management module 130 determines whether the job is found (step S702). When the job is not found (No at step S702), the process ends. When the job is found (Yes at step S702), the print-job management module 130 further determines whether the job is in the "print wait" state (step S703). When the job is not in the "print wait" state (No at step S703), the process ends. When the job is in the "print wait" state (Yes at step S703), the state of the job is changed to "paused" (step S704).

Namely, the state of the job specified is changed from "print wait" to "paused". With this operation, the state of the job specified is changed to "paused", and the job is deleted from the print job queue by a recreating process of the print job queue.

When a restart request for a job specified by a job ID is accepted, the restart request is processed by an algorithm in FIG. 8. First, the print-job management module 130 searches for the job with the job ID for which restart is requested (hereinafter, "restart job") in the job management table (step S801). The print-job management module 130 determines whether the job is found (step S802). When the job is not found (No at step S802), the process ends. When the job is found (Yes at step S802), the print-job management module 130 further determines whether the job is in the "paused" state (step S803). When the job is not in the "paused" state (No at step S803), the process ends. When the job is in the "paused" state (Yes at step S803), the state of the job is changed to "print wait" (step S804).

Namely, the state of the job specified is changed from "paused" to "print wait". With this operation, the state of the job specified is changed to "print wait", and the job is returned to the original printing order before the job is paused, by the recreating process of the print job queue.

As explained above, in the first embodiment, the printing apparatus is configured so that when the restart request for the print job being paused is accepted, the print job is printed in the original order in which the print job has been received from the host computer. Therefore, it is easy for the user to recognize in which order the restart print job is printed.

Figure 9:
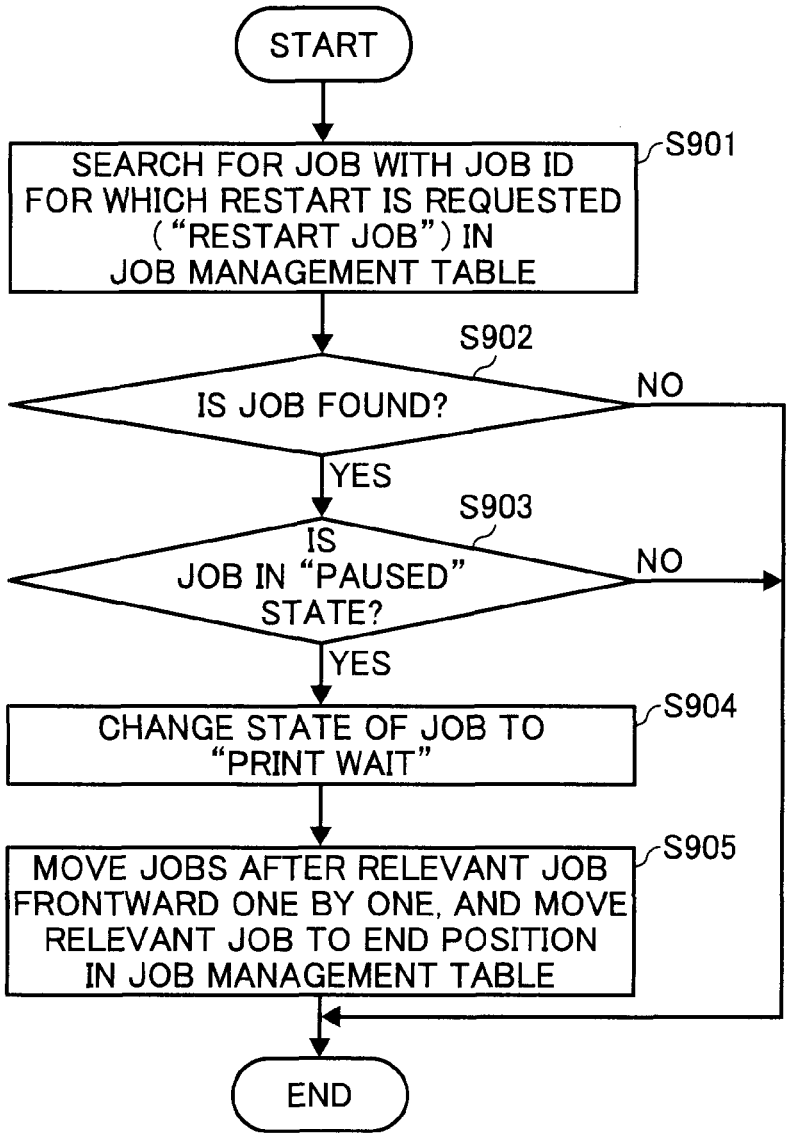
FIG. 9 is a flowchart of an algorithm for a job-restart requesting process in a printing apparatus according to a second embodiment of the present invention.

A printing apparatus according to the second embodiment is essentially of the same construction and operates in the similar manner as that of the first embodiment except that the restart print job is processed last among print jobs. That is, upon receiving a restart request for a print job being paused, the printing apparatus executes the print job at the end of print jobs. FIG. 9 is a flowchart of an algorithm for a job-restart requesting process.

The operation of the printing apparatus according to the second embodiment is explained below. The print-job management module 130 updates the job management table by the following processes upon suspending or restarting a job, and then, recreates the print job queue based on the job management table according to the algorithm in FIG. 6.

When a pause request for a job specified by a job ID is accepted, the pause request is processed by the algorithm in FIG. 7 similarly to the first embodiment. With this operation, the state of the job specified is changed to "paused", and the job is deleted from the print job queue by the recreating process of the print job queue.

When a restart request for a job specified by a job ID is accepted, the restart request is processed by an algorithm in FIG. 9. The processes at step S901 to step S904 of FIG. 9 are the same as these at step S801 to step S804 of FIG. 8, and the explanation thereof is omitted. The print-job management module 130 moves jobs after the job specified frontward one by one in the job management table, and moves the job specified to the end position (step S905).

Namely, the state of the job specified is changed from "paused" to "print wait", and the position of the job is moved to the end of the job management table. With this operation, the state of the job specified is changed to "print wait", and the job is printed at the end of the jobs by the recreating process of the print job queue.

Figure 10:
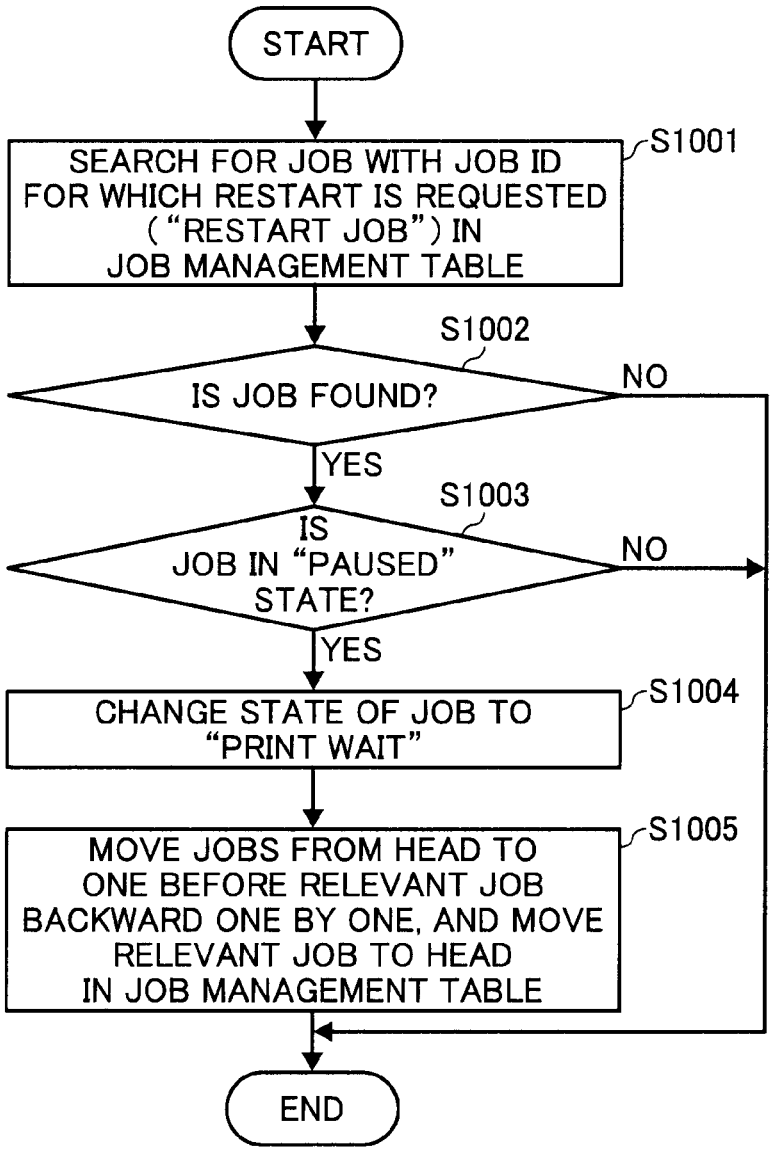
FIG. 10 is a flowchart of an algorithm for a job-restart requesting process in a printing apparatus according to a third embodiment of the present invention.

A printing apparatus according to the third embodiment is essentially of the same construction and operates in the similar manner as that of the first embodiment except that the restart print job is processed first. That is, upon receiving a restart request for a print job being paused, the printing apparatus processes the print job first. FIG. 10 is a flowchart of an algorithm for a job-restart requesting process.

The operation of the printing apparatus according to the third embodiment is explained below. The print-job management module 130 updates the job management table by the following processes upon suspending and restarting a job, and then, recreates the print job queue based on the job management table according to the algorithm in FIG. 6.

When a pause request for a job specified by a job ID is accepted, the pause request is processed by the algorithm in FIG. 7 similarly to the first embodiment. With this operation, the state of the job specified is changed to "paused", and the job is deleted from the print job queue by the recreating process of the print job queue.

When a restart request for a job specified by a job ID is accepted, the restart request is processed by an algorithm in FIG. 10. The processes at step S1001 to step S1004 of FIG. 10 are the same as these at step S801 to step S804 of FIG. 8, and the explanation thereof is omitted. The print-job management module 130 moves jobs from the head of the job management table to a job before the position of the job specified, backward one by one, and moves the job specified to the head of the job management table (step S1005).

Namely, the state of the job specified is changed from "paused to print wait", and the position of the job specified is moved to the head of the job management table. With this operation, the state of the job specified is changed to "print wait", and the job specified is printed first, of the jobs in "print wait" by the recreating process of the print job queue.

Figure 11A:
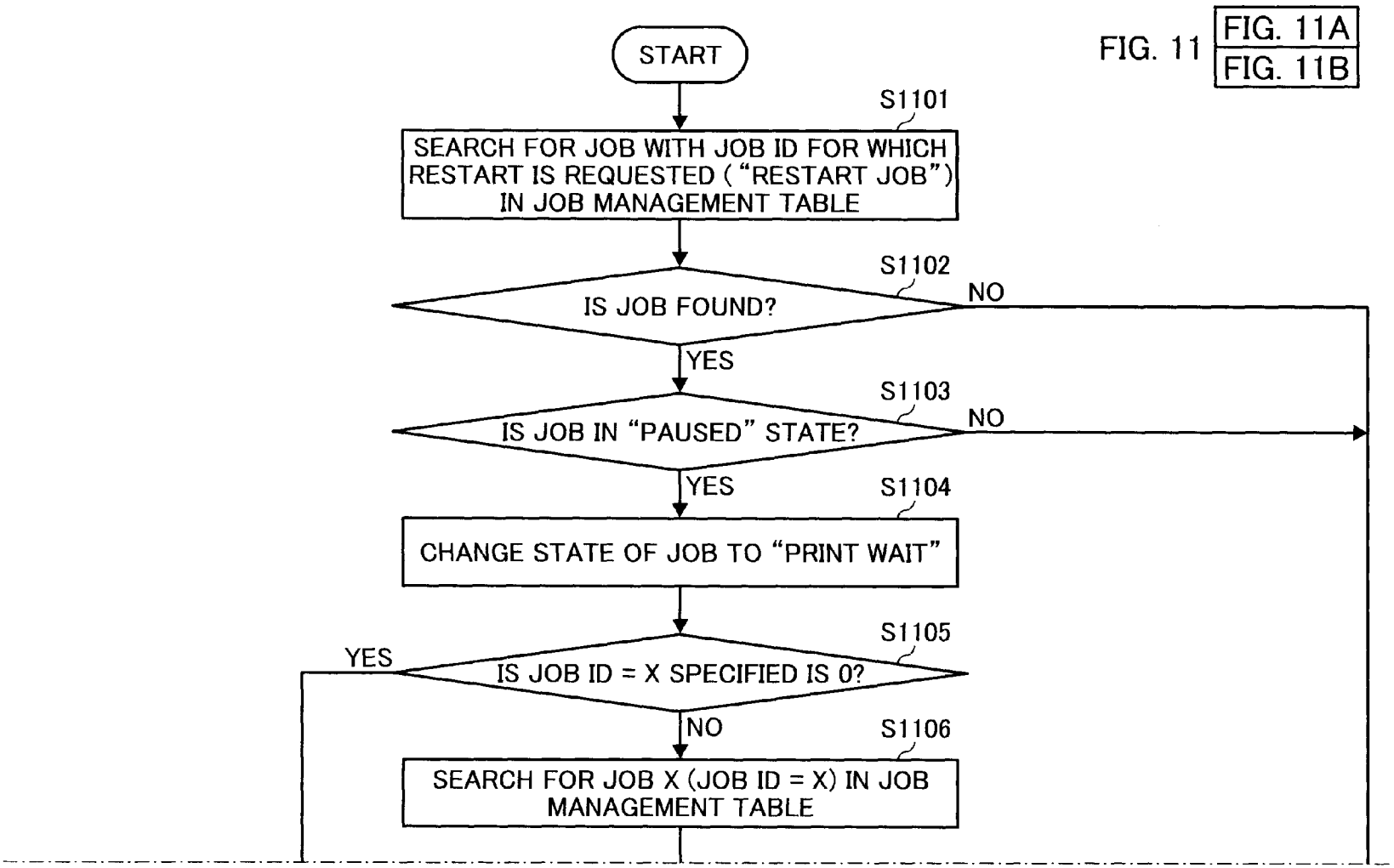
FIG. 11 is a flowchart of an algorithm for a job-restart requesting process in a printing apparatus according to a fourth embodiment of the present invention.
Figure 11B:
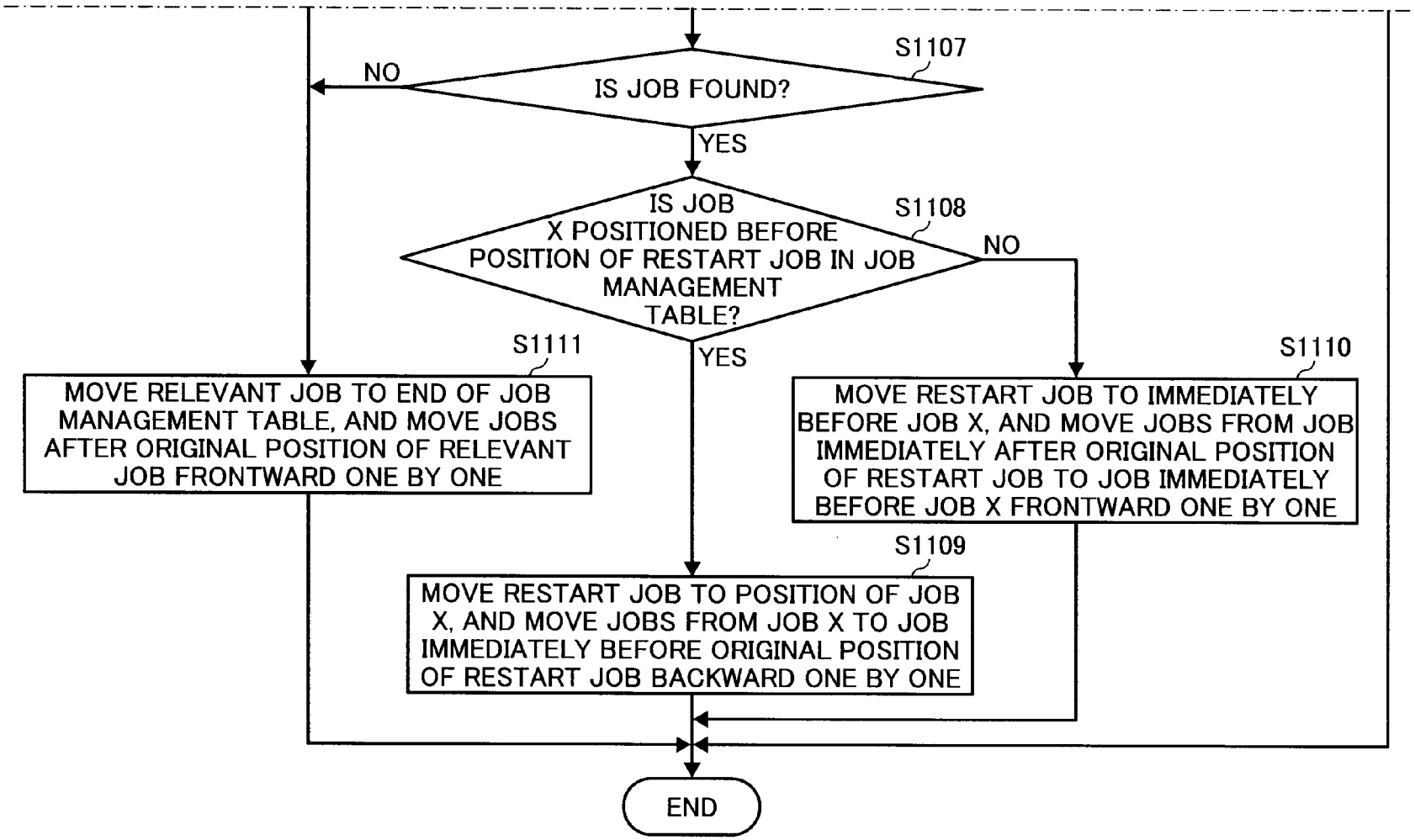

A printing apparatus according to the fourth embodiment is essentially of the same construction and operates in the similar manner as that of the first embodiment except that the order in which the restart print job is processed is specified. That is, upon receiving a restart request for a print job being paused, the printing apparatus processes the print job in the order specified. FIG. 11 is a flowchart of an algorithm for a job-restart requesting process.

The operation of the printing apparatus according to the fourth embodiment is explained below. The print-job management module 130 updates the job management table by the following processes upon suspending and restarting a job, and then, recreates the print job queue based on the job management table according to the algorithm in FIG. 6.

When a pause request for a job specified by a job ID is accepted, the pause request is processed by the algorithm in FIG. 7 similarly to the first embodiment. With this operation, the state of the job specified is changed to "paused", and the job is deleted from the print job queue by the recreating process of the print job queue.

When a restart request for a job specified by a job ID is accepted, the restart request is processed by an algorithm in FIG. 11. FIG. 11 depicts an operation when it is specified to print the job immediately before a job X (job ID=X) as a job order to restart the job. The processes at step S1101 to step S1104 of FIG. 11 are the same as these at step S801 to step S804 of FIG. 8, and the explanation thereof is omitted. At step S1105, the print-job management module 130 determines whether the job ID=X specified is 0 (step S1105). When the job ID=X specified is not 0 (No at step S1105), the print-job management module 130 searches for the job X from the job management table (step S1106).

The print-job management module 130 determines whether the job X is found (step S1107). When the job X is found (Yes at step S1107), the print-job management module 130 further determines whether the job X is positioned before the position of the restart job in the job management table (step S1108). When the job X is positioned before the restart job (Yes at step S1108), the print-job management module 130 moves the restart job to the position of the job X, and moves jobs from the job X to one immediately before the original position of the restart job, backward one by one (step S1109).

When the job X is not positioned before the restart job in the job management table (No at step S1108), the print-job management module 130 moves the restart job to the position immediately before the job X, and moves jobs from one immediately after the original position of the restart job to one immediately before the job X, frontward one by one (step S1110).

At step S1105, when the job ID=X specified is 0 (Yes at step S1105), or at step S1107, when the job X is not found (No at step S1107), the print-job management module 130 moves the job specified to the end of the job management table, and moves jobs after the original position of the job specified, frontward one by one (step S1111).

Namely, the state of the job specified is changed from "paused" to "print wait", and the position of the job specified is moved to the position immediately before the job X in the job management table. With this operation, the state of the job specified is changed to "print wait", and the job specified is printed immediately before the job X (job ID=X) by the recreating process of the print job queue.

The order in which print jobs are to be restarted can be decided by a combination of the methods according to the embodiments. Specifically, assume that a plurality of print data is received from the host computer connected through the network, print jobs containing the print data are temporarily stored, and a restart request is received for printing a print job which has been paused in response to a pause request. A predetermined printing order, i.e., the original order in which the print job has been received from the host computer, the first of all the print jobs, the last of all the print jobs, and the order specified from an external device, can be assigned to the print job to print the print data in a preset order.

Figure 12:
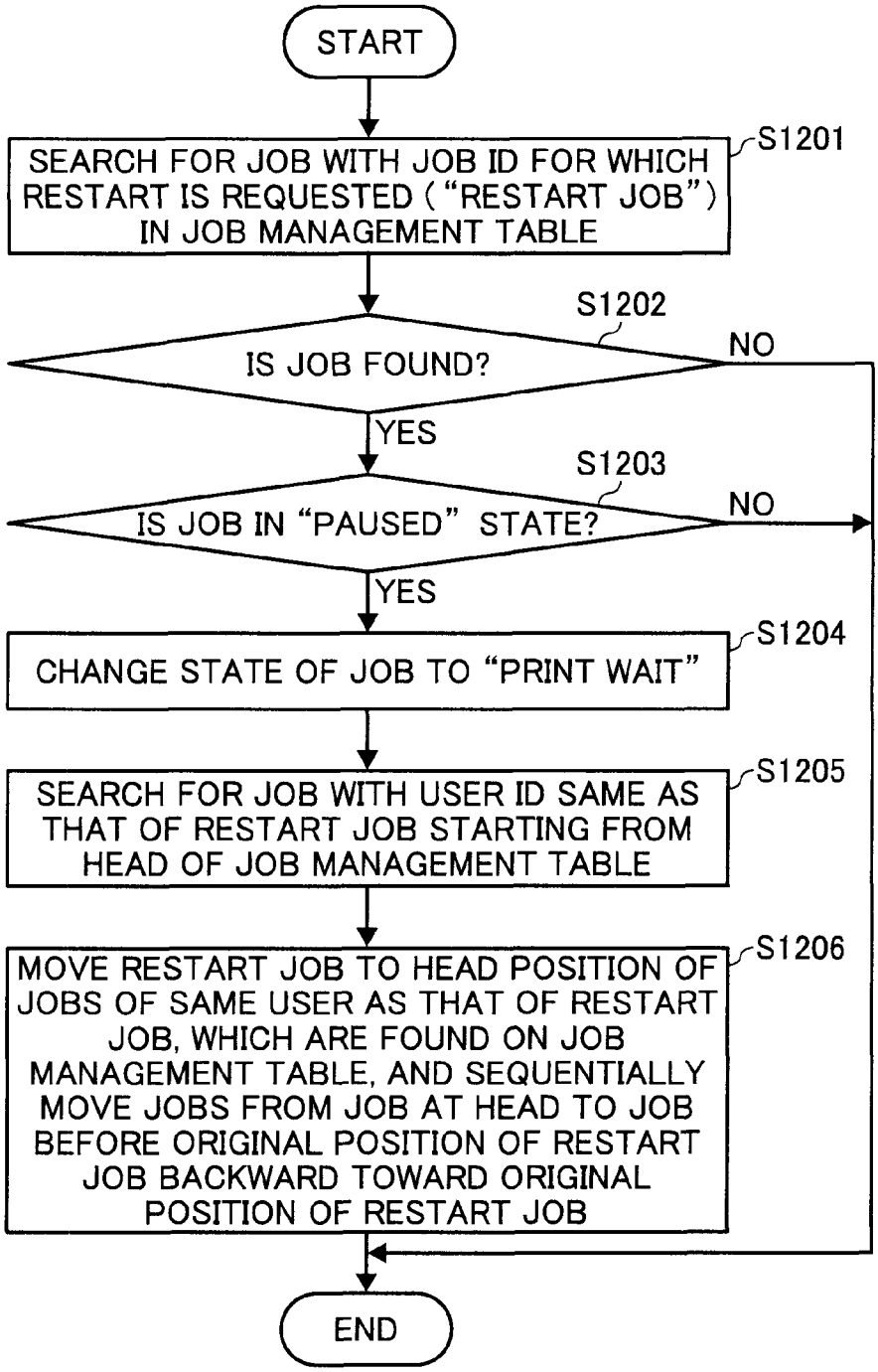
FIG. 12 is a flowchart of an algorithm for a job-restart requesting process in a printing apparatus according to a fifth embodiment of the present invention.

A printing apparatus according to the fifth embodiment is essentially of the same construction and operates in the similar manner as that of the first embodiment except that the restart print job is processed first among print jobs of the same user. That is, upon receiving a restart request for a print job being paused, the printing apparatus prints the relevant print job first of a plurality of jobs of the same user as the user of the relevant print job without changing the printing order of print jobs of other users. FIG. 12 is a flowchart of an algorithm for a job-restart requesting process.

The operation of the printing apparatus according to the fifth embodiment is explained below. The print-job management module 130 updates the job management table by the following processes upon suspending and restarting a job, and then, recreates the print job queue based on the job management table according to the algorithm in FIG. 6.

When a pause request for a job specified by a job ID is accepted, the pause request is processed by the algorithm in FIG. 7 similarly to the first embodiment. With this operation, the state of the job specified is changed to "paused", and the job is deleted from the print job queue by the recreating process of the print job queue.

When a restart request for a job specified by a job ID is accepted, the restart request is processed by an algorithm in FIG. 12. The processes at step S1201 to step S1204 of FIG. 12 are the same as these at step S801 to step S804 of FIG. 8, and the explanation thereof is omitted. At step S1205, the print-job management module 130 searches for a job whose user ID is the same as that of the restart job, starting from the head of the job management table (step S1205). The print-job management module 130 moves the restart job to the head position of the jobs of the same user as that of the restart job, which are found on the job management table, and sequentially moves jobs from the job at the head position to the job before the original position of the restart job, backward toward the original position of the restart job, of the jobs of the same user (step S1206).

Namely, the state of the job specified is changed from "paused" to "print wait", and the position of the job specified is moved to the head of the jobs of the same user in the job management table. The positions of the jobs of other users remain unchanged. With this operation, the state of the job specified is changed to "print wait", and the job specified is printed first in the order in which the jobs of the same user as that of the job specified are submitted, by the recreating process of the print job queue.

A printing apparatus according to the sixth embodiment is essentially of the same construction and operates in the similar manner as that of the first embodiment except that the restart print job is processed last among print jobs of the same user. That is, upon receiving a restart request for a print job being paused, the printing apparatus processes the print job at the end of a plurality of jobs of the same user as the user of a print job specified without changing the printing order of print jobs of other users FIG. 13 is a flowchart of an algorithm for a job-restart requesting process.

The operation of the printing apparatus according to the sixth embodiment is explained below. The print-job management module 130 updates the job management table by the following processes upon suspending or restarting a job, and then, recreates the print job queue based on the job management table according to the algorithm in FIG. 6.

When a pause request for a job specified by a job ID is accepted, the pause request is processed by the algorithm in FIG. 7 similarly to the first embodiment. With this operation, the state of the job specified is changed to "paused", and the job is deleted from the print job queue by the recreating process of the print job queue.

Figure 13:
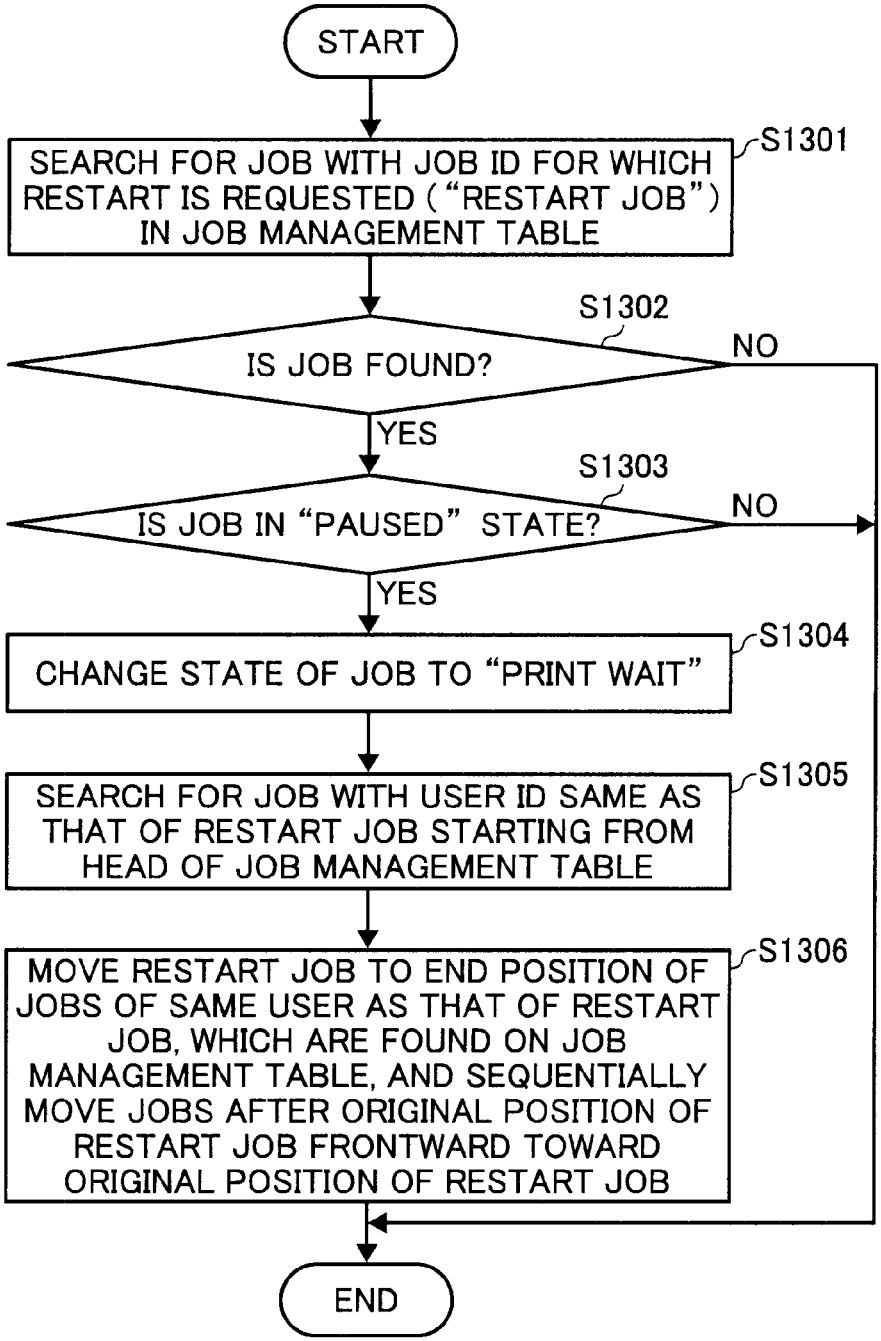
FIG. 13 is a flowchart of an algorithm for a job-restart requesting process in a printing apparatus according to a sixth embodiment of the present invention.

When a restart request for a job specified by a job ID is accepted, the restart request is processed by an algorithm in FIG. 13. The processes at step S1301 to step S1304 of FIG. 13 are the same as these at step S801 to step S804 of FIG. 8, and the explanation thereof is omitted. At step S1305, the print-job management module 130 searches for a job whose user ID is the same as that of the job whose restart is requested (hereinafter, "restart job") starting from the head of the job management table (step S1305). The print-job management module 130 moves the restart job to the end position of the jobs of the same user as that of the restart job, which are found on the job management table, and sequentially moves jobs after the original position of the restart job, frontward toward the original position of the restart job, of the jobs of the same user (step S1306).

Namely, the state of the job specified is changed from "paused" to "print wait", and the position of the job specified is moved to the end of the jobs of the same user in the job management table. The positions of the jobs of other users remain unchanged. With this operation, the state of the job specified is changed to "print wait", and the job specified is printed at the end in the order in which the jobs of the same user as that of the job specified are submitted, by the recreating process of the print job queue.

Figure 14A:
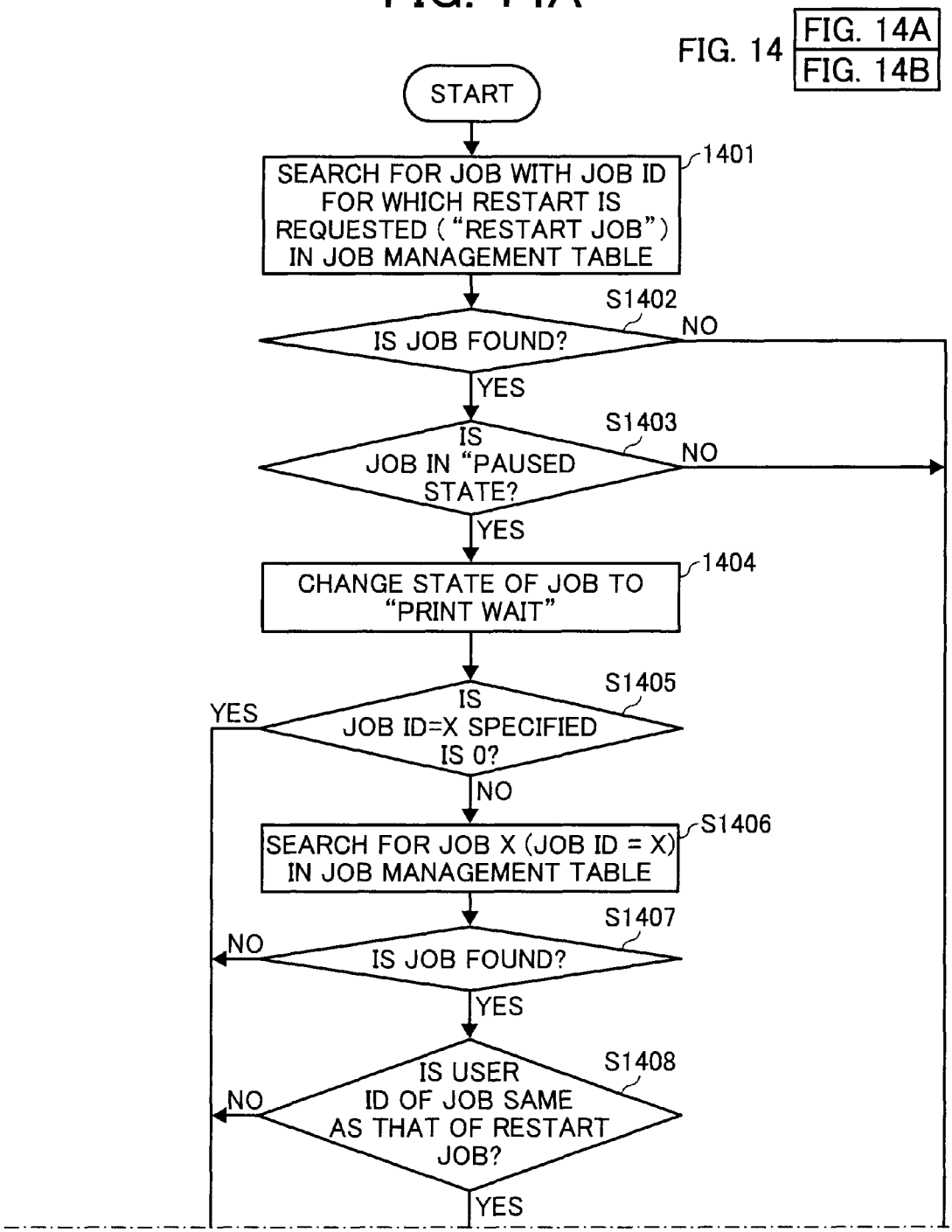
FIG. 14 is a flowchart of an algorithm for a job-restart requesting process in a printing apparatus according to a seventh embodiment of the present invention.
Figure 14B:
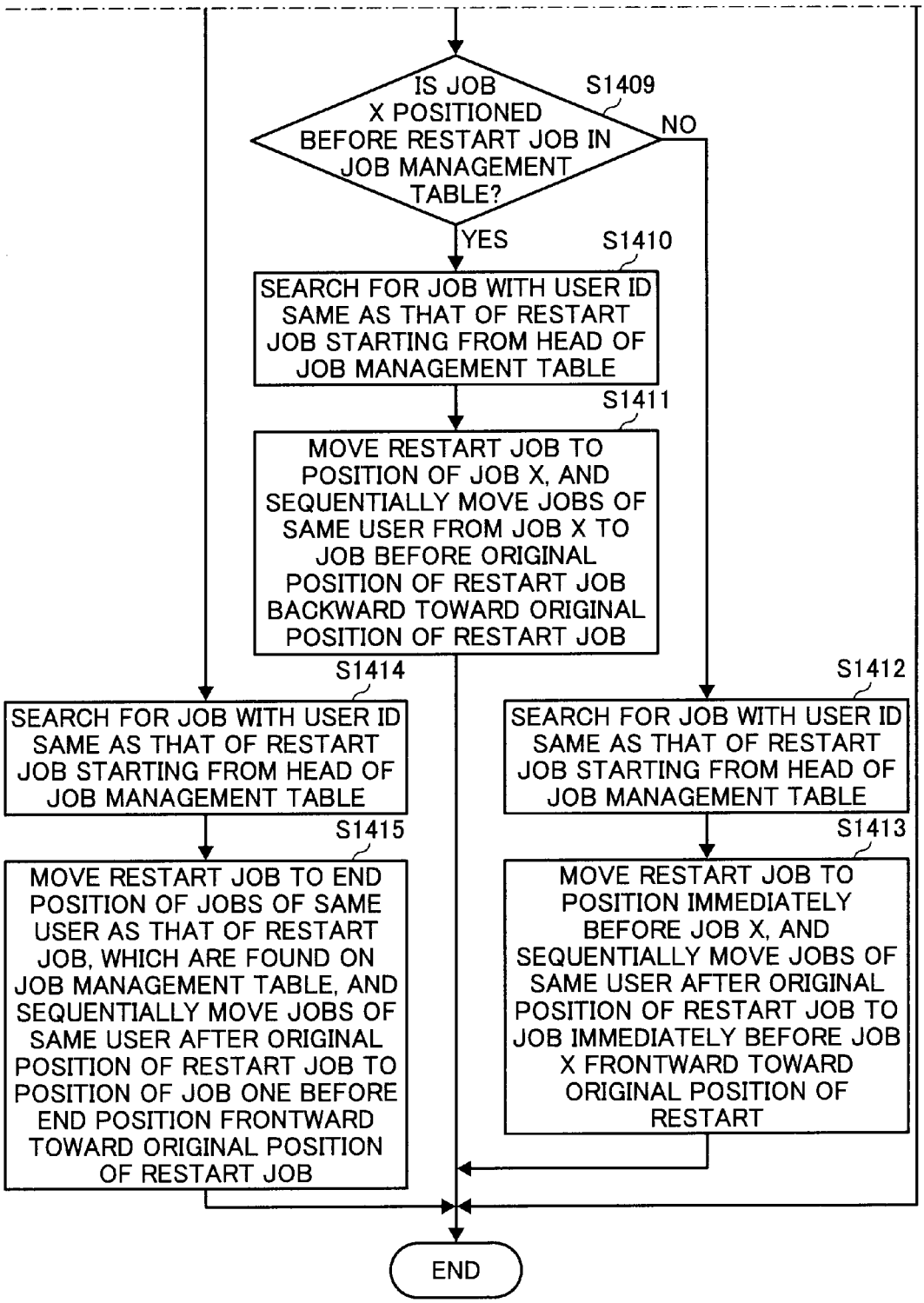

A printing apparatus according to the seventh embodiment is essentially of the same construction and operates in the similar manner as that of the first embodiment except that the restart print job is processed in the order specified among print jobs of the same user. That is, upon receiving a restart request for a print job being paused, the printing apparatus processes the print job in the order specified among a plurality of jobs of the same user as the user of the print job specified without changing the printing order of print jobs of other users. FIG. 14 is a flowchart of an algorithm for a job-restart requesting process.

The operation of the printing apparatus according to the seventh embodiment is explained below. The print-job management module 130 updates the job management table by the following processes upon suspending or restarting a job, and then, recreates the print job queue based on the job management table according to the algorithm in FIG. 6.

When a pause request for a job specified by a job ID is accepted, the pause request is processed by the algorithm in FIG. 7 similarly to the first embodiment. With this operation, the state of the job specified is changed to "paused", and the job is deleted from the print job queue by the recreating process of the print job queue.

When a restart request for a job specified by a job ID is accepted, the restart request is processed by an algorithm in FIG. 14. The processes at step S1401 to step S1404 of FIG. 14 are the same as these at step S801 to step S804 of FIG. 8, and the explanation thereof is omitted. At step S1405, the print-job management module 130 determines whether the job ID=X specified is 0 (step S1405). When the job ID=X is not 0 (No at step S1405), the print-job management module 130 searches for the job X in the job management table (step S1406).

The print-job management module 130 determines whether the job X is found (step S1407). When the job X is found (Yes at step S1407), the print-job management module 130 further determines whether the user ID of the job X is the same as that of the restart job (step S1408). When the user ID of the job X is the same as that of the restart job (Yes at step S1408), the print-job management module 130 determines whether the job X is positioned before the position of the restart job in the job management table (step S1409).

When the job X is positioned before the position of the restart job in the job management table (Yes at step S1409), the print-job management module 130 searches for jobs with the user ID the same as that of the restart job, starting from the head of the job management table (step S1410). The print-job management module 130 moves the restart job to the position of the job X, and sequentially moves the jobs of the same user from the job X to the job before the original position of the restart job, backward toward the original position of the restart job, in the jobs of the same user (step S1411).

At step S1409, when the job X is not positioned before the restart job in the job management table (No at step S1409), the print-job management module 130 searches for a job with the user ID the same as that of the restart job, starting from the head of the job management table (step S1412). The print-job management module 130 moves the restart job to the position immediately before the job X, and moves the jobs of the same user from the job after the original position of the restart job to the job immediately before the job X, frontward toward the original position one by one, in the jobs of the same user (1413).

At step S1405, when the job ID=is 0 (Yes at step S1405), or at step S1407, when the job X is not found (No at step S1407), or at step S1400, when the user ID of the job X is not the same as that of the restart job (No at step S1408), the print-job management module 130 searches for a job with the user ID the same as that of the restart job, starting from the head of the job management table (step S1414). The print-job management module 130 moves the restart job to the end position of the jobs of the same user as that of the restart job, which are found on the job management table, and sequentially moves the jobs of the same user, from the job after the original position of the restart job to a job one immediately before the end position, frontward toward the original position of the restart job (1415).

Namely, the state of the job specified is changed from "paused" to "print wait", and the position of the job specified is moved to the position immediately before the job X of the jobs of the same user in the job management table. However, the positions of the jobs of other users remain unchanged. With this operation, the state of the job specified is changed to "print wait", and the job specified is printed immediately before the job X (job ID=X) of the jobs of the same user as that of the job specified. Each job after the job specified is printed at a position delayed by one from its original order, in the jobs of each user which each job belongs to.

The order of the restart print job may also be decided by combining the methods according to the embodiments. More specifically, it may be configured to receive a plurality of print data from the host computer connected through the network; temporarily store print jobs containing the print data received; manage user information together with the print job if the user information indicating printing is added to the print data; accept a pause request and a restart request for printing of a print job; set a printing order, explained below, in the print job without changing an execution order of print jobs of other users when the restart request for the print job being paused is accepted; and print the print data stored, in the order set. The printing order is previously determined as any one of the first order and the last order of print jobs of the same user as that of the print job, and of the order specified from an external device.

The printing apparatuses according to the embodiments are most appropriate as a printing apparatus capable of managing a print job containing print data transmitted from a host computer and performing the pause and restart operations on the job.

Based on the configuration as above, when the print job being paused is to be restarted, the user can know in which order the restart print job is processed. The print job can be printed in arbitrary order such as the first or the last order according to an instruction. Moreover, by specifying the order in the print jobs of the same user, the print job can be restarted without causing other users to be disadvantaged.

Features of an image forming apparatus according to an eighth embodiment are explained below with reference to FIG. 15. The image forming apparatus includes a storage unit (corresponding to RAM 274) that stores print jobs, and causes a printing process of at least one of print jobs stored in the storage unit to be restarted when the memory full occurs in the storage unit. With this operation, if the memory full occurs in the image forming apparatus, the memory full therein can be cleared up and the subsequent processes can be continued.

The image forming apparatus deletes at least one of the print jobs stored in the storage unit when the memory full occurs in the storage unit. With this operation, if the memory full occurs in the image forming apparatus, the memory full therein can be cleared up.

Figure 15:
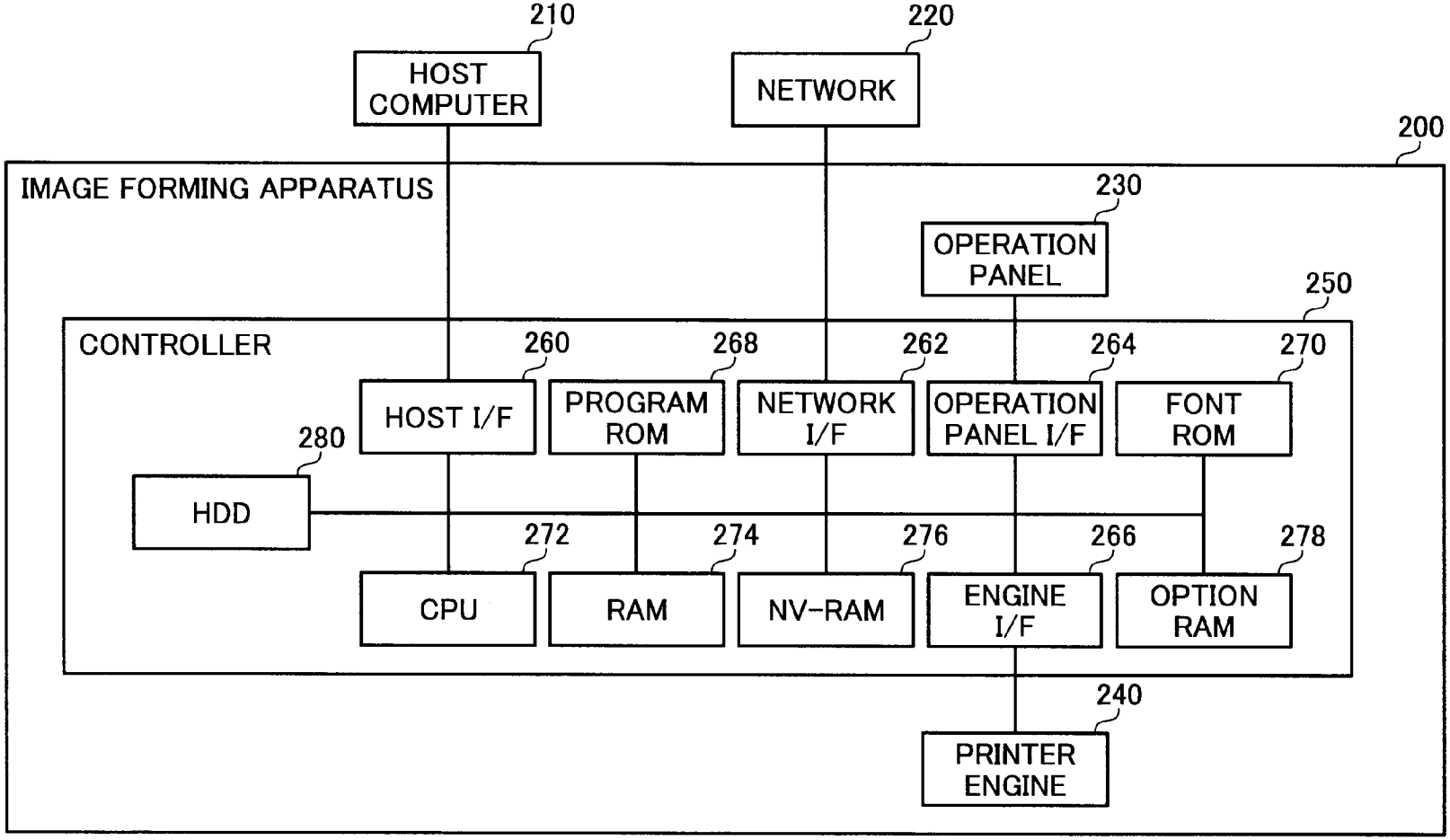
FIG. 15 is a block diagram of an image forming apparatus according to an eighth embodiment of the present invention.

FIG. 15 is a schematic block diagram of an image forming apparatus 200 according to the eighth embodiment. The image forming apparatus 200 is connected to a host computer 210 and a network 220 as shown in FIG. 15. The image forming apparatus 200 includes an operation panel 230, a printer engine 240, and a controller 250.

The operation panel 230 includes a display unit (not shown) for displaying operation states of the image forming apparatus 200, and a switching unit (not shown) for switching an operation mode and a font in the image forming apparatus 200.

The printer engine 240 forms an electrostatic latent image on a photosensitive element based on video signals and control signals sent from the controller 250, and develops the electrostatic latent image formed thereon, to form an image on a transfer paper.

The controller 250 outputs the video signals created based on an operation mode set in the image forming apparatus 200 and on "data for printing" output from the host computer 210 or from the network 220, to the printer engine 240.

The "data for printing" contains "printing control data", "print data", and "other data". The controller 250 converts "print data" to the video signals according to "printing control data" and outputs the video signals converted, to the printer engine 240.

The controller 250 operates the printer engine 240 according to a print condition changed based on a setting change command (instruction to change the print condition) contained in the "other data" in the "data for printing" output from the host computer 210 or the network 220.

It is noted that the print condition changed is automatically initialized by a reset command to release the print condition changed, to be returned to the original print condition before the change. The print condition mentioned here indicates various conditions on printing such as number of copies, duplex printing, scaling printing, color printing, and monochrome printing.

The controller 250 includes a host I/F 260, a network I/F 262, an operation panel I/F 264, an engine I/F 266, program ROM 268, font ROM 270, CPU 272, RAM 274, NVRAM 276, option RAM 278, and a hard disk drive (HDD) 280.

The host I/F 260 receives "data for printing", i.e., "printing control data", "print data", and "other data" from the host computer 210, and outputs a state signal to the host computer 210. The network I/F 262 receives "data for printing" from the network 220, and outputs a state signal to the network 220.

Both the host I/F 260 and the network I/F 262 are interfaces for parallel port (e.g., IEEE 1284), and are generally used as interfaces each between the host computer 210 or a personal computer (not shown) and a printer. A data transfer mode of the interface for parallel port includes five modes such as Centronics compatible mode, Nibble mode, Byte mode, Extended Capabilities Port (ECP) mode, and Enhanced Parallel Port (EPP) mode.

The operation panel I/F 264 inputs/outputs various signals between the controller 250 and the operation panel 230. The engine I/F 266 receives a video signal and a control signal from the controller 250 and outputs a state signal to the controller 250.

The program ROM 268 stores a data analyzing program and a print condition for initialization. Specifically, the data analyzing program controls data process, data management, peripheral modules in the controller 250. The font ROM 270 stores various types of font data used for printing.

The CPU 272 processes the "data for printing" sent from the host computer 210, according to the data analyzing program stored in the program ROM 268. The CPU 272 serves as a changing unit, a releasing unit, a detecting unit, and a recognizing unit.

The RAM 274 is used as work memory when the CPU 272 performs the processes, used as a buffer for managing "printing control data" and "print data" output from the host computer 210 page by page, and for temporarily storing the data, used as a buffer for temporarily storing the print condition output from the host computer 210, and used as bitmap memory for storing the "printing control data" and the "print data" converted to an actual print pattern, as video data.

The NVRAM 276 is non-volatile RAM for storing data which should be stored even when the power to the image forming apparatus 200 is turned off. The option RAM 278 is used for extension. The HDD 280 is a storage unit for storing large volumes of data such as print jobs.

Control Operation of Image Forming Apparatus 200

The printing operation of the image forming apparatus 200 is explained below. First, the "data for printing" transferred from the host computer 210 via the host I/F 260 is analyzed by the CPU 272 according to the data analyzing program stored in the program ROM 268. The "data for printing" analyzed is classified into "print data", "printing control data" (SP, CR, LF, HT, VT, . . . ), and "other data". The "print data" and the "printing control data" are temporarily stored in a reception buffer of the RAM 274.

The "print data" and the "printing control data" are processed one by one according to the data analyzing program stored in the program ROM 268, and are temporarily stored in an intermediate buffer of the RAM 274. For example, if the "print data" is character code, an intermediate code containing a print position, a print size, font information, and the like is created, and the intermediate code is temporarily stored in the intermediate buffer of the RAM 274.

If the "printing control data" is a command such as an escape sequence, the process previously defined in the command is executed. For example, if the command indicates specification of the print position, the position of a subsequent character code is set to the position specified. If the command indicates change of a font, the font information of a subsequent character code is set to the font specified.

As explained above, the CPU 272 processes the "data for printing" output from the host computer 210, and converts the intermediate code stored in the intermediate buffer to a video signal according to the data analyzing program when the data processed exceeds the amount for one page. When the conversion of the intermediate code to the video signal by the CPU 272 is finished, the controller 250 outputs an instruction signal indicating a start of printing to the printer engine 240 via the engine I/F 266, and the controller 250 transfers the video signal to the printer engine 240 in synchronization with the output of the instruction signal. The printer engine 240 prints the video signal transferred from the controller 250 to a transfer paper based on the print condition set by the host computer 210. In other words, the printer engine 240 prints the "print data" sent from the host computer 210 according to the print condition.

Control Operation when Memory Full Occurs

Figures 16, 17:
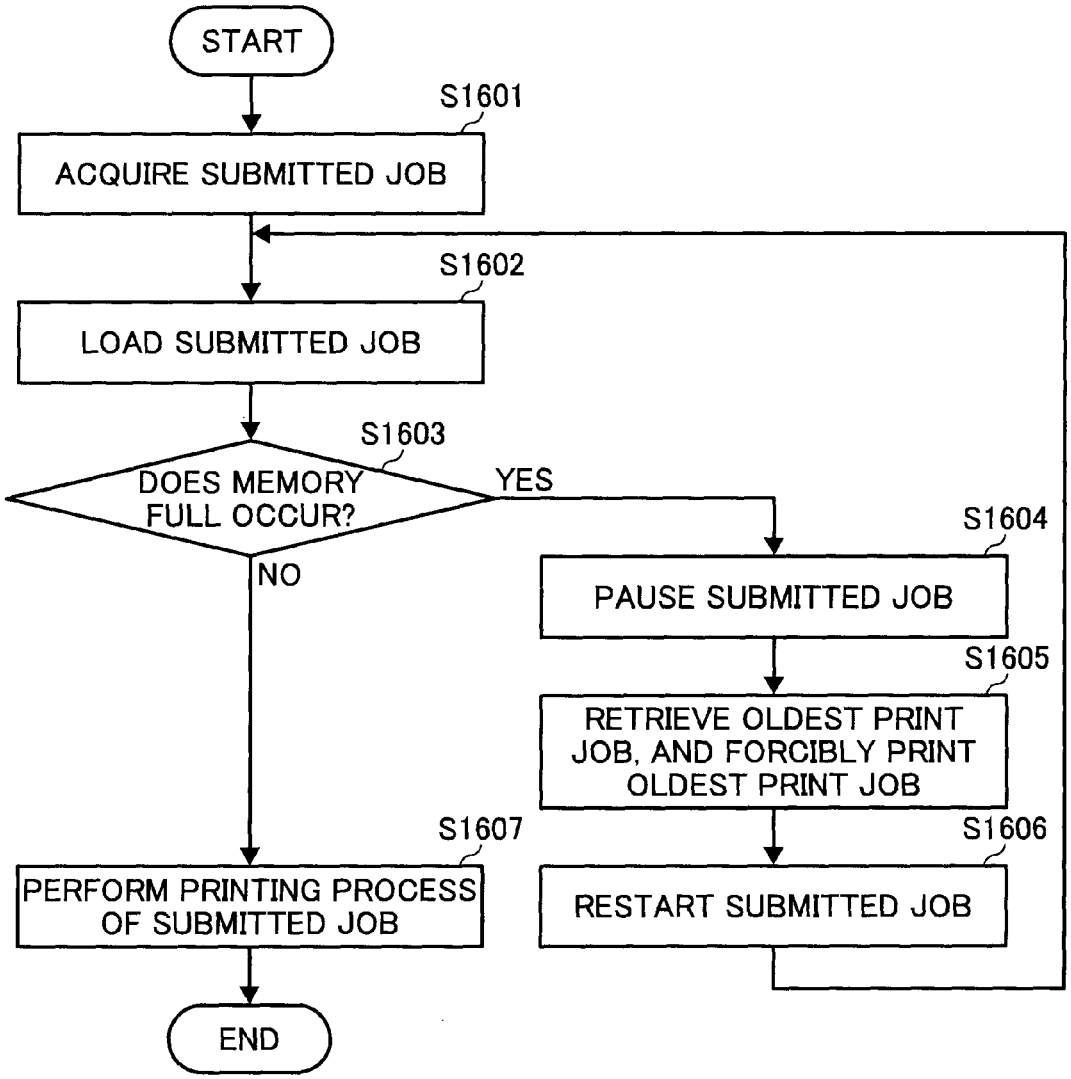
FIG. 16 is a flowchart of a control operation of the image forming apparatus.
FIG. 17 is an example of contents of a management table used for the control operation of the image forming apparatus.

FIG. 16 is a flowchart of the control operation for forcibly restarting a print job which has been paused in the image forming apparatus 200 when memory full occurs in the image forming apparatus 200.

First, the controller 250 receives print data (step S1601). When it is determined that a new job is submitted, the controller 250 starts loading the print data of the job which is newly submitted (step S1603). Then, the controller 250 determines whether the memory full occurs in the image forming apparatus (step S1603). When the memory full occurs (Yes at step S1603), the controller 250 pauses to load the print data of the submitted job (step S1604).

Then, the controller 250 retrieves an oldest print job from print jobs being paused in the image forming apparatus, and forcibly restarts loading print data of the oldest print job to print the print data of the oldest print job (step S1605).

The image forming apparatus 200 has a management table as shown in FIG. 17, and searches for an oldest print job from print jobs being paused in the image forming apparatus, based on the management table of FIG. 17.

The management table as shown in FIG. 17 is used for managing print jobs in the image forming apparatus, and manages the order in which the print jobs are submitted, by assigning management numbers 1, 2, 3, . . . to the print jobs in the order in which they are submitted to the image forming apparatus. In the management table of FIG. 17, the states of the print job such as "paused", "printing", "print wait", and "loading" are also managed together with the submission order of the print jobs.

Based on the management table shown in FIG. 17, the controller 250 acquires a print job, to which the oldest management number is assigned, from print jobs in the "paused" state in the image forming apparatus. The controller 250 determines the print job acquired from the management table as the oldest print job among the print jobs being paused, and loads the print data of the oldest print job to print the print data of the print job. With this operation, the information amount in the image forming apparatus can be reduced by the amount of the print data of the print job which is printed at step S1605. The management table as shown in FIG. 17 is only an example, and hence, any table structure can be used to manage the "submission order" of print jobs if it is possible to manage the "submission order" of print jobs.

Next, the controller 250 restarts the job which has been paused at step S1604 (step S1606), and again loads the print data of the submitted job (step S1602). When the memory full does not occur in the image forming apparatus (No at step S1603), the printing process is performed on the print data of the submitted job which has been loaded at step S1602 (step S1607).

As explained above, the image forming apparatus according to the eighth embodiment pauses to load a job which is newly submitted when the memory full occurs in the image forming apparatus during the printing of the submitted job, and forcibly restarts the printing process of the oldest print job from the print jobs being paused in the image forming apparatus. It is thereby possible to clear up the memory full in the image forming apparatus and perform the printing process of the job which is newly submitted. By controlling so as to forcibly restart the printing process from the oldest print job in the image forming apparatus, the memory full can be cleared up without disrupting the order of the print jobs submitted to the image forming apparatus. In the eighth embodiment, when the memory full occurs in the image forming apparatus, only one job as the oldest print job in the image forming apparatus can also be forcibly restarted.

Figures 18, 19:
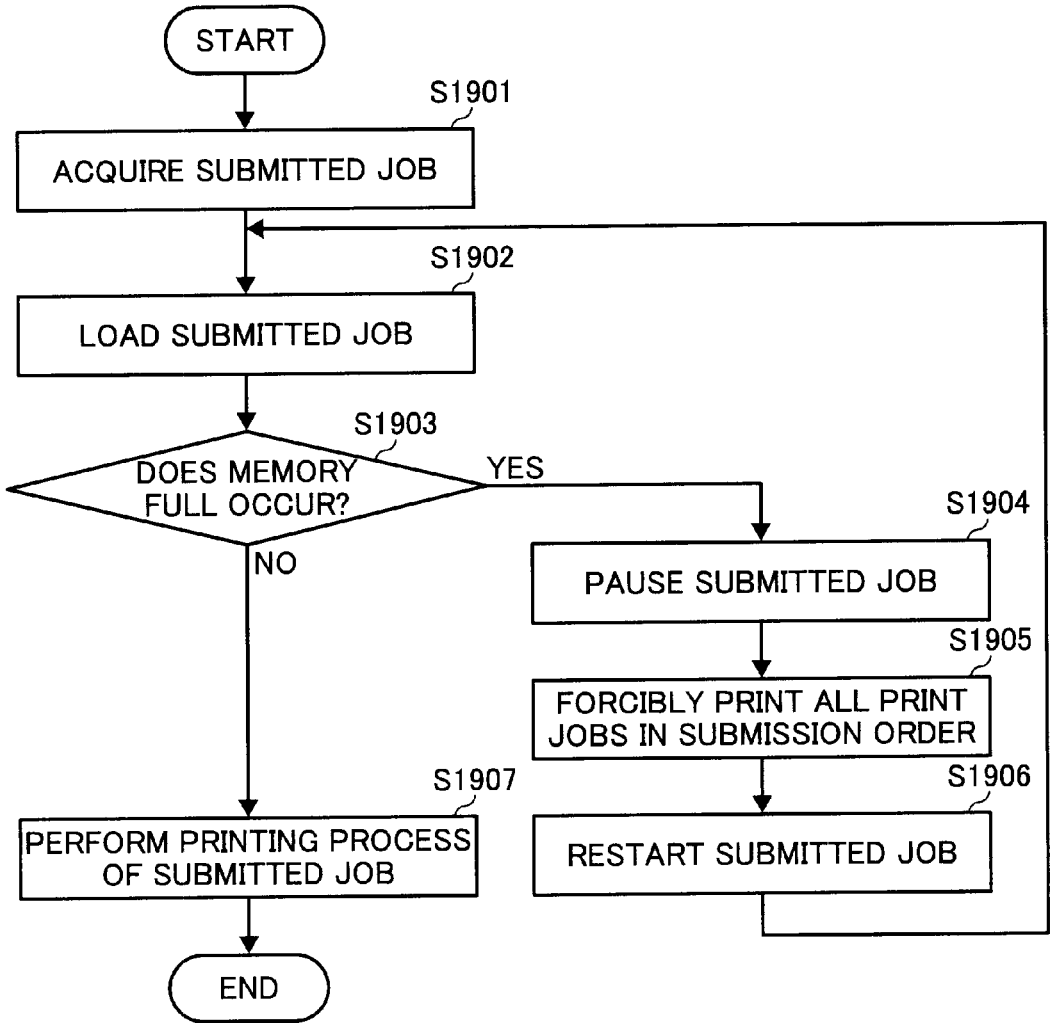
FIG. 18 is an example of contents of a management table used for a control operation of an image forming apparatus according to a ninth embodiment of the present invention.
FIG. 19 is a flowchart of a control operation of an image forming apparatus according to a tenth embodiment of the present invention.

A ninth embodiment is explained below. The image forming apparatus 200 controls so as to sequentially retrieve a print job to which the oldest management number is assigned, from print jobs in the "paused" state in the image forming apparatus, based on the management table as shown in FIG. 17, and to forcibly restart the printing process from the print job retrieved. However, as shown in FIG. 18, an image forming apparatus according to the ninth embodiment controls so as to sequentially retrieve a print job whose "submitted date and time" is the earliest, from among the print jobs in the "paused" state in the image forming apparatus, based on a management table for recording and managing "submitted date and time" of each print job, and to forcibly restart the printing process from the print job retrieved. With this operation, the memory full in the image forming apparatus can be cleared up and the printing process can be performed on the job which is newly submitted, similarly to the eighth embodiment. As shown in FIG. 18, by managing "submitted date and time" of each print job, detailed information on the print jobs can be managed. It is noted that the management table shown in FIG. 18 is only an example, and hence, any table structure can be used to manage "submitted date and time" of each print job if it is possible to manage the "submitted date and time" of the print job.

A tenth embodiment is explained below. As shown in FIG. 16, the image forming apparatus 200 pauses the printing process of the job which is newly submitted (step S1604) when the memory full occurs in the image forming apparatus (Yes at step S1603), and to forcibly restart the printing process from the oldest print job which has been paused in the image forming apparatus at step S1605. As shown in FIG. 19, an image forming apparatus according to the tenth embodiment pauses the printing process of a job which is newly submitted (step S1904) when the memory full occurs in the image forming apparatus (Yes at step S1903), and, at step S1905, to forcibly restart the printing process of all the print jobs being paused in the image forming apparatus in the order in which the print jobs are submitted. With this operation, all the print jobs being paused in the image forming apparatus can be forcibly restarted in their submission order, and the memory full in the image forming apparatus can be reliably cleared up without disrupting the order of the print jobs submitted to the image forming apparatus.

Therefore, unlike the eighth embodiment, it is possible to perform the printing process of the submitted job at step S1607 without determining at step S1603 whether the memory full occurs after the submitted job is restarted at step S1606, which enables achievement of process simplification. The management tables shown in FIGS. 17 and 18 are used when all the print jobs being paused in the image forming apparatus are forcibly restarted in their submission order.

An eleventh embodiment is explained below. In an image forming apparatus according to the eleventh embodiment, when the memory full occurs, the printing process is forcibly restarted from a print job with a largest information amount among the print jobs being paused in the image forming apparatus. When the memory full occurs in the image forming apparatus, by forcibly restarting from the print job with the largest information amount among the print jobs being paused in the image forming apparatus, the number of print jobs which are to be forcibly restarted can be reduced to as few as possible. The eleventh embodiment is explained below with reference to FIG. 20.

First, the controller 250 receives print data (step S2001). When it is determined that a new print job is submitted, the controller 250 starts loading the print data of the job which is newly submitted (step S2002). Then, the controller 250 determines whether the memory full occurs in the image forming apparatus (step S2003). When the memory full occurs (Yes at step S2003), the controller 250 pauses the submitted job of the print data which is being loaded ("loading") at step S2002 (step S2004).

Then, the controller 250 retrieves a print job with the largest information amount from among print jobs being paused in the image forming apparatus, and forcibly restarts loading print data of the print job with the largest information amount to print the print data of the print job (step S2005).

Figures 20, 21:
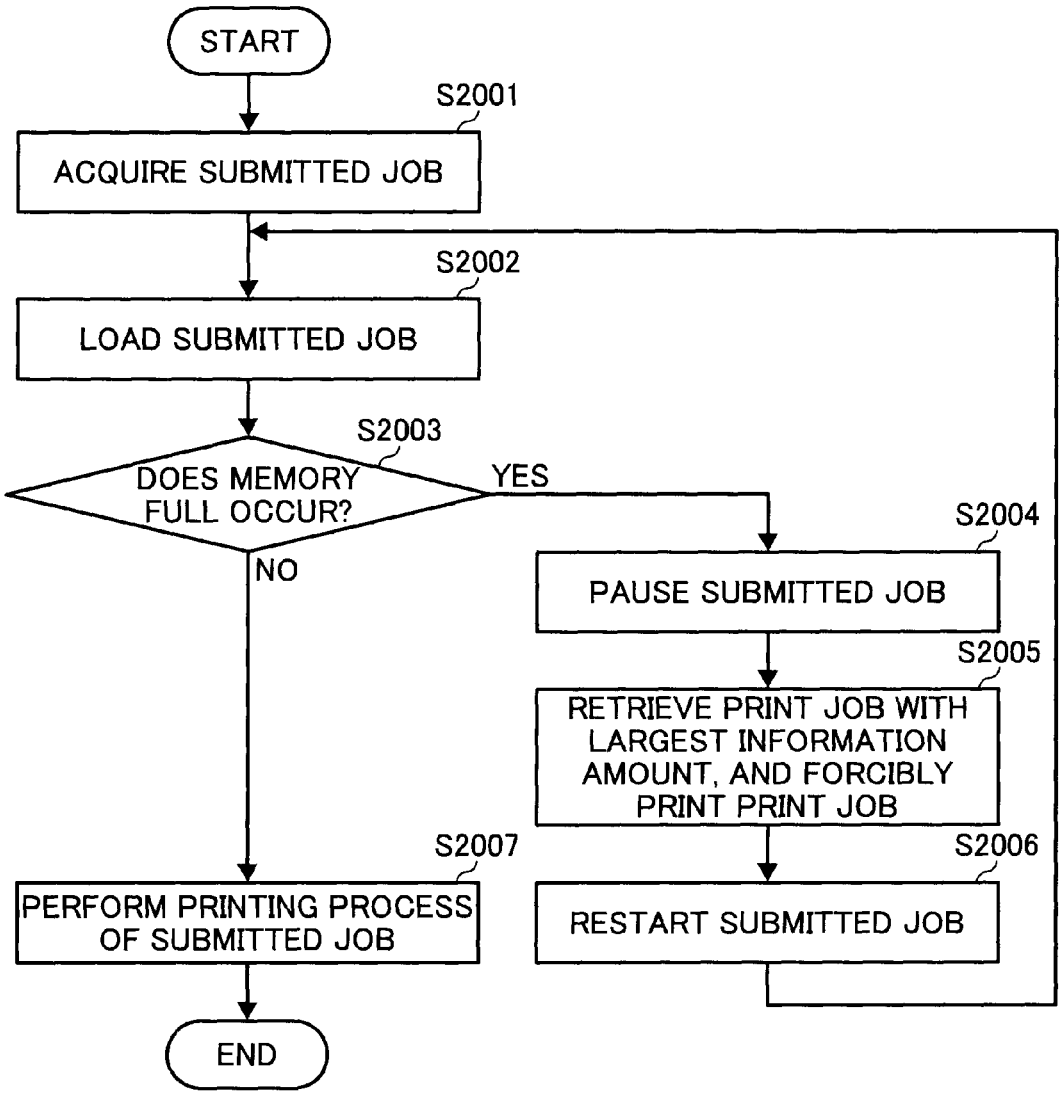
FIG. 20 is a flowchart of a control operation of an image forming apparatus according to an eleventh embodiment of the present invention.
FIG. 21 is an example of contents of a management table used for the control operation of the image forming apparatus shown in FIG. 20.

The image forming apparatus according to the eleventh embodiment has a management table as shown in FIG. 21, and searches for a print job with the largest information amount from among the print jobs being paused in the image forming apparatus based on the management table.

The management table as shown in FIG. 21 is used for managing print jobs in the image forming apparatus, and manages each "occupied memory space" indicating how much space each information amount of print jobs occupies in the image forming apparatus. The management table manages the "occupied memory space" of each print job, and also manages the states of the corresponding print job such as "paused", "printing", "print wait", and "loading".

In the image forming apparatus, the controller 250 retrieves a print job with the largest "occupied memory space" from among print jobs in the "paused" state based on the management table. The controller 250 determines the print job as a print job with the largest information amount among the print jobs being paused in the image forming apparatus, and loads the print data of the print job with the largest information amount to print the print data of the print job. With this operation, the information amount in the image forming apparatus can be reduced by the amount of information corresponding to the print job which is printed at step S2005. Moreover, because forcible restarting is performed from the print job with the largest information amount, a large volume of information in the image forming apparatus can be reduced at a time. The management table as shown in FIG. 21 is only an example, and hence, any table structure can be used to manage each "occupied memory space" of print jobs if it is possible to manage each "occupied memory space" of the print jobs.

Next, the controller 250 restarts the submitted job which has been paused at step S2004 (step S2006), and again loads the print data of the submitted job (step S2002). When the memory full does not occur in the image forming apparatus (No at step S2003), the printing process is performed on the print data of the submitted job which is loaded at step S2002 (step S2007).

As explained above, in the image forming apparatus according to the eleventh embodiment, when the memory full occurs in the image forming apparatus, by forcibly restarting the printing process from the print job with the largest information amount among the print jobs being paused in the image forming apparatus, the number of print jobs which are to be forcibly restarted can be reduced to as few as possible.

The control operation as shown in FIG. 20 is implemented by forcibly restarting the printing process from the print job with the largest information amount among the print jobs being paused in the image forming apparatus, at step S2005.

However, it is also possible to restart only one print job with the largest information amount. The forcible restarting can also be performed from the print job with the largest information amount, and sequentially performed on the print jobs in the order of one with a larger information amount until it is determined that the image forming apparatus reserves a predetermined information capacity.

A twelfth embodiment is explained below. In an image forming apparatus according to the twelfth embodiment, when the memory full occurs, the printing process is forcibly restarted from a print job with a smallest information amount among print jobs being paused in the image forming apparatus. When the memory full occurs in the image forming apparatus, by forcibly restarting from the print job with the smallest information amount among the print jobs being paused in the image forming apparatus, it is possible to reduce the load of the control operation for forcibly restarting the print job, and also to clear up the memory full in the image forming apparatus while suppressing the effect of the load on the image forming apparatus itself to as low as possible. The image forming apparatus according to the twelfth embodiment is explained below with reference to FIG. 22.

First, the controller 250 receives print data (step S2201). When it is determined that a new print job is submitted, the controller 250 starts loading the print data of the job which is newly submitted (step S2002). Then, the controller 250 determines whether the memory full occurs in the image forming apparatus (step S2203). When the memory full occurs (Yes at step S2203), the controller 250 pauses the submitted print job of the print data which is loaded at step S2202 (step S2204).

Then, the controller 250 retrieves a print job with a smallest information amount from among print jobs being paused in the image forming apparatus, and forcibly restarts loading print data of the print job with the smallest information amount to print the print data of the print job with the smallest information amount (step S2205).

The image forming apparatus according to the twelfth embodiment has a management table as shown in FIG. 21, and searches for a print job with the smallest information amount from among the print jobs being paused in the image forming apparatus, based on the management table of FIG. 21.

The management table as shown in FIG. 21 is used for managing the print jobs in the image forming apparatus, and manages each "occupied memory space" indicating how much space each information amount of print data of print jobs occupies in the image forming apparatus. The management table of FIG. 21 manages the "occupied memory space" of each print job, and also manages the states of the corresponding print job such as "paused", "printing", "print wait", and "loading".

In the image forming apparatus, the controller 250 retrieves a print job with the smallest "occupied memory space" from among the print jobs in the "paused" state based on the management table. The controller 250 determines the print job as a print job with the smallest information amount among the print jobs being paused in the image forming apparatus, and loads the print data of the print job with the smallest information amount to print the print data of the print job. With this operation, the information amount in the image forming apparatus can be reduced by the amount of the information corresponding to the print job which is printed at step S2205. Moreover, because forcible restarting is performed from the print job with the small information amount, the information amount in the image forming apparatus can be reduced without applying the load to the image forming apparatus.

Next, the controller 250 restarts the submitted job which has been paused at step S2204 (step S2206), and again loads the print data of the submitted job (step S2202). When the memory full does not occur in the image forming apparatus (No at step S2203), the printing process is executed to the print data of the submitted job which is loaded at step S2202 (step S2207).

As explained above, in the image forming apparatus according to the twelfth embodiment, when the memory full occurs in the image forming apparatus, by forcibly restarting from the print job with the smallest information amount among the print jobs being paused in the image forming apparatus, it is possible to reduce the information amount in the image forming apparatus without applying the load to the image forming apparatus when the memory full occurs in the image forming apparatus. Thus, it is possible to clear up the memory full in the image forming apparatus while suppressing the effect of the load on the image forming apparatus itself.

Figure 22:
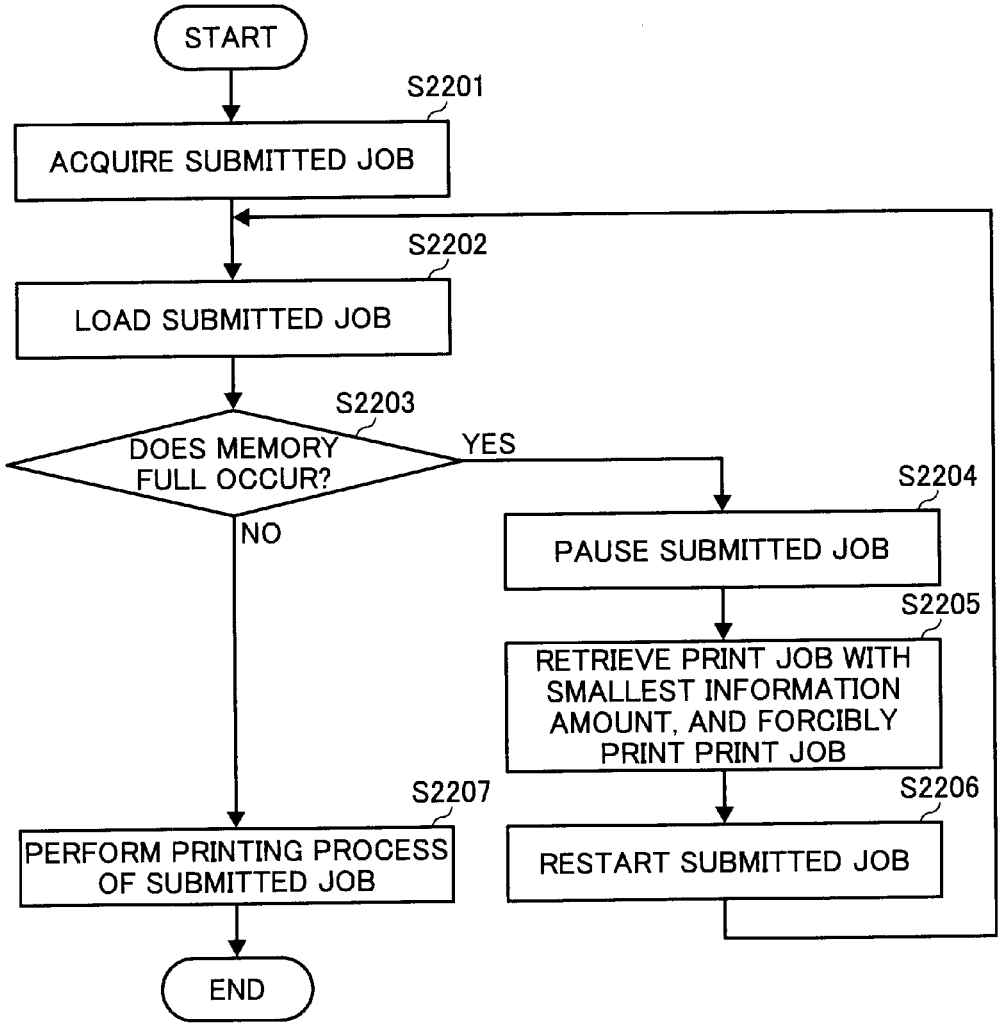
FIG. 22 is a flowchart of a control operation of an image forming apparatus according to a twelfth embodiment of the present invention.

The control operation as shown in FIG. 22 is implemented by forcibly restarting from the print job with the smallest information amount among the print jobs being paused in the image forming apparatus at step S2205, but it is also possible to control so as to restart only one print job with the smallest information amount. Furthermore, the forcible restarting can also be performed from the print job with the smallest information amount, and sequentially performed on the print jobs in the order of one with a smaller information amount until it is determined that the image forming apparatus reserves a predetermined information capacity.

A thirteenth embodiment is explained below. In an image forming apparatus according to the thirteenth embodiment, when the memory full occurs, the printing process is forcibly restarted from a print job with a lowest priority to be desired to be paused in the image forming apparatus, among print jobs being paused therein. When the memory full occurs in the image forming apparatus, by forcibly restarting from the print job with the lowest priority to be desired to be paused in the image forming apparatus among the print jobs being paused therein, it is possible to pause a print job with a higher priority in the image forming apparatus even if the print job is forcibly restarted, and also to reduce the effect of the print job paused in the image forming apparatus on a user to as low as possible. The image forming apparatus according to the thirteenth embodiment is explained below with reference to FIG. 23.

First, the controller 250 receives print data (step S2301). When it is determined that a new print job is submitted, the controller 150 starts loading the print data of the job which is newly submitted (step S2302). Then, the controller 250 determines whether the memory full occurs in the image forming apparatus (step S2303). When the memory full occurs (Yes at step S2303), the controller 250 pauses the submitted job of the print data which is loaded at step S2302 (step S2304).

Then, the controller 250 retrieves a print job with a lowest priority to be desired to be paused in the image forming apparatus from among print jobs being paused therein, and forcibly restarts loading print data of the print job with the lowest priority to print the print data of the print job with the lowest priority (step S2305).

Figures 23, 24:
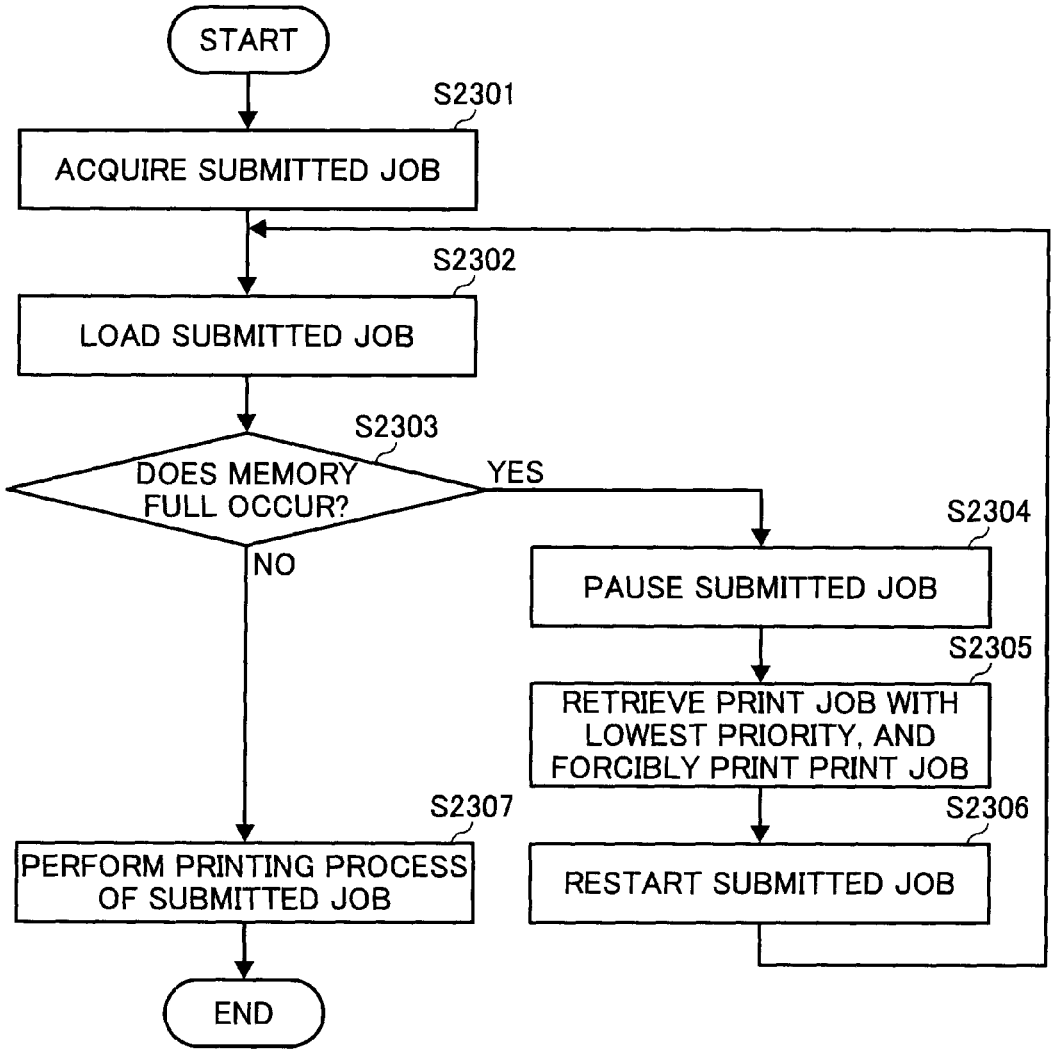
FIG. 23 is a flowchart of a control operation of an image forming apparatus according to a thirteenth embodiment of the present invention.
FIG. 24 is an example of contents of a management table used for the control operation of the image forming apparatus shown in FIG. 23.

The image forming apparatus according to the thirteenth embodiment has a management table as shown in FIG. 24, and searches for the print job with the lowest priority from among the print jobs being paused in the image forming apparatus based on the management table.

The management table as shown in FIG. 24 is used for managing the print jobs in the image forming apparatus, and manages "priority" indicating how a print job is desired to be paused in the image forming apparatus. The "priority" can be arbitrarily set by the user through the operation panel 230 of the image forming apparatus. With this operation, the "priority" can be managed for each user in the management table. The management table manages the "priority" of each print job, and also manages the states of the corresponding print job such as "paused", "printing", "print wait", and "loading".

In the image forming apparatus, the controller 250 acquires a print job with the lowest "priority" from among the print jobs in the "paused" state based on the management table. The controller 250 determines that the print job acquired from the management table is the one with the lowest priority among the print jobs being paused, and loads the print data of the print job with the lowest priority to print the print data of the print job. With this operation, the information amount in the image forming apparatus can be reduced by the amount of information corresponding to the print job which is printed at step S2305. The management table of FIG. 24 is only an example, and hence, any table structure can be used to manage the "priority" of each print job if it is possible to manage the "priority" of each print job.

Next, the controller 250 restarts the submitted job which has been paused at step S2304 (step S2306), and again loads the print data of the submitted job (step S2302). When the memory full does not occur in the image forming apparatus (No at step S2303), the printing process is executed to the print data of the submitted job which is loaded at step S2302 (step S2307).

As explained above, when the memory full occurs in the image forming apparatus, the image forming apparatus according to the thirteenth embodiment forcibly restarts the printing process from the print job with the lowest priority to be desired to be paused in the image forming apparatus among the print jobs being paused therein. The user previously sets a high priority in a particular print job. These configurations allow the print job with the high priority to be paused in the image forming apparatus even if the print job is forcibly restarted when the memory full occurs therein. This enables the effect of the print job paused in the image forming apparatus on the user to be minimized.

The control operation as shown in FIG. 23 is implemented by forcibly restarting from the print job with the lowest priority among the print jobs being paused in the image forming apparatus at step S2305. However, it is also possible to restart only one print job with the lowest priority. The forcible restarting can also be performed from the print job with the lowest priority and sequentially performed on the print jobs in the order of one with a smaller information amount until it is determined that the image forming apparatus reserves a predetermined information capacity. It is also possible to control so as to forcibly restart all the print jobs with low priority.

The "priority" managed by the management table shown in FIG. 24 can be used for the image forming apparatuses according to the embodiments. For example, the control operation in each of the image forming apparatuses can be configured in such a manner that when forcible restarting is executed from the print job with the largest information amount among the print jobs being paused therein and if there are a plurality of print jobs each of which contains the same information amount as each other, a first print job to be forcibly restarted can be selected based on its "priority". It is noted that the control operation in the image forming apparatus according to the twelfth embodiment is configured in such a manner that when forcible restarting is executed from the print job with the smallest information amount among the print jobs being paused therein and if there are a plurality of print jobs each of which contains the same information amount as each other, a first print job to be forcibly restarted can be selected based on its "priority". Accordingly, it is also possible to select a print job to be forcibly restarted using the "occupied memory space" managed by the management table shown in FIG. 21 and the "priority" managed by the management table shown in FIG. 24.

A fourteenth embodiment is explained below. The image forming apparatuses according to the embodiments are configured to control so that when the memory full occurs in the image forming apparatus, the printing process of the print job being paused therein is forcibly restarted. However, an image forming apparatus according to the fourteenth embodiment controls so that when the memory full occurs in the image forming apparatus, the print job being paused therein is forcibly discarded. With this operation, the memory full in the image forming apparatus can be cleared up, and the printing process can be performed on a job which is newly submitted.

Figure 25:
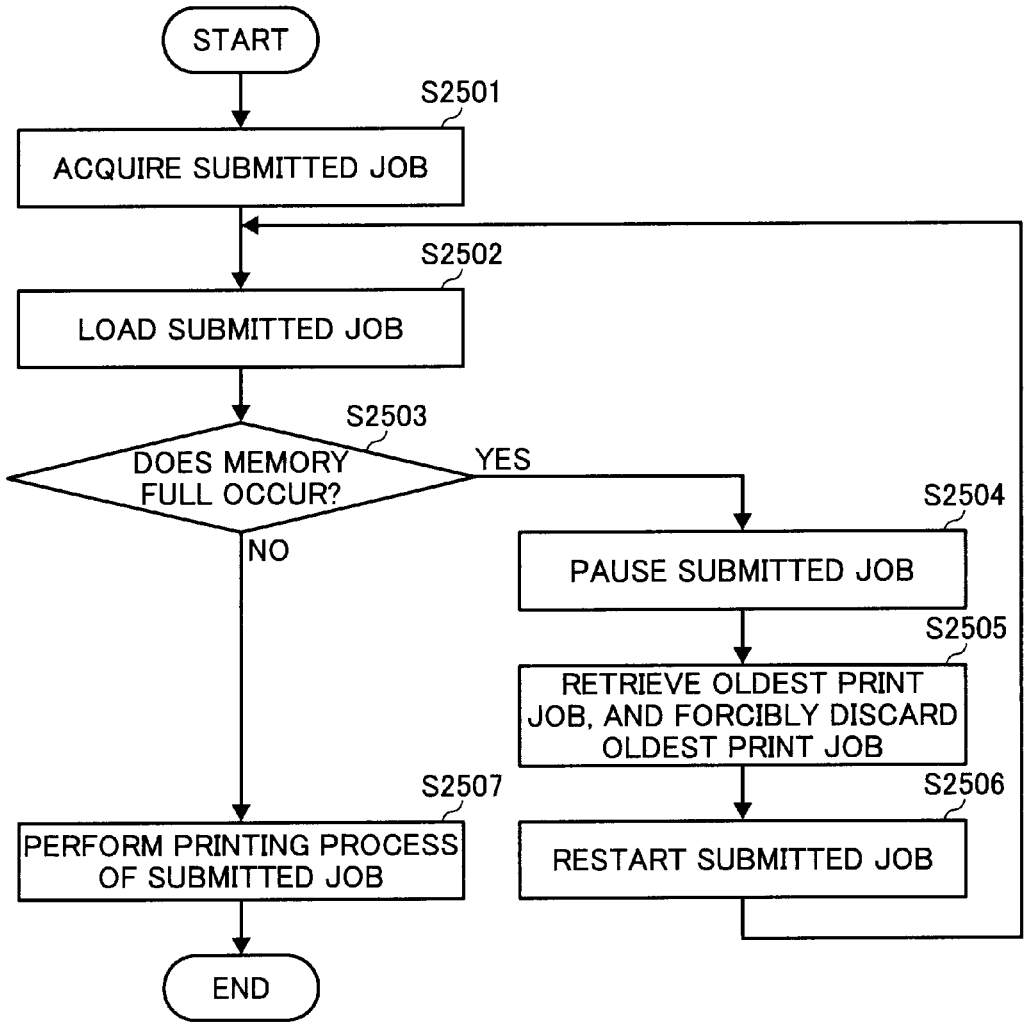
FIGS. 25 to 29 are flowcharts of control operations of an image forming apparatus according to a fourteenth embodiment of the present invention.

For example, the image forming apparatuses according to the eighth and the ninth embodiments control, as shown in FIG. 16, so that when the memory full occurs in the image forming apparatus, the printing process is forcibly restarted from the oldest print job among the print jobs being paused therein at step S1605. However, as shown in FIG. 25, when the memory full occurs in the image forming apparatus, at step S2505, it is also possible to control so as to forcibly discard the oldest print job among the print jobs being paused therein.

Figure 26:
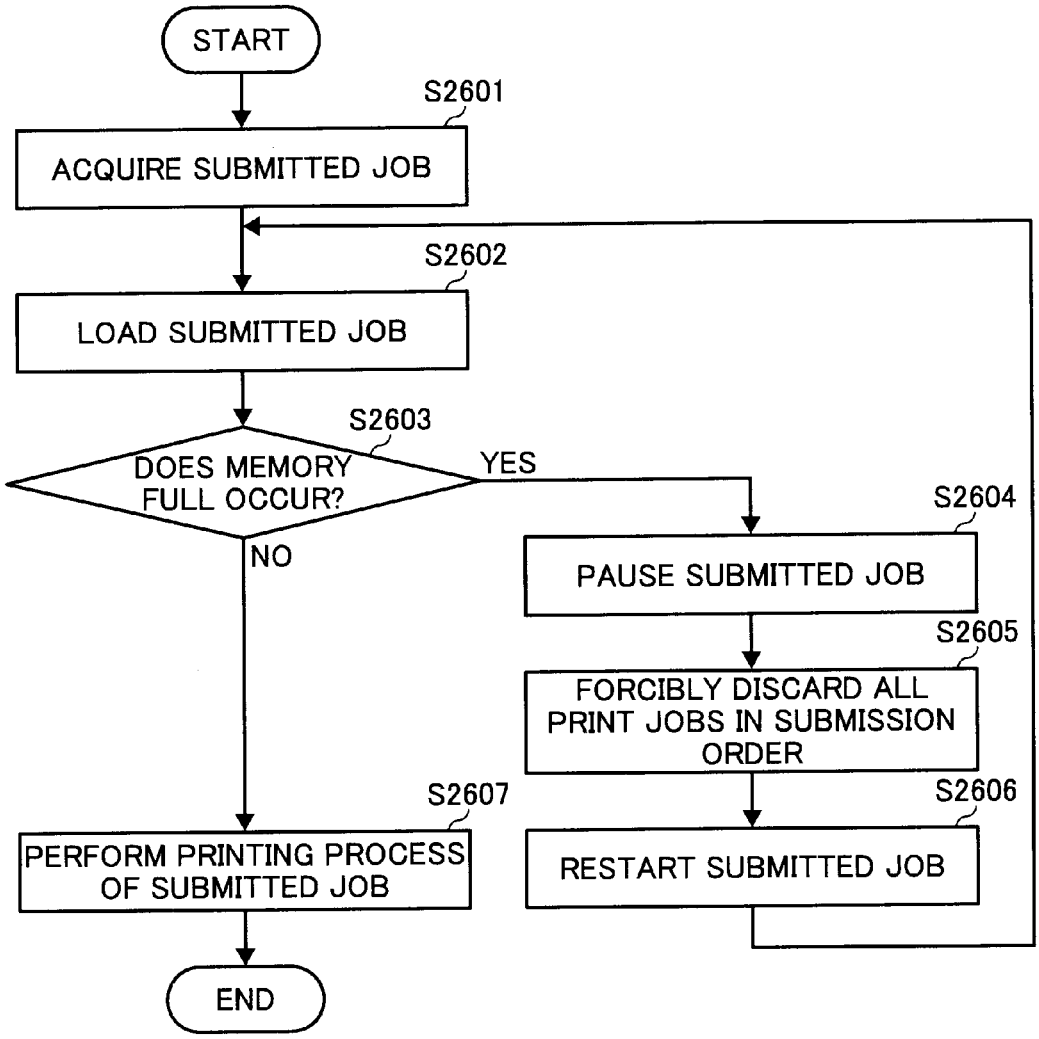

In the image forming apparatus according to the tenth embodiment, as shown in FIG. 19, when the memory full occurs in the image forming apparatus, the printing process of all the print jobs being paused therein is forcibly restarted in their submission order at step S1905. However, as shown in FIG. 26, when the memory full occurs in the image forming apparatus, at step S2605, it is also possible to forcibly discard all the print jobs being paused therein in their submission order.

Figure 27:
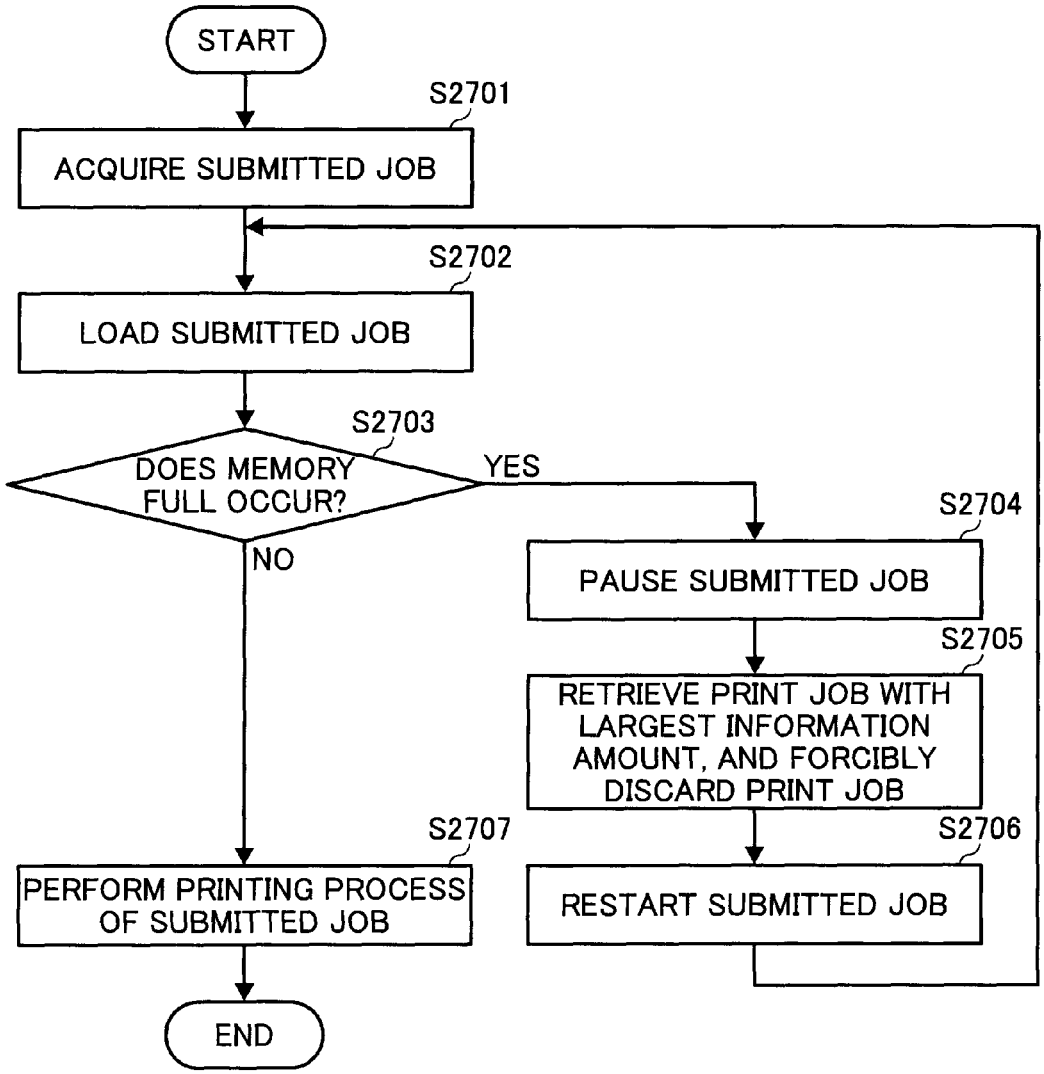

In the image forming apparatus according to the eleventh embodiment, as shown in FIG. 20, when the memory full occurs in the image forming apparatus, at step S2005, the printing process is forcibly restarted from the print job with the largest information amount among the print jobs being paused therein. However, as shown in FIG. 27, when the memory full occurs in the image forming apparatus, at step S2705, it is also possible to forcibly discard a print job from the one with the largest information amount among the print jobs being paused therein.

Figure 28:
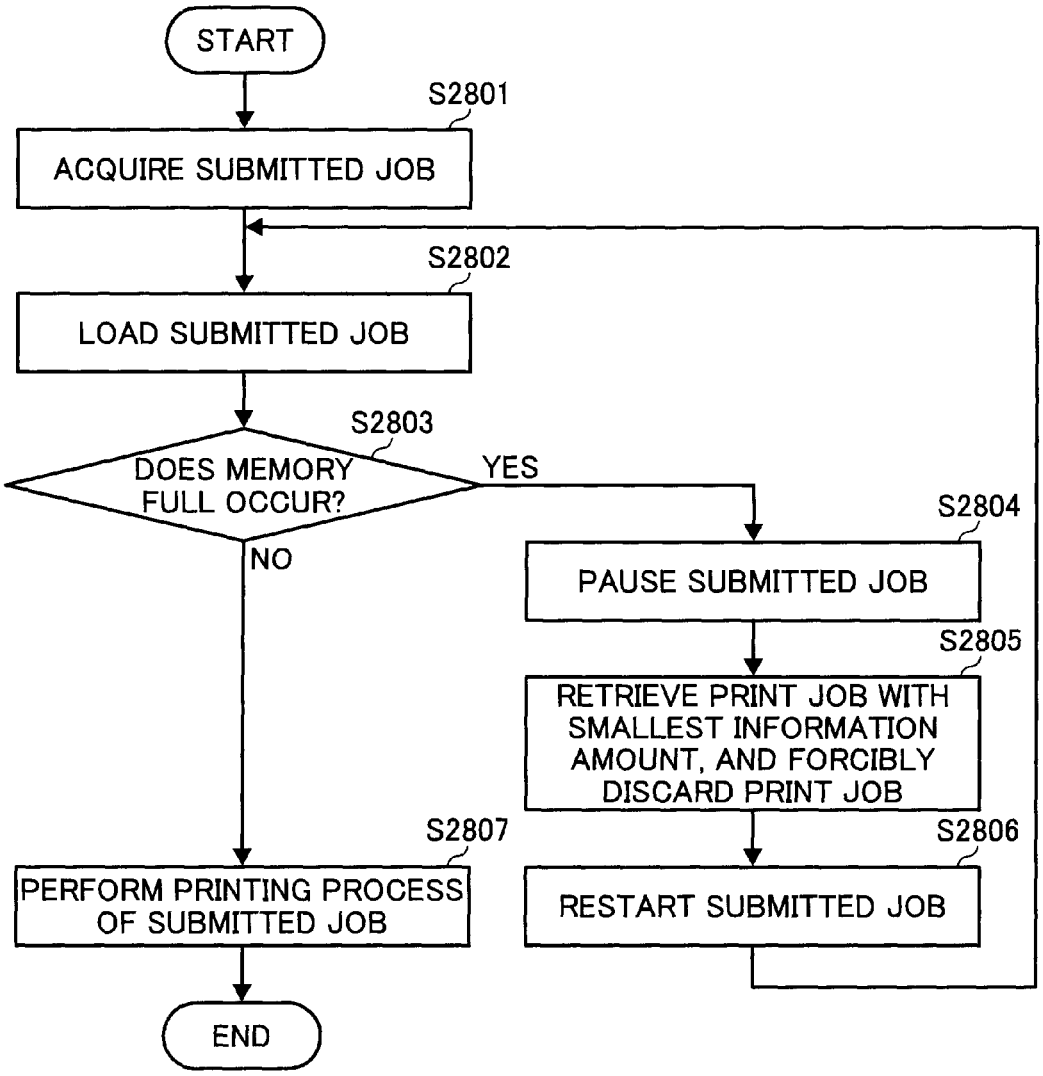

In the image forming apparatus according to the twelfth embodiment, as shown in FIG. 22, when the memory full occurs in the image forming apparatus, at step S2205, the printing process is forcibly restarted from the print job with the smallest information amount among the print jobs being paused therein. However, as shown in FIG. 28, when the memory full occurs in the image forming apparatus, at step S2805, it is also possible to forcibly discard a print job from the one with the smallest information amount among the print jobs being paused therein.

Figure 29:
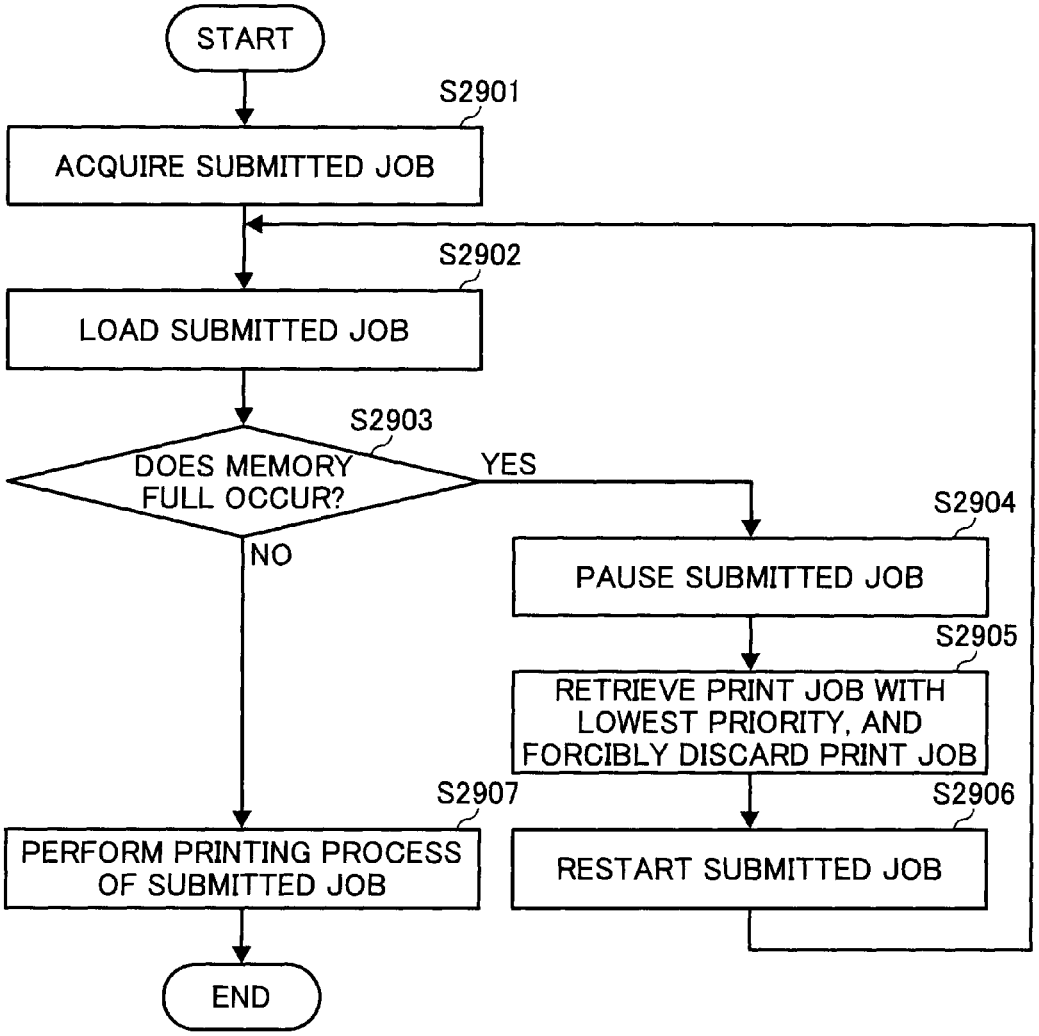

In the image forming apparatus according to the thirteenth embodiment, as shown in FIG. 23, when the memory full occurs in the image forming apparatus, at step S2305, the printing process is forcibly restarted from the print job with the lowest priority to be desired to be paused in the image forming apparatus among the print jobs being paused therein. However, as shown in FIG. 29, when the memory full occurs in the image forming apparatus, at step S2905, it is also possible to forcibly discard a print job from the one with the lowest priority to be desired to be paused in the image forming apparatus among the print jobs being paused therein.

As explained above, when the memory full occurs in the image forming apparatus, by forcibly discarding the print job being paused therein, it is also possible to clear up the memory full therein and perform the printing process of the job which is newly submitted, similarly to the image forming apparatuses according to the eighth to thirteenth embodiments.

Two functions as follows can also be included in the image forming apparatus, and either one of the functions is used to clear up the memory full when the memory full occurs in the image forming apparatus. More specifically, one of the functions controls so that the printing process of the print job being paused therein is forcibly restarted when the memory full occurs therein. The other one of the functions controls so that the print job being paused therein is forcibly discarded when the memory full occurs therein. In this case, it is also possible for the user to arbitrarily set which of the functions is used to clear up the memory full, through the operation panel 230 of the image forming apparatus.

It should be noted that the embodiments are the exemplary embodiments of the present invention. The present invention is not therefore limited only by the embodiments, and various changes may be made without departing from the scope of the present invention.

For example, the control operation in the image forming apparatuses according to the embodiments can be implemented not by the hardware configuration but by software such as a computer program. Furthermore, the control operation can also be implemented in the image forming apparatuses by recording the program in an optical recording medium, a magnetic recording medium, a magneto-optical recording medium, or a recording medium such as a semiconductor memory, and loading the program from any one of the media into the image forming apparatus. Moreover, by loading the program from an external device connected through a predetermined network into the image forming apparatus, the control operation can be implemented in the image forming apparatus.

As explained above, when the memory full occurs in the image forming apparatuses according to the embodiments, by performing at least one of the control for restarting the printing process of at least one print job stored therein and the control for deleting at least one print job stored therein, the memory full occurring in the image forming apparatus can be cleared up, and the subsequent control processes can be continued.

A fifteenth embodiment is explained in detail below with reference to the drawings. FIG. 15 is a block diagram of the hardware configuration of a laser printer as the image forming apparatus 200. The image forming apparatus or laser printer 200 includes the controller 250 which is a generic term of a control mechanism that converts print data from the host computer 210 to video data according to a control mode set at that time and a control code from the host computer 210 or from the network 220, and that outputs the video data to the printer engine 240. The controller 250 includes the following modules.

The host I/F 260 is an interface for handling a control signal and data from the host computer 210 to the printer, and also a state signal from the printer to the host computer 210. The network I/F 262 is an interface for handling a control signal and data from the network 220 to the printer, and also a state signal from the printer to the network 220.

The CPU 272 processes data (print data, control data) received from the host computer 210 according to the program ROM 268. The RAM 274 is used as work memory when the CPU 272 performs the processes, used as buffer for managing the data from the host computer 210 page by page and temporarily storing the data, and used as bitmap memory for converting the data stored in the buffer to an actual print pattern and storing video data.

The HDD (mass-storage device) 280 stores large volumes of data. The NVRAM 276 is non-volatile RAM for storing data which should be stored even when the power is turned off. The program ROM 268 stores programs for controlling data process, data management, and peripheral modules in the controller 250. The font ROM 270 stores various types of font data used for printing.

The engine I/F 266 is an interface for handling a control signal and a video signal from the controller 250 to the printer engine 240, and also a state signal from the printer to the controller 250. The printer engine 240 forms an electrostatic latent image on a photosensitive element based on the video signal and control signal sent from the controller 250, and develops the electrostatic latent image formed thereon, causes transfer paper to be fed from a paper feed unit, and transfers the image developed to the transfer paper and fixes the image thereon, to form the image.

The operation panel 230 includes the display unit for displaying states of the laser printer 200, and the switching unit for switching a printer mode and a font.

The outline of the data process is explained below. The data transferred from the host computer 210 to the laser printer 200 via the host I/F 260 is analyzed by the CPU 272 according to the data analyzing program stored in the program ROM 268. The data analyzed is classified into print data, printing control data (SP, CR, LF, HT, VT, . . . , etc.), and other data.

The print data and the printing control data are temporarily stored in the reception buffer of the RAM 274.

The received data temporarily stored is fetched one by one by the control program on the program ROM 268, and is processed thereby. For example, if the data fetched is character code, an intermediate code containing a print position, a print size, a character code, font information, and the like is created, and the intermediate code is stored in the intermediate buffer of the RAM 274. If the data is a control code and a command such as an escape sequence, processes previously defined in the code and command are executed. The process is performed in such a manner that if the command indicates specification of a print position, the position of a subsequent character code is set as a position specified, and if the command indicates change of a font, the font information of a subsequent character code is set as a font specified.

In this manner, if a print instruction from the host computer 210 is processed, or if the data processed exceeds the amount for one page, the intermediate code stored in the intermediate buffer is converted to video data according to the control program. When the conversion is finished, the controller 250 outputs an instruction for a print start to the printer engine 240 via the engine I/F 266, and transfers the video data thereto in synchronization with the output of the instruction.

The print data sent from the host computer 210 is printed through the printer engine 240 in the flow sequence as explained above.

Figure 30:
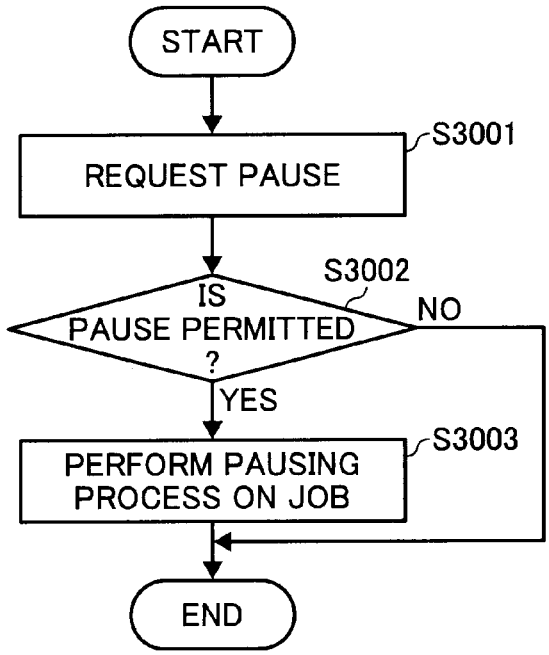
FIG. 30 is a flowchart of a process according to a fifteenth embodiment of the present invention.

The operation of the fifteenth embodiment is explained below with reference to the flowchart shown in FIG. 30. Referring to FIG. 30, first, the operation is implemented to acquire a pause request from the user (step S3001), and determine whether the pause is permitted (step S3002). If it is permitted (Yes at step S3002), the pausing process is performed on the job (step S3003). If it is not permitted (No at step S3002) then the process ends.

Figure 31:
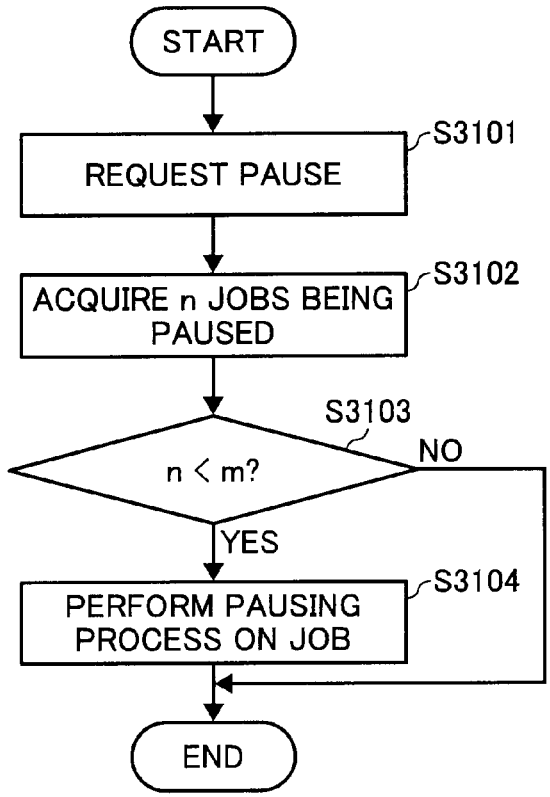
FIG. 31 is a flowchart of a process according to a sixteenth embodiment of the present invention.

The operation of a sixteenth embodiment is explained below with reference to the flowchart shown in FIG. 31. Referring to FIG. 31, first, the operation is implemented to acquire a pause request from the user (step S3101), and acquire n jobs being paused (step S3103). It is determined whether n is smaller than a predetermined number m (step S3103). If n is smaller than m (Yes at step S3103), the pausing process is performed on the job (step S3104). If n is not smaller than m (No at step S3103), the process ends.

In the sixteenth embodiment, a determining unit is used to determine that the pause is not permitted when the jobs being paused reach a predetermined number, and therefore, the number of jobs being paused are limited, which enables to suppress the space of a storage area used by the jobs being paused.

Figure 32:
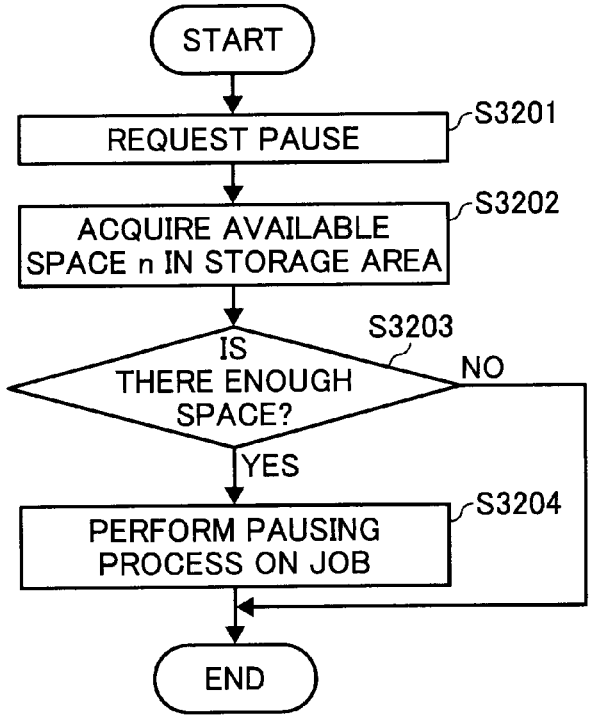
FIG. 32 is a flowchart of a process according to a seventeenth embodiment of the present invention.

The operation of a seventeenth embodiment is explained below with reference to the flowchart shown in FIG. 32. Referring to FIG. 32, first, the operation is implemented to acquire a pause request from the user (step S3201), and acquire available space n in a storage area (step S3202). Then, it is determined whether there is enough space in the storage area, namely, whether the available space n of the storage area is more than a space in of the storage area required for normal printing (step S3203). If there is enough space in the storage area (Yes at step S3203), then the pausing process is performed on the job (step S3204). If there is not enough space therein (No at step S3203), then the process ends.

In the seventeenth embodiment, a determining unit is used to determine that the pause is not permitted when there is not enough space in the storage area required for normal printing, which enables to prevent an event such that the job cannot be paused, and to avoid an event such that the normal printing cannot be performed due to the jobs being paused.

Figure 33:
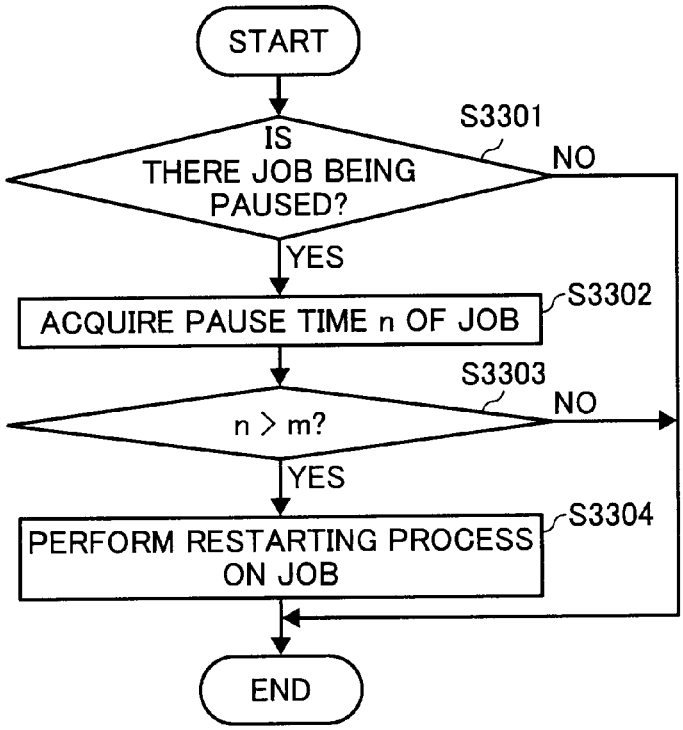
FIG. 33 is a flowchart of a process according to a eighteenth embodiment of the present invention.

The operation of an eighteenth embodiment is explained below with reference to the flowchart shown in FIG. 33. Referring to FIG. 33, first, it is determined whether there is any job being paused (step S3301). Then, if there is a job being paused (Yes at step S3301), a pause time n is acquired (step S3302). If there is no job being paused (No at step S3301), the process ends. It is further determined whether the pause time n is longer than a predetermined time m (step S3303). If it is longer than the predetermined time (Yes at step S3303), the restarting process is performed on the job (step S3304). If it is not longer than that (No at step S3303), then the process ends.

In the eighteenth embodiment, in an image forming apparatus capable of pausing the process of print data received, when the user forgets to restart the job paused, by forcibly restarting the job paused for a time exceeding the predetermined time, it is possible to avoid an event such that there is not enough available space in the storage area and this causes the process not to be performed.

Figure 34:
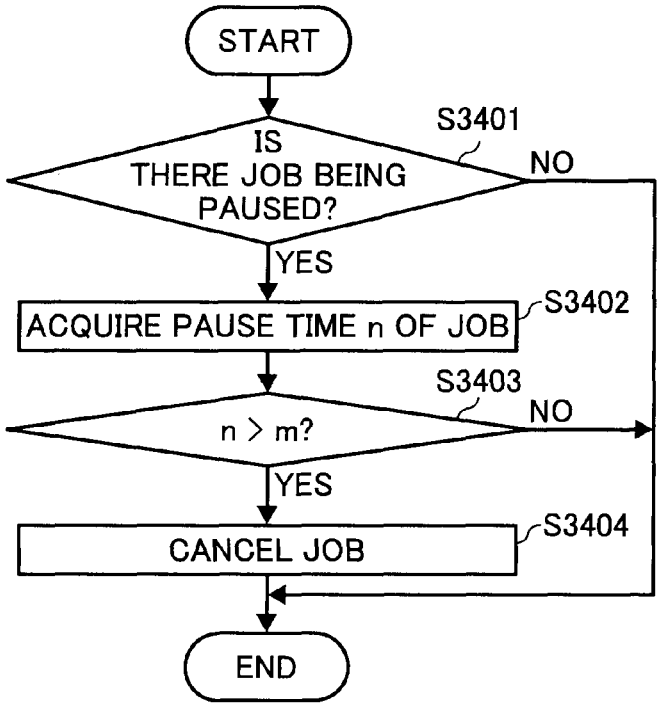
FIG. 34 is a flowchart of a process according to a nineteenth embodiment of the present invention.

The operation of a nineteenth embodiment is explained below with reference to the flowchart shown in FIG. 34. Referring to FIG. 34, first, it is determined whether there is any job being paused (step S3401). Then, if there is a job being paused (Yes at step S3401), a pause time n of the job is acquired (step S3402) If there is no job being paused (No at step S3401), the process ends. It is further determined whether the pause time n is longer than a predetermined time m (step S3403). If the pause time n is longer than the predetermined time m (Yes at step S3403), the job is canceled (step S3404). If the pause time n is not longer than the predetermined time m (No at step S3403) then the process ends.

In the nineteenth embodiment, in an image forming apparatus capable of pausing the process of print data received, when the user forgets to restart the job paused, by forcibly canceling the job paused for a time exceeding the predetermined time, it is possible to minimize the effect on another printing upon avoidance of an event such that there is not enough space in the storage area and this causes the process not to be performed.

Figure 35:
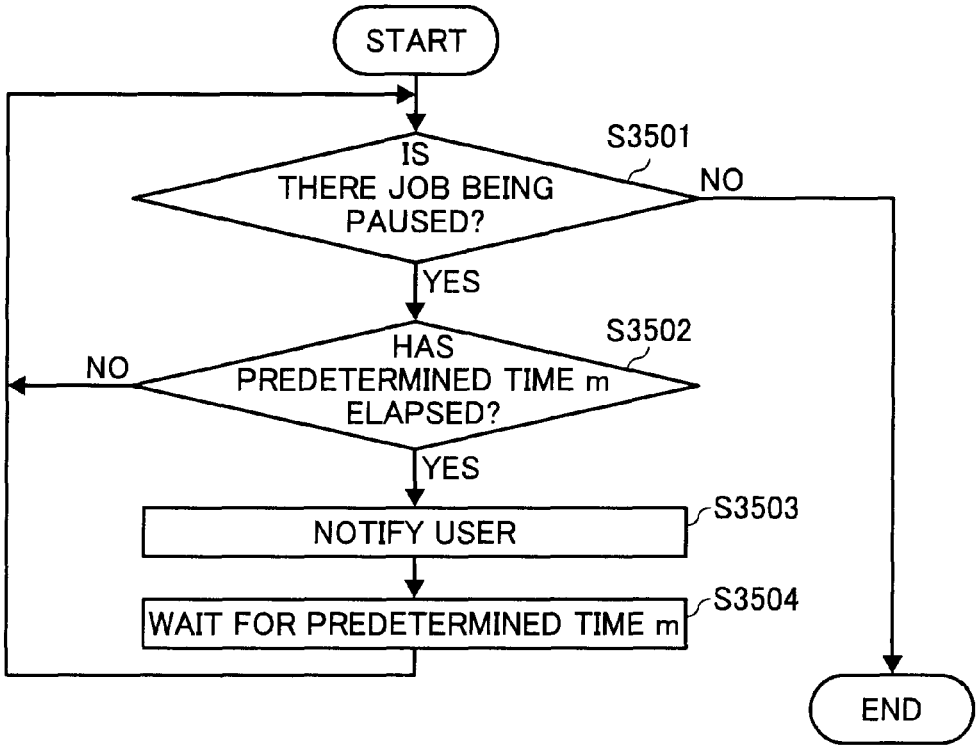
FIG. 35 is a flowchart of a process according to a twentieth embodiment of the present invention.

The operation of a twentieth embodiment is explained below with reference to the flowchart shown in FIG. 35. Referring to FIG. 35, first, it is determined whether there is any job being paused (step S3501). If there is a job being paused (Yes at step S3501), a pause time of the job is checked and it is further determined whether the pause time is longer than a predetermined time m (step S3502). If there is no job being paused (No at step S3501), the process ends. If the job is paused longer than the predetermined time m (Yes at step S3502), the user is notified that there is the job being paused (step S3503). Then, the flow waits for a predetermined time n (step S3504), and returns to the process where it is determined whether there is any job being paused.

In the twentieth embodiment, in an image forming apparatus capable of pausing the process of print data received, it is possible to prevent an event such that the user forgets that the job has been paused by notifying the user who has paused the job, about this matter.

It should be noted that the embodiments are the exemplary embodiments of the present invention, and various changes may be made without departing from the scope of the present invention. For example, the present invention is applicable to printers, copiers, and facsimiles.

By loading the program for implementing the functions of the laser printer 200 according to the embodiments thereinto and executing the program, the processes for implementing the functions thereof may be performed. Furthermore, the program may be transmitted to other computer systems through a Compact Disk Read Only Memory (CD-ROM) or a magneto-optical disk which is a computer-readable recording medium, or over transmitted wave through the Internet and a telephone line which are transmission media.

In the embodiments, the configuration in which the functions of the laser printer 200 are implemented as one computer system is explained, but the present invention is also applicable to a configuration in which a plurality of devices are added for each function.

The twentieth embodiment can suppress to further reduce the space of the storage area due to the jobs being paused, and can avoid an event such that there is not enough space in the storage area.

Exemplary embodiments of an image forming apparatus, a print-job managing method, and a print-job managing program according to a twenty-first embodiment are explained in detail below with reference to the accompanying drawings.

Figure 36:
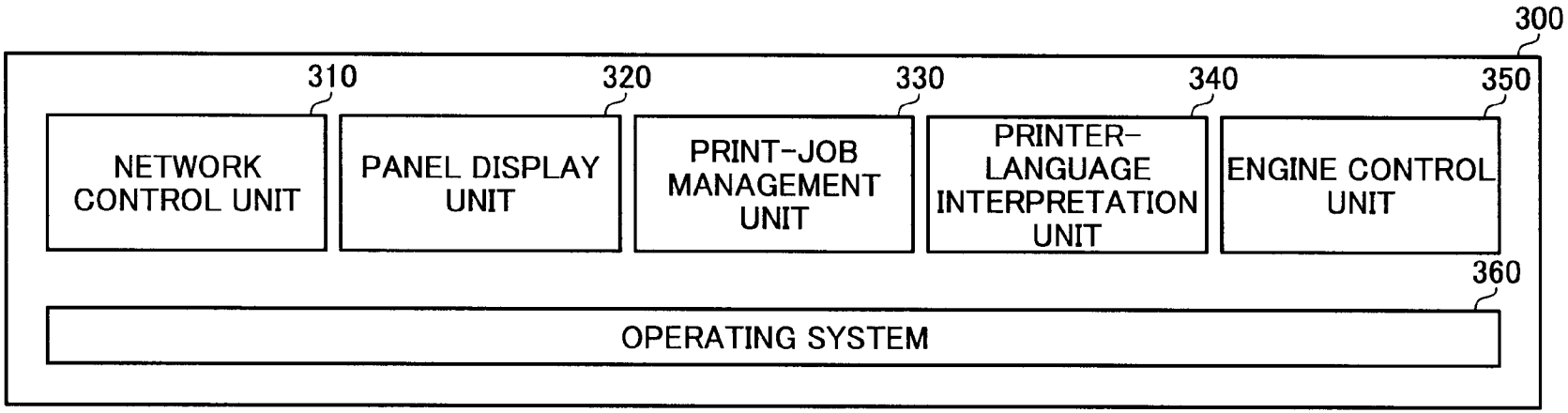

The twenty-first embodiment is explained below with reference to the accompanying drawings. FIG. 36 is a block diagram of a multifunction product (MFP) 300 according to the twenty-first embodiment. It is noted that the twenty-first embodiment is explained using the MFP as an example; however, a printer and any device which manages print jobs can also be used.

The MFP 300 includes a network control unit 310, a panel display unit 320, a print-job management unit 330, a printer-language interpretation unit 340, an engine control unit 350, and an operating system 360.

The network control unit 310 controls the network I/F and performs communications with client terminals connected thereto via the network. The panel display unit 320 controls a panel I/F to display a state of the printing apparatus on the operation panel.

The print-job management unit 330 manages print jobs containing print data received from the network control unit 310. The print-job management unit 330 also receives instructions to pause and restart the print job from the network control unit 310. Details thereof are explained later.

The printer-language interpretation unit 340 generates a print image from the print data corresponding to the print job when printing is instructed by the print-job management unit 330.

The engine control unit 350 receives the print job from the print-job management unit 330, and sequentially transmits print images generated by the printer-language interpretation unit 340 to the printer engine through the engine I/F.

The operating system 360 manages the components and provides basic functions such as input/output management and memory control to control the MFP 300.

Figure 37:
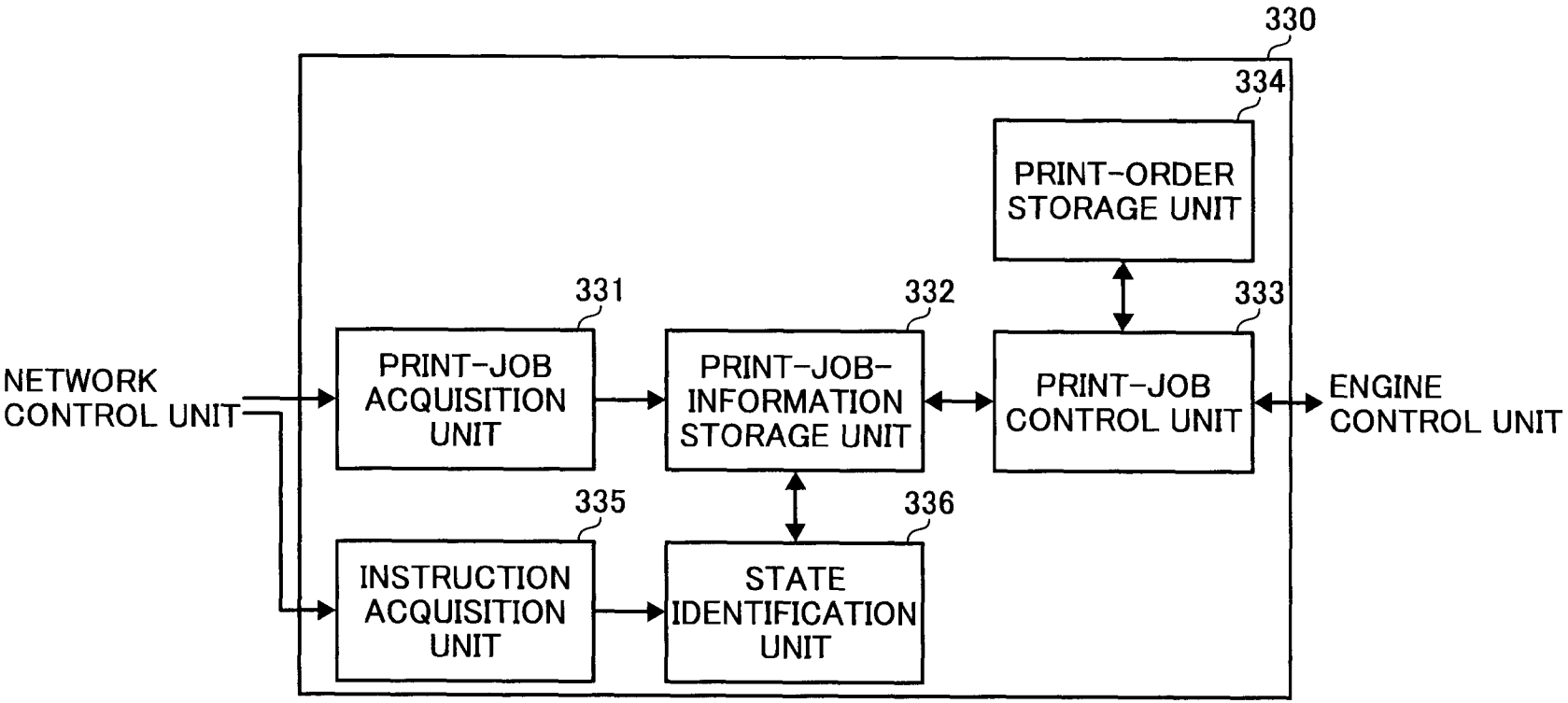
FIG. 37 is a block diagram of a print-job management unit shown in FIG. 36.

FIG. 37 is a block diagram of the print-job management unit 330. The print-job management unit 330 further includes a print-job acquisition unit 331, a print-job-information storage unit 332, a print-job control unit 333, a print-order storage unit 334, an instruction acquisition unit 335, and a state identification unit 336.

The print-job acquisition unit 331 acquires print jobs containing print data transmitted from a client terminal through the network control unit 310.

Figures 38, 39:
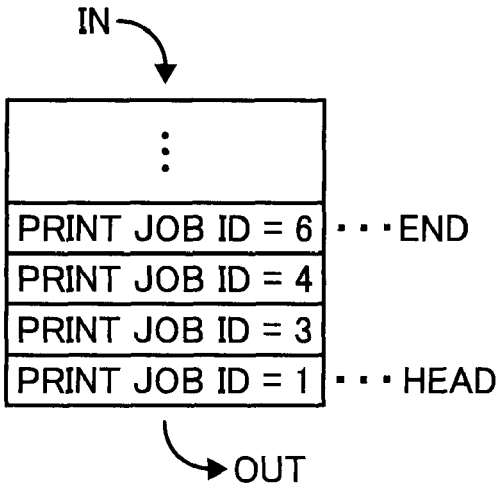
FIG. 38 is an example of a data structure in a print-job-information storage unit shown in FIG. 37.
FIG. 39 is an example of a data structure in a print-order storage unit shown in FIG. 37.

The print-job-information storage unit 332 stores information on the print jobs acquired by the print-job acquisition unit 331. FIG. 38 is an example of a data structure in the print-job-information storage unit 332. The print-job-information storage unit 332 stores a print job ID, a user ID, a job state, and print data which are associated with one another. Information of the print jobs received from the network I/F is stored in the print-job-information storage unit 332 basically in the order in which the print jobs have been accepted.

The print job ID is uniquely set with a number to identify a print job in the print-job management unit 330. The user ID is used to identify a user who submits a print job, and is added to the print job by a client terminal to which the print job is submitted.

The job state represents a state of a print job, and includes three states such as "print wait", "printing", and "paused". The "print wait" represents a state before paper feeding is started. The "printing" represents a state after the paper feeding is finished. The "paused" represents a state where a pause instruction has been received. When a new print job is generated, the "print wait" is set as the job state. Further, the print job is deleted from the print-job-information storage unit 332 when all the pages are completely printed.

The print-order storage unit 334 stores the order of printing print jobs which are printable. FIG. 39 is an example of a data structure in the print-order storage unit 334. The print-order storage unit 334 has a queue structure, and a data input/output system is First In First Out (FIFO). In the twenty-first embodiment, as also shown in FIG. 38, the print job ID=1 which is the head print job indicates the "printing" state, and the print job ID=3, 4, 6 which are the subsequent print jobs indicate the "print wait" state. It is noted that all pieces of print-job identification information, each of which job state is "print wait" or "printing" in the print-job-information storage unit 332, are registered in the print-order storage unit 334.

The instruction acquisition unit 335 accepts a print job ID and an instruction of operation for the print job ID transmitted from a client terminal. The operation for the print job ID is specifically "pause instruction" or "restart instruction". The pause instruction is such that the pause of printing is instructed to a print job in the "print wait" state, and the job state is changed to "paused". The restart instruction is such that the restart of printing is instructed to a print job in the "paused" state, and the job state is changed to "print wait". The state identification unit 336 identifies a job state corresponding to the print-job identification information acquired by the instruction acquisition unit 335.

The print-job control unit 333 stores print-job identification information in the print-order storage unit 334 in the order of printing based on the print-job identification information and the job states stored in the print-job-information storage unit 332. The print-job control unit 333 instructs the engine control unit 350 to execute a print job corresponding to the print-job identification information stored in the head of the print-order storage unit 334.

Furthermore, the print-job control unit 333 changes the job state stored in the print-job-information storage unit 332 according to the printing state of the print job transmitted from the engine control unit 350. The print-job control unit 333 changes the job state stored in the print-job-information storage unit 332, based on the instruction of the operation for the print job acquired by the instruction acquisition unit 335 and on the job state identified by the state identification unit 336. Furthermore, the print-job control unit 333 changes the order of the print-job identification information stored in the print-order storage unit 334 and changes the order of printing the print jobs, based on the job states stored in the print-job-information storage unit 332.

The state transition from creation of a print job to elimination thereof is explained below with reference to FIG. 4. FIG. 4 is an example of the print-job state transition. First, a print request is sent from a client terminal to the MFP 300, and a print job is created, and information on the print job is stored in the print-job-information storage unit 332.

The job state of the print job created is "print wait". When a pause instruction for printing the print job in the "print wait" state is received, the job state is changed to "paused". Conversely, when a restart instruction for printing the print job in the "paused" state is received, the job state is changed to "print wait".

The print job in "print wait" is moved to the head of the printing order in the print-order storage unit 334, and when execution of the print job is instructed to the engine control unit 350 and information such that the paper is fed is received from the engine control unit 350, the job state is changed to "printing". However, even if the pause instruction for printing is received when the job state is "printing", the printing is not interrupted.

When all the pages for the print job are completely ejected in the printing operation, the print-job identification information is deleted from the print-order storage unit 334, the information of the print job is also deleted from the print-job-information storage unit 332, and the print job is eliminated.

Figure 40:
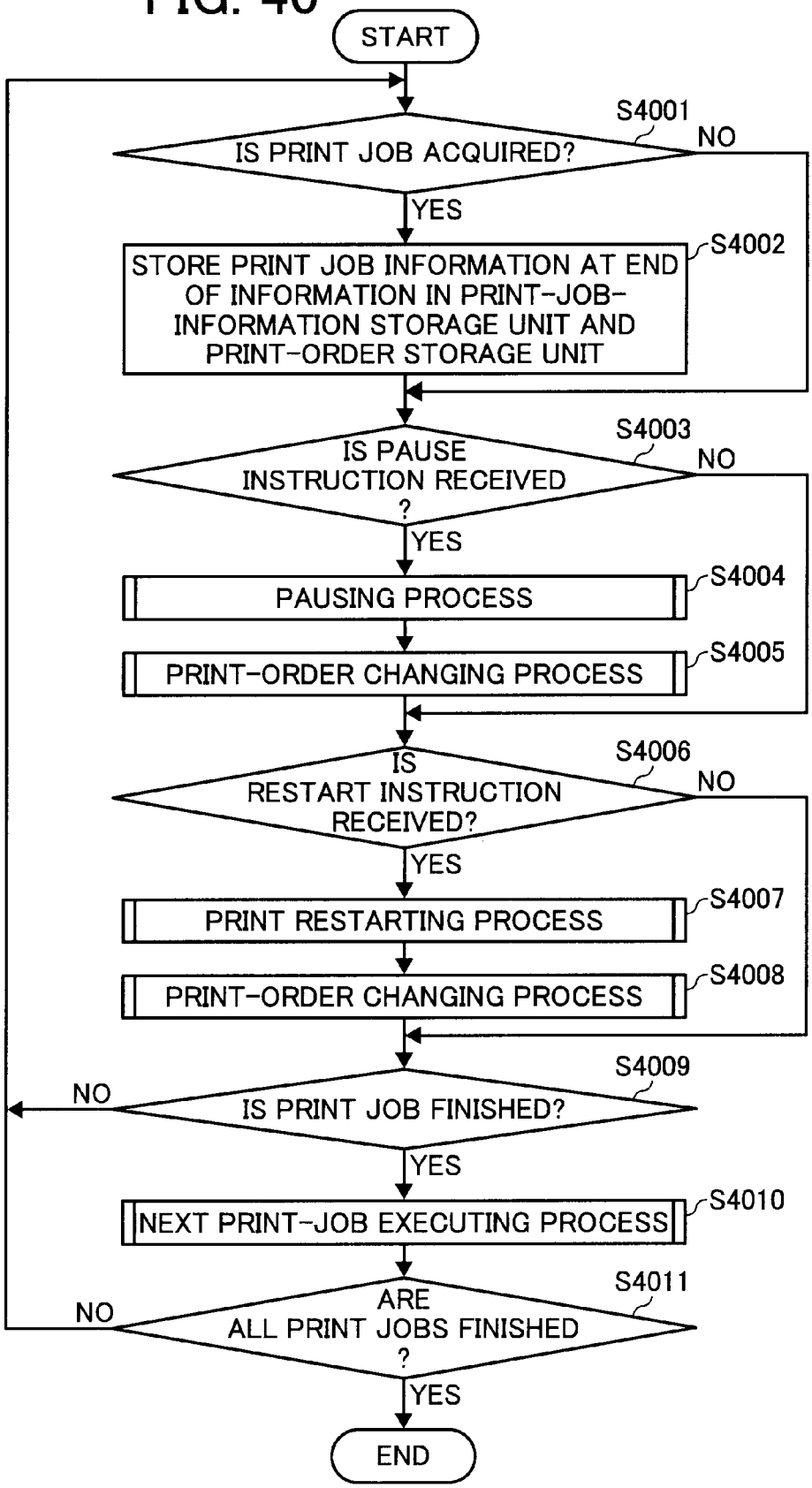
FIG. 40 is a flowchart of a print-job managing process performed by a print-job acquisition unit, a print-job control unit, an instruction acquisition unit, and a state identification unit shown in FIG. 37.

FIG. 40 is a flowchart of a print-job managing process performed by the print-job acquisition unit 331, the print-job control unit 333, the instruction acquisition unit 335, and the state identification unit 336. The print-job acquisition unit 331 determines whether a print job transmitted from a client terminal is acquired (step S4001). When the print job is acquired (Yes at step S4001), the print-job acquisition unit 331 stores information on the print job at the end of the information in the print-job-information storage unit 332 and the print-order storage unit 334 (step S4002). More specifically, the print job ID, the user ID, "print wait" as the job state, and the print data are stored at the end of the information in the print-job-information storage unit 332, and the print job ID is stored at the end of the order in the print-order storage unit 334. When the print job is not acquired (No at step S4001), the process proceeds to step S4003.

The instruction acquisition unit 335 determines whether a pause instruction for printing is received (step S4003). When the pause instruction is received (Yes at step S4003), the instruction acquisition unit 335 performs a pausing process (step S4004), and also performs a print-order changing process (step S4005). Details thereof are explained later. When the pause instruction is not received (No at step S4003), the process proceeds to step S4006.

The instruction acquisition unit 335 determines whether a restart instruction for printing is received (step S4006). When the restart instruction is received (Yes at step S4006), the instruction acquisition unit 335 performs a print restarting process (step S4007), and also performs the print-order changing process (step S4008). Details thereof are explained later. When the restart instruction is not received (No at step S4006), the process proceeds to step S4009.

The print-job control unit 333 determines whether the print job is finished (step S4009). When the print job is not finished (No at step S4009), the process returns to step S4001. When the print job is finished (Yes at step S4009), the print-job control unit 333 performs a next print-job executing process (step S4010). Details thereof are explained later.

The print-job control unit 333 determines whether all the print jobs are finished (step S4011). When all the print jobs are finished (Yes at step S4011), the process ends. When not all the print jobs are finished (No at step S4011), the process returns to step S4001.

Figure 41:
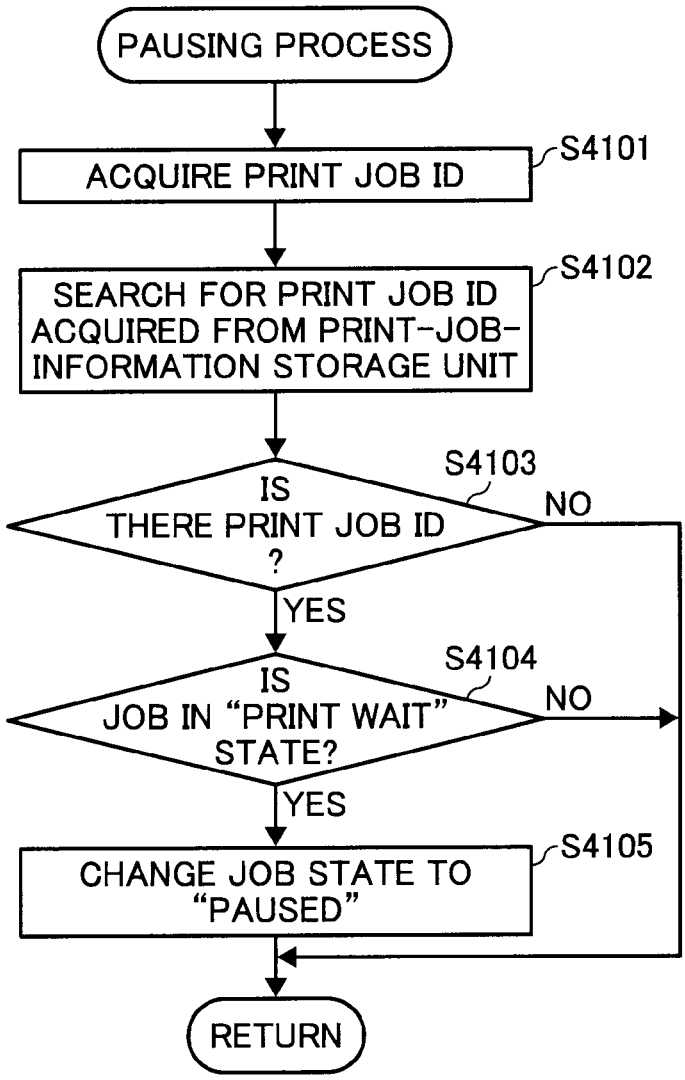
FIG. 41 is a detailed flowchart of a pausing process shown in FIG. 40.

FIG. 41 is a detailed flowchart of the pausing process performed by the instruction acquisition unit 335 and the state identification unit 336. The instruction acquisition unit 335 acquires the print job ID (step S4101). More specifically, the instruction acquisition unit 335 acquires the print job ID received together with the pause instruction from the client terminal. The state identification unit 336 searches for the print job ID acquired, from the print-job-information storage unit 332 (step S4102). The state identification unit 336 determines whether there is the print job ID (step S4103).

When there is the print job ID (Yes at step S4103), the state identification unit 336 determines whether the job state is "print wait" (step S4104). When the job state is "print wait" (Yes at step S4104), the state identification unit 336 changes the job state to "paused" (step S4105). In this manner, the job state is determined at the time when the pause instruction for printing is received, and the job state being in "printing" is not changed to "paused". Therefore, the printing operation of the print job whose printing has been started is not paused.

When there is no such a print job ID (No at step S4103), or when the job state is not "print wait" (No at step S4104), the process ends.

Figure 42:
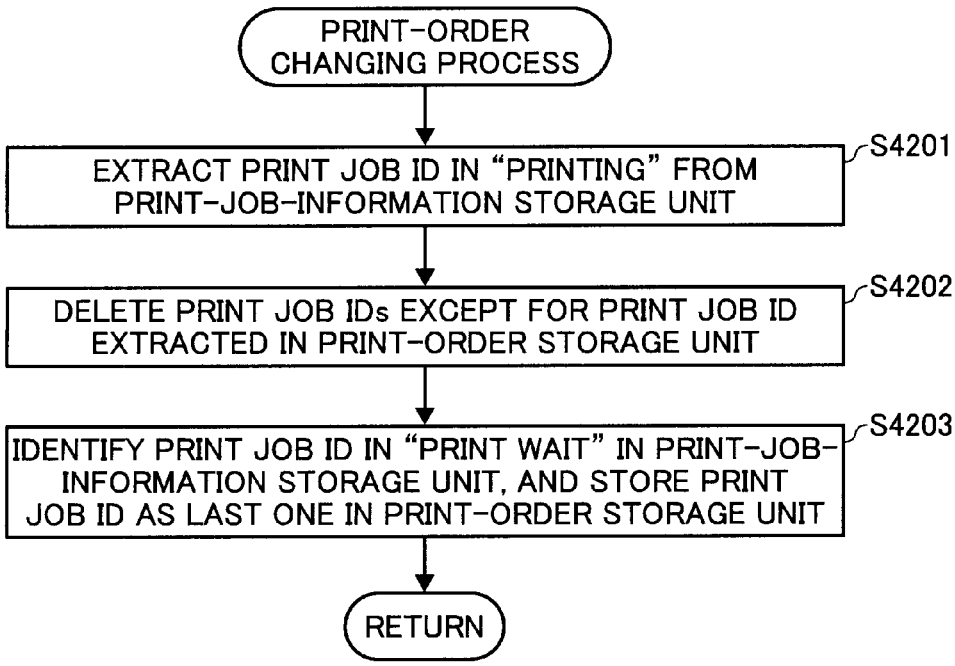
FIG. 42 is a detailed flowchart of a print-order changing process shown in FIG. 40.

FIG. 42 is a detailed flowchart of the print-order changing process performed by the print-job control unit 333. The print-job control unit 333 extracts the print job ID corresponding to the "printing" state from the print-job-information storage unit 332 (step S4201). The print-job control unit 333 deletes print job IDs except for the print job ID extracted in the print-order storage unit 334 (step S4202). The print-job control unit 333 identifies the print job ID in "print wait" in the print-job-information storage unit 332, and stores the print job ID as the last one in the print-order storage unit 334 (step S4203). In this manner, the job in "printing" and the subsequent jobs in "print wait" are sequentially stored in the print-order storage unit 334 according to the order of the print jobs recorded in the print-job-information storage unit 332.

With this operation, during the pausing process, the print job ID for which job state is changed from "print wait" to "paused" is not stored in the print-order storage unit 334, and accordingly, the printing operation is not started. Furthermore, during the print restarting process explained later, the print job IDs for which job state is changed from "paused" to "print wait" are stored in the print-order storage unit 334 in the order in which the print job IDs are stored earlier in the print-job-information storage unit 332. Therefore, the printing operation is started in the order in which the print jobs are submitted.

Figure 43:
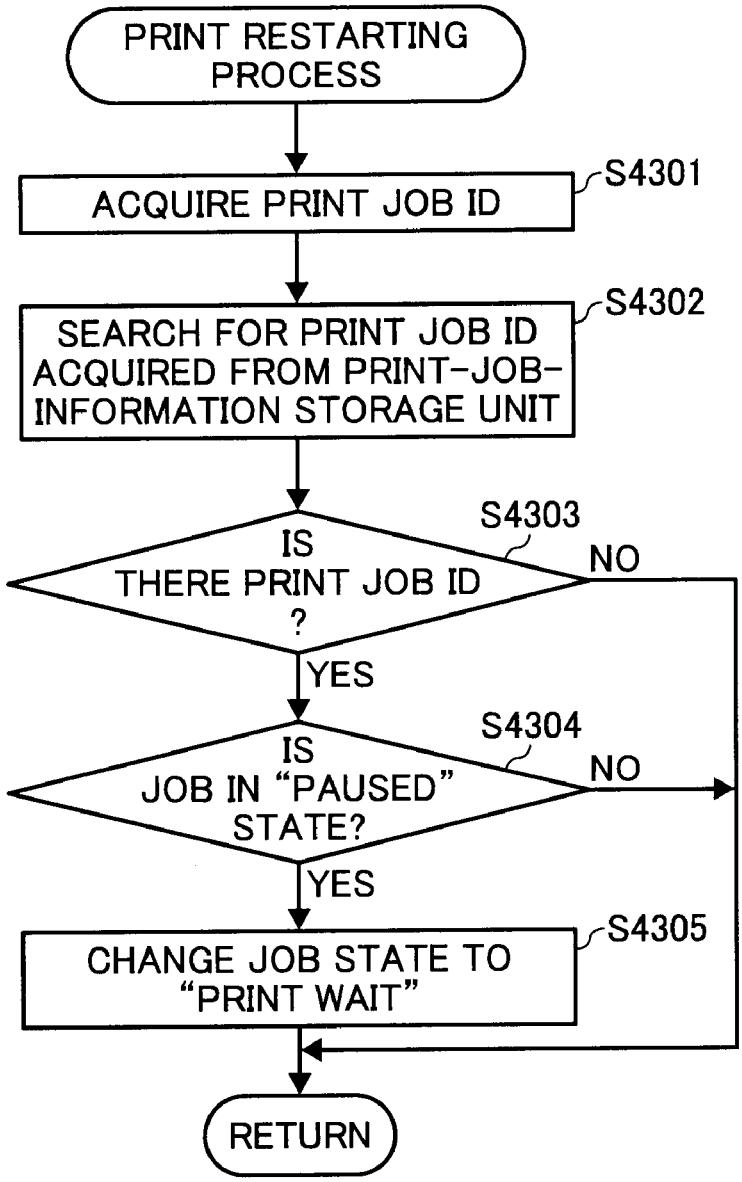
FIG. 43 is a detailed flowchart of a print restarting process shown in FIG. 40.

FIG. 43 is a detailed flowchart of the print restarting process performed by the state identification unit 336. The instruction acquisition unit 335 acquires a print job ID (step S4301). More specifically, the instruction acquisition unit 335 acquires the print job ID received together with the restart instruction from a client terminal. The state identification unit 336 searches for the print job ID acquired, from the print-job-information storage unit 332 (step S4302). The state identification unit 336 determines whether there is the print job ID (step S4303).

When there is the print job ID (Yes at step S4303), the state identification unit 336 determines whether the job state is "paused" (step S4304). When the job state is "paused" (Yes at step S4304), the state identification unit 336 changes the job state to "print wait" (step S4305). When there is no such a print job ID (No at step S4303), or when the job state is not "paused" (No at step S4304), the process ends.

Figure 44:
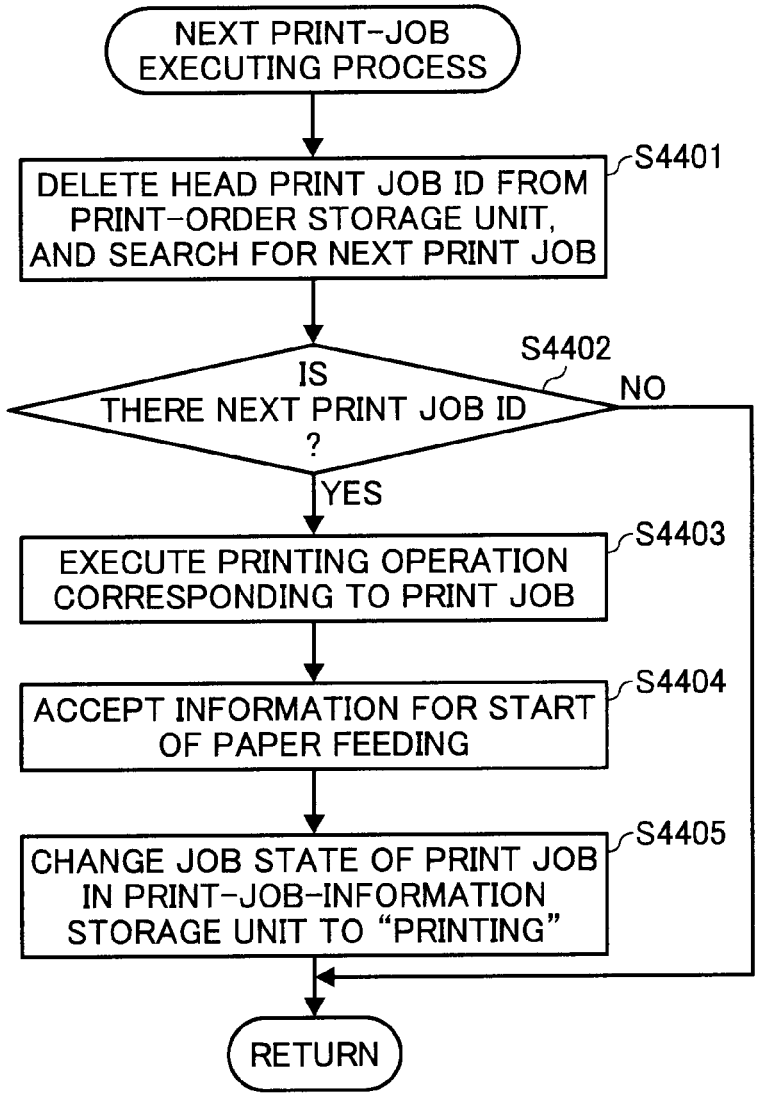
FIG. 44 is a detailed flowchart of a next print-job executing process shown in FIG. 40.

FIG. 44 is a detailed flowchart of the next print-job executing process performed by the print-job control unit 333. The print-job control unit 333 deletes the head print job ID from the print-order storage unit 334, and searches for a next print job ID (step S4401). The print-job control unit 333 determines whether there is a next print job ID (step S4402). When there is no next print job ID (No at step S4402), the process ends.

When there is the next print job ID (Yes at step S4402), the print-job control unit 333 executes the printing operation to the print job obtained (step S4403) The print-job control unit 333 accepts information for the start of paper feeding from the engine control unit 350 (step S4404). The print-job control unit 333 changes the job state of the print job, being an object of the print-job-information storage unit 332, to "printing" (step S4405).

In this manner, the printing operation for the print job is started, and the job state is changed to "printing" at the time when the paper feeding is started. In the pausing process, when the "printing" is set as the job state, the printing operation is not paused even if the pause instruction for printing is received. Therefore, an output result for the print job is collectively output, and accordingly, the output result does not get mixed with other output results, thus improving the user's usability.

Figure 45:
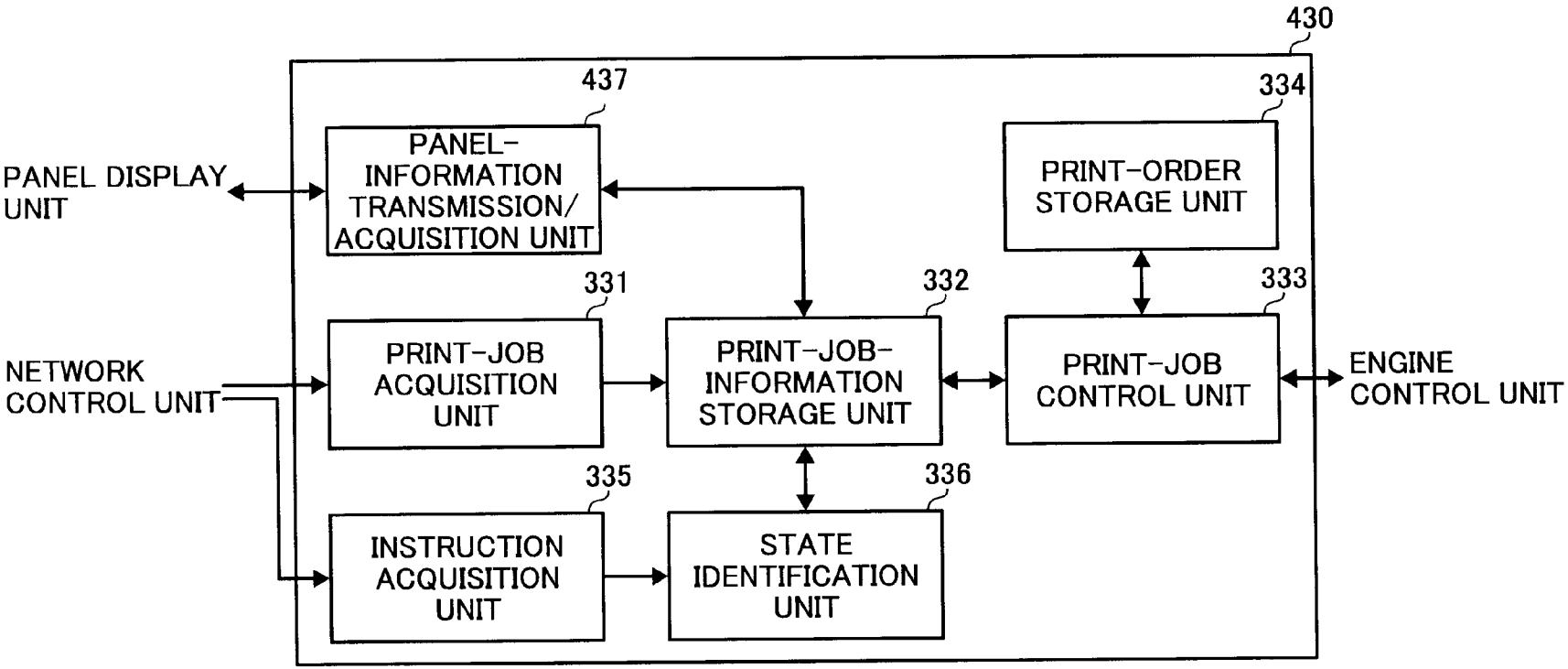
FIG. 45 is a block diagram of a print-job management unit of an MFP according to a twenty-second embodiment of the present invention.

A twenty-second embodiment is explained below with reference to the accompanying drawings. FIG. 45 is a block diagram of a print-job management unit 430 of an MFP according to the twenty-second embodiment. The MFP of the twenty-second embodiment is basically similar in construction to that of the twenty-first embodiment, and hence, the same explanation is not repeated. The print-job management unit 430 includes the print-job acquisition unit 331, the print-job-information storage unit 332, the print-job control unit 333, the print-order storage unit 334, the instruction acquisition unit 335, the state identification unit 335, and a panel-information transmission/acquisition unit 437. Here, the respective configurations and functions of the print-job acquisition unit 331, the print-job-information storage unit 332, the print-job control unit 333, the print-order storage unit 334, the instruction acquisition unit 335, and the state identification unit 336 are the same as these of the twenty-first embodiment, and explanation thereof is omitted.

The panel-information transmission/acquisition unit 437 acquires a user ID input through the operation panel, identifies information on a print job corresponding to the user ID acquired from the print-job-information storage unit 333, and outputs the information to the operation panel.

Figure 46:
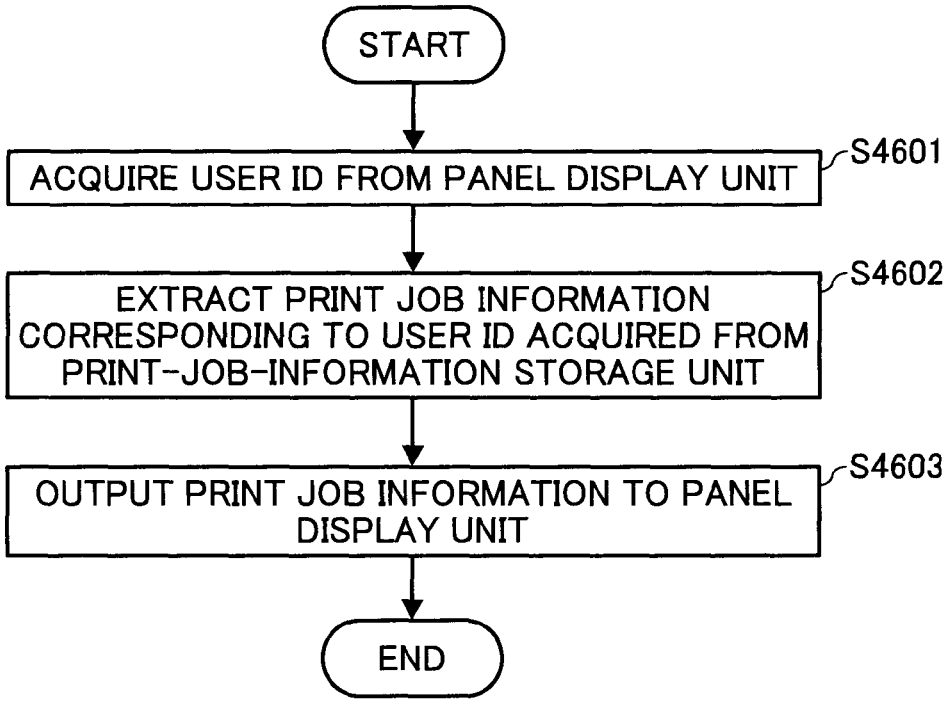
FIG. 46 is a flowchart of a print-job managing process performed by a panel-information transmission/acquisition unit shown in FIG. 45.

FIG. 46 is a flowchart of a print-job managing process performed by the panel-information transmission/acquisition unit 437. The panel-information transmission/acquisition unit 437 acquires a user ID input through the operation panel (step S4601). The panel-information transmission/acquisition unit 437 extracts print job information corresponding to the user ID from the print-job-information storage unit 332 (step S4602). The print job information mentioned here indicates information on each print job stored in the print-job-information storage unit 33. More specifically, the print job information indicates a print job ID, a user ID, and a job state stored therein for one print job. For example, if a plurality pieces of print job information with the user ID of "BBB" are stored in the print-job-information storage unit 332, all pieces of the print job information of which the user ID is "BBB" are extracted.

Figure 47:
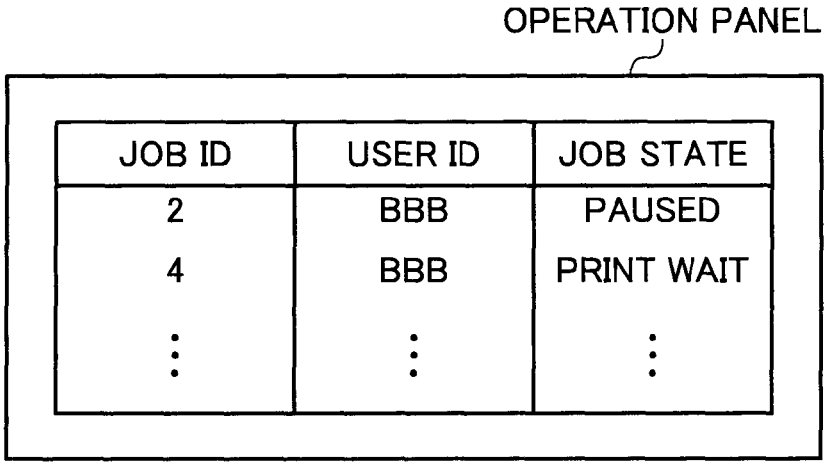
FIG. 47 is an example of print job information displayed on an operation panel according to the twenty-second embodiment.

The panel-information transmission/acquisition unit 437 transmits the print job information extracted to the panel display unit 320, and the print job information is displayed on the operation panel (step S4603). FIG. 47 is an example of the print job information displayed on the operation panel. For example, when "BBB" is acquired as the user ID and the print job information as shown in FIG. 38 is stored in the print-job-information storage unit 332, the print job information with print job ID=2 and 4 corresponding to the user ID "BBB" is displayed. The user specifies the print job information displayed, and indicates the pause instruction or the restart instruction together with the instruction of the print job ID. It is thereby possible to prevent the user from performing an erroneous operation on other user's print jobs.

In the flowchart, the case where the user ID is acquired from the operation panel of the MFP 300 and the print job information for the user ID is displayed on the display panel is explained below. However, the user may acquire the user ID from the client terminal to which the print job is submitted, and transmit the print job information corresponding to the user ID acquired to the client terminal through the network, and the print job information may be displayed thereon.

In this manner, only the print job, of which printing is requested by the user using the user ID, is displayed on the operation panel. Therefore, it is possible to prevent other users from sending an erroneous pause instruction or restart instruction for printing, thus improving the user's usability.

A twenty-third embodiment is explained below with reference to the accompanying drawings. An MFP of the twenty-third embodiment is basically similar in construction to that of the twenty-first embodiment, and hence, the same explanation is not repeated. In the twenty-third embodiment, a pausing process is performed as shown in FIG. 48, explained below, instead of that in the flowchart of the print-job managing process shown in FIG. 40.

Figure 48:
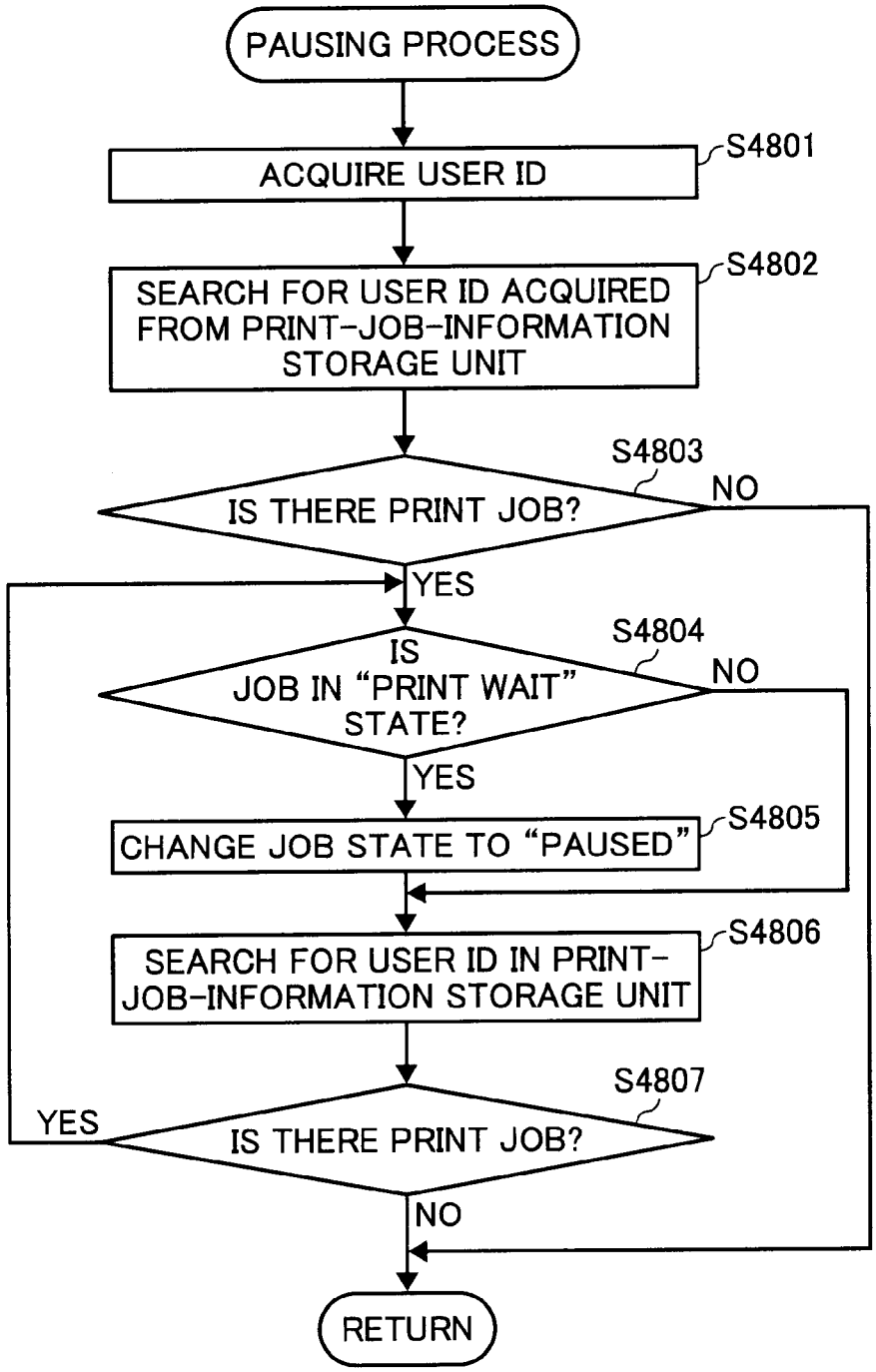
FIGS. 48 to 50 are flowcharts of a procedure for a pausing processes performed by an instruction acquisition unit and a state identification unit according to a twenty-third embodiment of the present invention.

FIG. 48 is a flowchart of the pausing process performed by the instruction acquisition unit 335 and the state identification unit 335. The instruction acquisition unit 335 acquires a user ID (step S4801). More specifically, the instruction acquisition unit 335 acquires the user ID received together with the pause instruction from a client terminal. The state identification unit 336 searches for the user ID acquired, from the print-job-information storage unit 332 (step S4802). The state identification unit 336 determines whether there is a print job corresponding to the user ID (step S4803).

When there is the print job (Yes at step S4803), the state identification unit 336 determines whether the job state is "print wait" (step S4804). When the job state is "print wait" (Yes at step S4804), the state identification unit 336 changes the job state to "paused" (step S4805). When the job state is not "print wait" (No at step S4804), the process proceeds to step S4806.

The state identification unit 336 searches for the target user ID, from the print-job-information storage unit 332 (step S4806). The state identification unit 336 determines whether there is a print job corresponding to the user ID (step S4807). When there is the job ID (Yes at step S4807), the process returns to step S4804.

When there is no such a print job (No at step S4807), the process ends. Further, at step S4803, when there is no such a print job (No at step S4803), the process ends.

In this manner, by acquiring the user ID, the "print wait" state of the print jobs can collectively be changed to the "paused" state. Therefore, the operation load on the user can be reduced, which allows improved user's usability.

As for the print restarting process, by performing the same process as above, the state of the print jobs whose user ID as the target is the same as each other can be collectively changed from the "paused" state to the "print wait" state. Therefore, the operation load on the user can be reduced, which allows improved user's usability.

Figure 49:
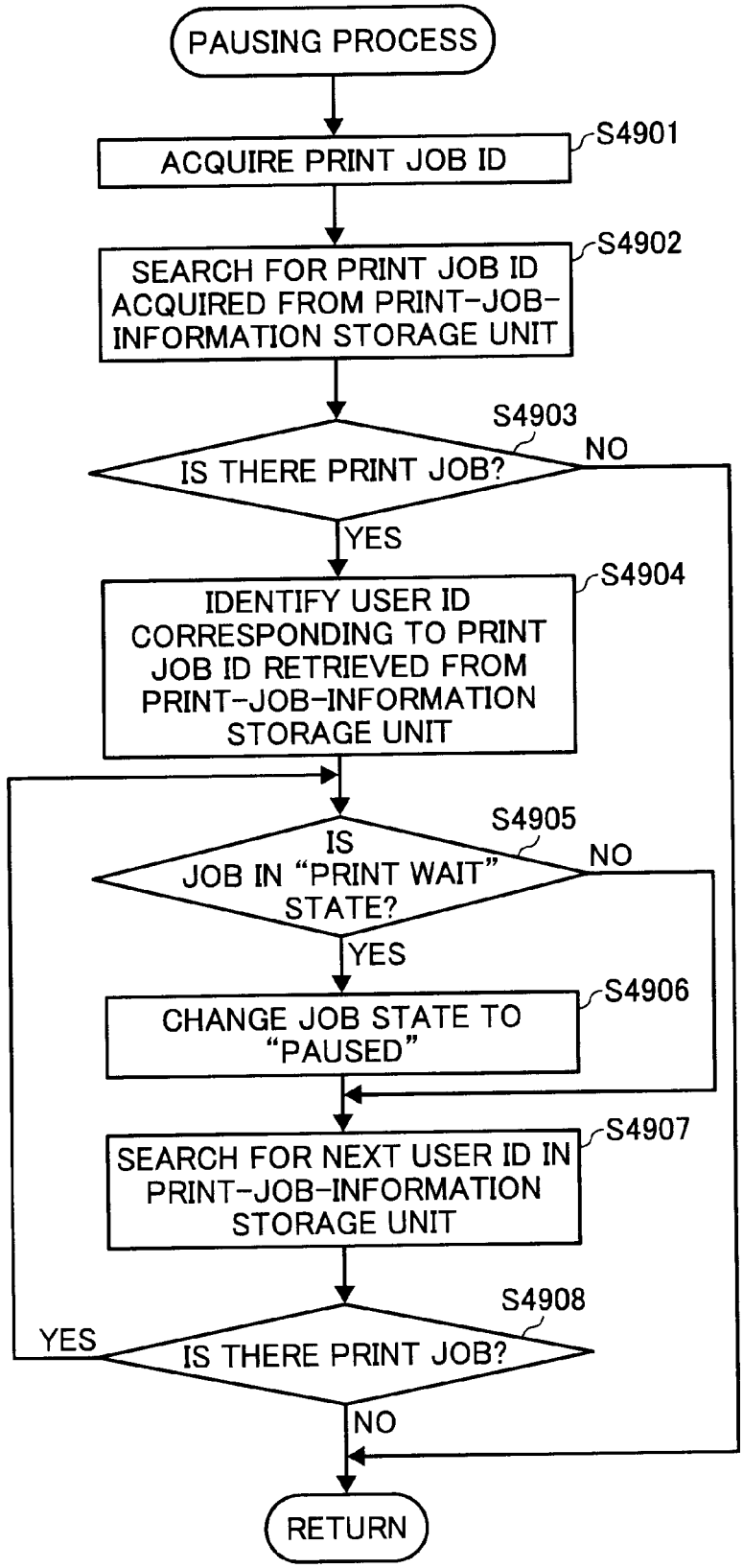

FIG. 49 is a flowchart of another example of the pausing process performed by the instruction acquisition unit 335 and the state identification unit 336. The instruction acquisition unit 335 acquires a print job ID from the network control unit 310 (step S4901). More specifically, the instruction acquisition unit 335 acquires the print job ID received together with the pause instruction from a client terminal. The state identification unit 336 searches for the print job ID acquired, from the print-job-information storage unit 332 (step S4902). The state identification unit 336 determines whether there is the print job by retrieving the print job ID (step S4903).

When there is the print job (Yes at step S4903), the state identification unit 336 identifies the user ID corresponding to the print job ID from the print-job-information storage unit 332 (step S4904). The state identification unit 336 determines whether the job state is "print wait" (step S4905). When the job state is "print wait" (Yes at step S4905), the state identification unit 336 changes the job state to "paused" (step S4906). When the job state is not "print wait" (No at step S4905), the process proceeds to step S4907.

The state identification unit 336 searches for a next user ID, from the print-job-information storage unit 332 (step S4907). In other words, the state identification unit 336 searches for a user ID stored after the currently searched user ID. The state identification unit 336 determines whether there is a print job by retrieving the user ID (step S4908). When there is the print job (Yes at step S4908), the process returns to step S4905.

When there is no such a print job (No at step S4908), the process ends. Further, at step S4903, when there is no such a print job (No at step S4903), the process ends.

In this manner, the user ID can be identified from the print job ID, and the print job(s) in the "print wait" state, of the print jobs of which printing is requested after the print job ID is acquired, can be changed to the "paused" state. Therefore, the operation load on the user can be reduced, which allows improved user's usability.

As for the print restarting process, by performing the same process as above, all the print jobs can be changed from the "paused" state to the "print wait" state. More specifically, all the print jobs are such that the printing thereof is requested after the print job ID is acquired and the print job ID acquired and the user ID thereof are the same as each other. Therefore, the operation load on the user can be reduced, which allows improved user's usability.

Figure 50:
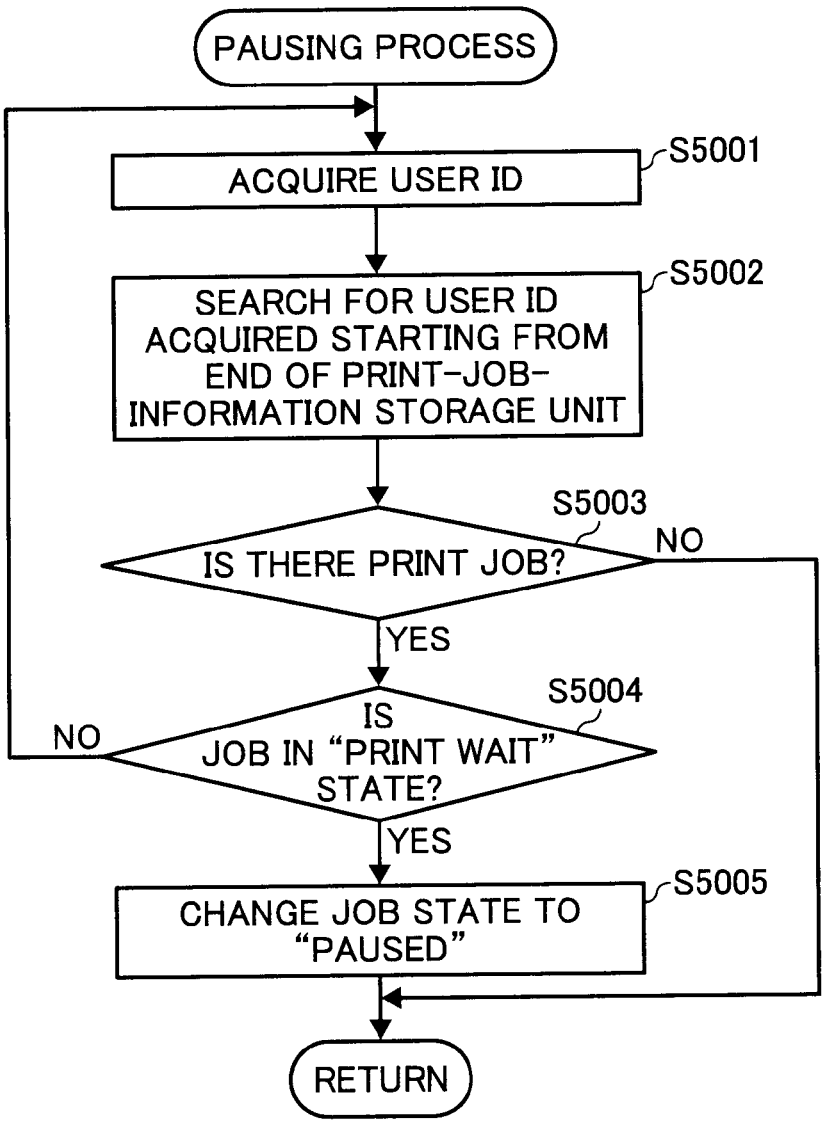

FIG. 50 is a flowchart of yet another example of the pausing process performed by the instruction acquisition unit 335 and the state identification unit 336. The instruction acquisition unit 335 acquires a user ID (step S5001). More specifically, the instruction acquisition unit 335 acquires the user ID received together with the pause instruction from a client terminal. The state identification unit 336 searches for the user ID acquired, starting from the end of information the print-job-information storage unit 332 (step S5002). The state identification unit 336 determines whether there is a print job corresponding to the user ID (step S5003).

When there is the print job (Yes at step S5003), the state identification unit 336 determines whether the job state is "print wait" (step S5004). When the job state is "print wait" (Yes at step S5004), the state identification unit 336 changes the job state to "paused" (step S5005). When the job state is not "print wait" (No at step S5004), the process returns to step S5001.

In this manner, by specifying the user ID, the job state of a print job newly submitted can be changed from "print wait" to "paused". Therefore, the operation load on the user can be reduced, which allows improved user's usability.

As for the print restarting process, by performing the same process as above, the job state of the print job newly submitted can be changed from "paused" to "print wait". Therefore, the operation load on the user can be reduced, which allows improved user's usability.

Figure 51:
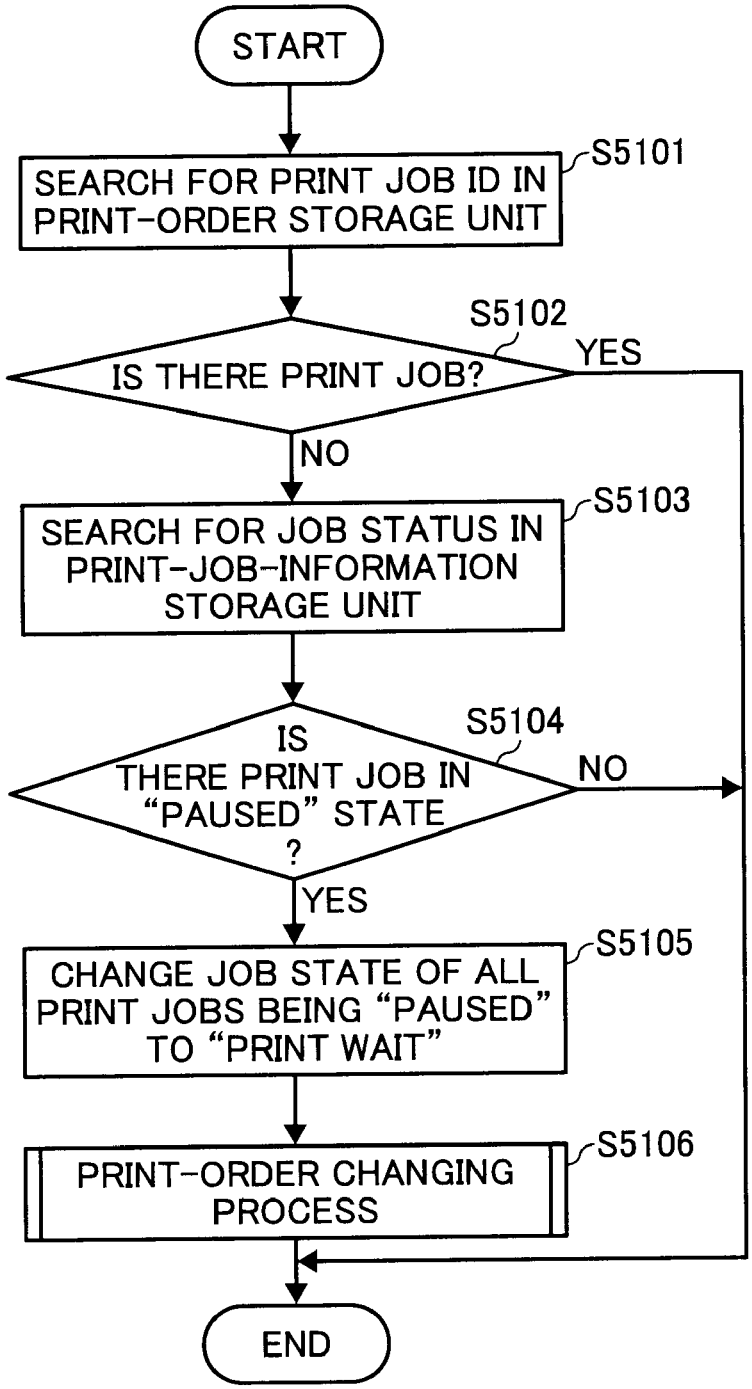
FIG. 51 is a flowchart of an automatic restarting process performed by a print-job control unit according to a twenty-fourth embodiment of the present invention.

A twenty-fourth embodiment is explained below with reference to the accompanying drawings. An MFP of the twenty-fourth embodiment is basically similar in construction to that of the twenty-first embodiment, and hence, the same explanation is not repeated. The twenty-fourth embodiment is configured to perform an automatic restarting process as shown in FIG. 51, instead of the flowchart in FIG. 40 as shown in the twenty-first embodiment. FIG. 51 is a flowchart of an automatic restarting process performed by the print-job control unit 333.

The print-job control unit 333 searches for a print job ID in the print-order storage unit 334 (step S5101). The print-job control unit 333 determines whether there is the print job by retrieving the print job ID (step S5102). When there is no such a print job (No at step S5102), namely, when all the print jobs scheduled are completely printed and there is no more print job in "print wait", the print-job-information storage unit 332 searches for the job state (step S5103).

The print-job-information storage unit 332 determines whether there is any print job in the "paused" state (step S5104). When there is the print job in the "paused" state (Yes at step S5104), the print-job-information storage unit 332 changes the job state of all the print jobs each of which job state is "paused", to "print wait" (step S5105). The print-order changing process is thus performed (step S5103).

At step S5102, when there is the print job (Yes at step S5102), the process ends. Further, at step S5104, when there is no print job in the "paused" state (No at step S5104), the process ends.

In this manner, when there is any print job in the "paused" state upon completion of printing of all the print jobs in "print wait", the printing process is performed without operation by the user. Therefore, the print job is automatically output at the time when congestion is resolved, and there is no need for the user to monitor the state of congestion. Thus, user's usability can be improved.

It is noted that when the pause instruction for printing of a print job is to be executed, it may be set in the print job whether an automatic releasing process is to be performed on the print job in "paused", and the automatic releasing process may be performed only on the print job in which the automatic releasing process is set.

At step S5105, it may also be configured not to change the job state of all the print jobs being "paused" to "print wait", but to change the job state of one print job of the print jobs in the "paused" state retrieved, to "print wait". With this operation, even if there are the print jobs in the "paused" state, the paused state of printing is released one by one. Therefore, when a new print job is submitted at the midpoint during the operation, the print job newly submitted is executed preferentially to the print jobs before the paused state is released.

The individual processes explained in the embodiments may be freely combined and executed.

In the aspects of the invention according to these embodiments, because the printing operation is not paused after the printing operation is started, the output results are continuously collectively output, to enable the achievement of improved user's usability.

Figure 52:
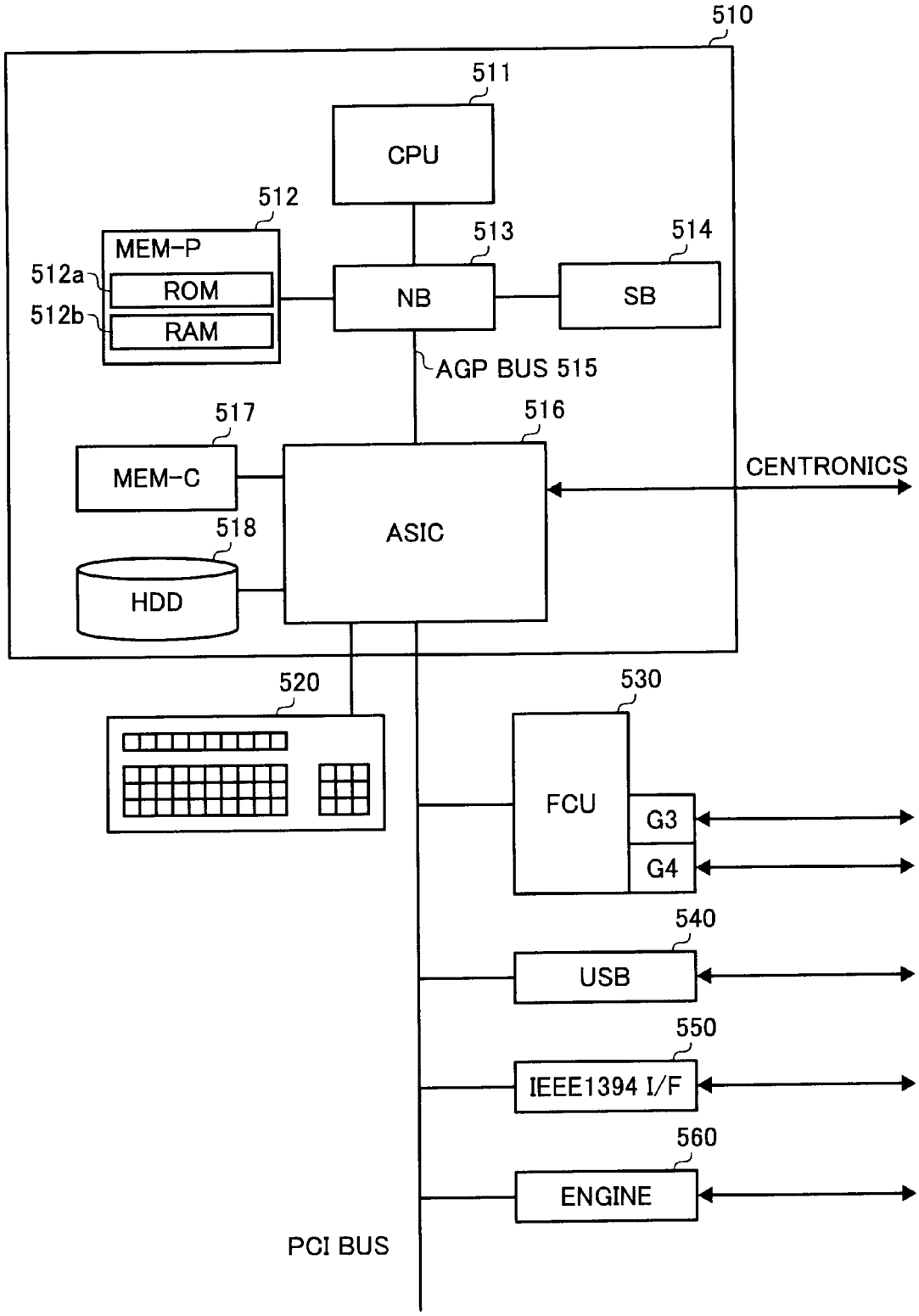
FIG. 52 is a block diagram of an example of a hardware configuration of the MFPs.

FIG. 52 is a block diagram of an example of a hardware configuration of the MFPs according to the embodiments. The MFP includes a controller 510 and an engine unit (Engine) 560 which are connected to each other through a Peripheral Component Interconnect (PCI) bus. The controller 510 controls the MFP, the drawings, and the communications, and also controls the inputs from an operation unit 520. The engine unit 560 is a printer engine connectable to the PCI bus, such as a monochromatic plotter, a one-drum color plotter, a four-drum color plotter, a scanner, or a facsimile unit. The engine unit 560 includes an image processing portion, such as error diffusion and gamma conversion, in addition to the so-called engine portion like a plotter.

The controller 510 includes a CPU 511, a northbridge (NB) 513, a system memory (MEM-P) 512, a southbridge (SB) 514, a local memory (MEM-C) 517, an Application Specific Integrated Circuit (ASIC) 516, and a HDD 518. The NB 513 and the ASIC 516 are connected together by an Accelerated Graphics Port (AGP) bus 515. The MEM-P 512 further includes ROM 512*a*, and RAM 512*b*.

The CPU 511 controls the MEP. The CPU 511 includes a chipset including the NB 513, the MEM-P 512, and the SB 514, and is connected to another device via the chipset.

The NB 513 is a bridge that connects the CPU 511 to the MEM-P 512, the SB 514, and the AGP bus 515. The NB 513 includes a memory controller that controls read/write from/to the MEM-P 512, a PCI master, and an AGP target.

The MEM-P 512 is a system memory that is used as a memory for storing a program and data, a memory for mapping a program and data, a drawing memory for the printer, or the like. The MEM-P 512 includes the ROM 512*a* and the RAM 512*b*. The ROM 512*a* is a read only memory used as the memory for storing a program and data, and the RAM 512*b* is a rewriteable memory used as the memory for mapping a program and data and as the drawing memory for the printer or the like.

The SB 514 is a bridge that connects the NB 513 to a PCI device and a peripheral device. The SB 514 is connected to the NB 513 via the PCI bus to which a network I/F or the like is connected.

The ASIC 516 is an integrated circuit (IC) for image processing purposes having hardware elements for image processing, and serves as a bridge that connects the AGP bus 515, the PCI bus, the HDD 518, and the MEM-C 517 to one another. The ASIC 516 includes a PCI target, an AGP master, an arbiter (ARB) that is the core of the ASIC 515, a memory controller that controls the MEM-C 517, a plurality of Direct Memory Access Controllers (DMACs) that perform rotation of image data by a hardware logic or the like, and a PCI unit that performs data transfer with the engine unit 560 via the PCI bus. The ASIC 515 is connected with a Fax Control Unit (FCU) 530, a Universal Serial Bus (USB) 540, and an IEEE 1394 (the Institute of Electrical and Electronics Engineers 1394) I/F 550 via the PCI bus.

The MEM-C 517 is a local memory used as a copy image buffer and a code buffer. The HDD 518 is a storage that stores image data, programs, font data, and forms.

The AGP bus 515 is a bus interface for a graphics accelerator card proposed to accelerate a graphic process. The AGP bus 515 accelerates the graphics accelerator card by directly accessing the MEM-P 512 at a high throughput.

A computer program (hereinafter, "print-job managing program") executed by the MFP according to the above embodiments is provided by being prestored in the ROM or the like.

The print-job managing program can also be provided by being recorded in a computer-readable recording medium such as a CD-ROM, a Flexible Disk (FD), Compact Disk Recordable (CD-R), and a Digital Versatile Disk (DVD) in a file of an installable or executable format.

The print-job managing program can be stored in a computer connected to a network such as the Internet and downloaded via the network. The print-job managing program can also be provided or distributed via the network such as the Internet.

The print-job managing program is configured with modules including the components (print-job acquisition unit, print-job control unit, instruction acquisition unit, state identification unit, etc). As actual hardware, the CPU (processor) reads the print-job managing program from the ROM and executes it, and the components are thereby loaded on a main storage unit. The print-job acquisition unit, the print-job control unit, the instruction acquisition unit, and the state identification unit or the like are implemented on the main storage unit.

The print-job-information storage unit and the print-order storage unit can be configured with any storage medium generally used such as HDD, an optical disc, and a memory card.

A printing control method includes receiving a plurality of print jobs containing print data from a host computer connected through a network, temporarily storing the print jobs in a storage unit, printing the print data contained in the print jobs, accepting a pause request or a restart request for printing of a print job, controlling execution of the print job in response to the pause request or the restart request, and determining, when the restart request for the print job being paused is accepted, the order in which the print job is to be printed according to a preset condition.

An image-formation control method includes acquiring a print job, determining whether the amount of data to be temporarily stored in a storage unit, which temporarily stores print jobs, exceeds the capacity of the storage unit, suspending storing the print job in the storage unit when the data amount exceeds the memory capacity, and deleting at least one of print jobs stored in the storage unit.

Another image-formation control method includes receiving a print job, sequentially processing print jobs temporarily stored in the storage unit and suspending the processing of a print job, determining whether it is permitted to suspend the processing of a print job based on the print jobs stored in the storage unit, and not accepting a pause request when it is not permitted to suspend the processing of the print job.

A print-job management method includes storing print-job identification information for identifying a print job and job state information indicating a current state of the print job in an associated manner, accepting a pause instruction to pause a print job corresponding to the print-job identification information stored in a job storage unit in association with the job state information indicating "printing" during printing operation corresponding to the print job, identifying job state information stored in the job storage unit in association with the print-job identification information in response to the pause instruction, and not pausing the print job indicated by the pause instruction when the job state information indicates "printing".

Although the invention has been described with respect to a specific embodiment for a complete and clear disclosure, the appended claims are not to be thus limited but are to be construed as embodying all modifications and alternative constructions that may occur to one stilled in the art that fairly fall within the basic teaching herein set forth.

What is claimed is:

1. A printing apparatus, comprising:

a receiving unit configured to receive a plurality of print jobs including print data from a host computer connected through a network to the printing apparatus;

a storage unit configured to temporarily store therein the plurality of print jobs;

a printing unit configured to print the print data contained in the plurality of print jobs stored in the storage unit;

a request receiving unit configured to receive a pause request and a restart request to pause and restart printing of a selected print job of the plurality of print jobs; and a print-job control unit configured to control execution of the selected print job in response to the pause request and the restart request, and, upon receiving the restart request for the selected print job being paused, configured to determine a printing order according to a predetermined condition to print the selected print job.

2. The printing apparatus according to claim 1, wherein, upon receiving the restart request for the selected print job being paused, the print-job control unit is configured to determine the printing order to print the selected print job in an order in which the selected print job has been received from the host computer.

3. The printing apparatus according to claim 1, wherein, upon receiving the restart request for the selected print job being paused, the print-job control unit is configured to determine the printing order to print the selected print job last among the plurality of print jobs stored in the storage unit.

4. The printing apparatus according to claim 1, wherein, upon receiving the restart request for the selected print job being paused, the print-job control unit is configured to determine the printing order to print the selected print job first among the plurality of print jobs stored in the storage unit.

5. The printing apparatus according to claim 1, wherein, upon receiving the restart request for the selected print job being paused, the print-job control unit is configured to determine the printing order to print the selected print job in an order specified by an external device.

6. The printing apparatus according to claim 1, wherein upon receiving a print job including print data with user information that indicates a user who requests printing, the storage unit is configured to store therein the print job together with the user information, and upon receiving the restart request for the selected print job being paused, the print-job control unit is configured to determine the printing order to print the selected print job last among print jobs with user information identical to user information of the selected print job, of the plurality of print jobs stored in the storage unit, without changing a printing order of print jobs with different user information.

7. The printing apparatus according to claim 1, wherein upon receiving a print job including print data with user information that indicates a user who requests printing, the storage unit is configured to store therein the print job together with the user information, and upon receiving the restart request for the selected print job being paused, the print-job control unit is configured to determine the printing order to print the selected print job first among print jobs with user information identical to user information of the selected print job, of the plurality of print jobs stored in the storage unit, without changing a printing order of print jobs with different user information.

8. The printing apparatus according to claim 1, wherein upon receiving a print job including print data with user information that indicates a user who requests printing, the storage unit is configured to store therein the print job together with the user information, and upon receiving the restart request for the selected print job being paused, the print-job control unit is configured to change, as specified, a printing order of print jobs with user information identical to user information of the selected print job, of the plurality of print jobs stored in the storage unit, without changing a printing order of print jobs with different user information.

9. An image forming apparatus, comprising:

an acquisition unit configured to acquire a selected print job;

a storage unit configured to temporarily store therein the selected print job;

a determining unit configured to determine whether data to be temporarily stored in the storage unit will cause an overflow in the storage unit;

a pausing unit configured to pause storing of the selected print job in the storage unit when the data will cause an overflow in the storage unit; and a deleting unit configured to delete at least one of a plurality of print jobs stored in the storage unit and not yet printed when the data will cause an overflow in the storage unit.

10. The image forming apparatus according to claim 9, wherein the deleting unit is configured to delete the at least one of the plurality of print jobs in any one of:

order in which the plurality of print jobs are submitted to the image forming apparatus, order of date and time on which the plurality of print jobs are submitted to the image forming apparatus, descending order of data amount of the plurality of print jobs, ascending order of data amount of the plurality of print jobs, and ascending order of priority of the plurality of print jobs.

11. The image forming apparatus according to claim 9, wherein the deleting unit is configured to delete at least one of the plurality of print jobs until data temporarily stored in the storage unit is reduced to a predetermined amount.

12. The image forming apparatus according to claim 11, further comprising a setting unit that is configured to set the predetermined amount.

13. The image forming apparatus according to claim 9, further comprising a print-job control unit that is configured to print at least one of the plurality of print jobs stored in the storage unit when the data will cause an overflow in the storage unit, wherein the deleting unit is configured to delete the at least one of the plurality of print jobs that has been printed from the storage unit.

14. An image forming apparatus, comprising:

a receiving unit configured to receive a print job;

a storage unit configured to temporarily store therein the print job;

a print-job control unit configured to sequentially process print jobs temporarily stored in the storage unit, and to pause a selected print job within a print job queue and prior to printing in response to a pause request; and a determining unit is configured to determine whether the print-job control unit is permitted to pause the selected print job based on a physical quantity related to the print jobs stored in the storage unit, wherein when the print-job control unit is not permitted to pause the selected print job, the print-job control unit is configured to not accept the pause request.

15. The image forming apparatus according to claim 14, wherein, when the storage unit stores therein a predetermined number of print jobs being paused, the determining unit is configured to determine that the determining unit is not permitted to pause the selected print job.

16. The image forming apparatus according to claim 14, wherein, when a storage area does not have enough available space required for printing, the determining unit is configured to determine that the determining unit is not permitted to pause the print job.

17. The image forming apparatus according to claim 14, further comprising a measurement unit configured to measure a pause time for which each selected print job is paused, wherein the print-job control unit is configured to forcibly restart a selected print job that has been paused for more than a predetermined time among selected print jobs being paused.

18. The image forming apparatus according to claim 14, further comprising a measurement unit configured to measure a pause time for which each selected print job is paused, wherein the print-job control unit is configured to forcibly cancel the selected print job that has been paused for more than a predetermined time.

19. The image forming apparatus according to claim 17, further comprising an indicating unit configured to indicate the selected print job that has been paused for more than the predetermined time.

20. An image forming apparatus, comprising:

a job storage unit configured to store therein print-job identification information that identifies a print job in association with job state information indicating a current state of the print job, the job state information indicates a printing state when printing of the print job is started;

an instruction receiving unit configured to receive a pause instruction to pause a selected print job corresponding to the print-job identification information stored in the job storage unit;

a job-state identifying unit configured to refer to the job state information associated with the print-job identification information to identify the current state of the selected print job in response to the pause instruction; and a print-job control unit configured not to pause the selected print job in response to the pause instruction when the selected print job is in the printing state.

21. The image forming apparatus according to claim 20, wherein the job storage unit is configured to further store therein user identification information that identifies a user who requests the selected print job in association with the print-job identification information, the image forming apparatus further comprising:

a user-identification-information acquisition unit configured to acquire user identification information from an external device;

a print-job specifying unit configured to specify print-job identification information associated with acquired user identification information; and an output unit configured to output the print-job identification information.

22. The image forming apparatus according to claim 20, wherein the job storage unit is configured to further store therein user identification information that identifies a user who requests the print job, the print-job identification information includes a plurality of pieces of print-job identification information that identify a plurality of print jobs, respectively, each associated with the user identification information, and the job state information includes a plurality of pieces of job state information indicating current state of the plurality of print jobs, respectively, the image forming apparatus further comprising:

an operation-information acquisition unit configured to acquire user identification information and job operation information indicating an operation for each print job from an external device;

a print-job specifying unit configured to specify, from the plurality of pieces of print-job identification information, at least one piece of print-job identification information associated with user identification information identical to acquired user identification information; and a changing unit configured to change job state information associated with specified print-job identification information based on the job operation information.

23. The image forming apparatus according to claim 22, wherein, when there are a plurality of pieces of print-job identification information associated with user identification information identical to the acquired user identification information, the print-job specifying unit is configured to specify print-job identification information most recently registered in the job storage unit from the plurality pieces of print-job identification information.

24. The image forming apparatus according to claim 20, wherein the job storage unit is configured to further store therein user identification information that identifies a user who requests the print job, the print-job identification information includes a plurality of pieces of print-job identification information that identify a plurality of print jobs, respectively, each associated with the user identification information, and the job state information includes a plurality of pieces of job state information indicating current state of the print jobs, respectively, the image forming apparatus further comprising:

an operation-information acquisition unit configured to acquire print-job identification information and job operation information indicating an operation for each print job from an external device;

a user specifying unit configured to specify user identification information associated with acquired print-job identification information;

a print-job specifying unit configured to specify at least one piece of print-job identification information associated with user identification information that is identical to the specified user identification information and registered in the job storage unit after the acquired print-job identification information; and a changing unit configured to change job state information associated with specified print-job identification information based on the job operation information.

25. The image forming apparatus according to claim 22, wherein the operation-information acquisition unit is configured to acquire a pause instruction as the job operation information, the print-job specifying unit is configured to specify the print-job identification information when the job state information associated with the specified print-job identification information indicates print wait state, and the changing unit is configured to change the job state information to indicate paused state.

26. The image forming apparatus according to claim 24, wherein the operation-information acquisition unit is configured to acquire a pause instruction as the job operation information, the print-job specifying unit is configured to specify the print-job identification information when the job state information associated with the specified print-job identification information indicates print wait state, and the changing unit is configured to change the job state information to indicate paused state.

27. The image forming apparatus according to claim 22, wherein the operation-information acquisition unit is configured to acquire a restart instruction as the job operation information, the print-job specifying unit is configured to specify the print-job identification information when the job state information associated with the specified print-job identification information indicates paused state, and the changing unit is configured to change the job state information to indicate print wait state.

28. The image forming apparatus according to claim 24, wherein the operation-information acquisition unit is configured to acquire a restart instruction as the job operation information, the print-job specifying unit is configured to specify the print-job identification information when the job state information associated with the specified print-job identification information indicates paused state, and the changing unit is configured to change the job state information to indicate print wait state.

29. The image forming apparatus according to claim 21, further comprising:

a determining unit configured to determine whether the job storage unit stores therein print-job identification information associated with job state information indicating any one of:

printing state and print wait state; and a changing unit configured to change job state information indicating paused state stored in the job storage unit to indicate print wait state when there is no print-job identification information associated with the job state information indicating any one of printing state and print wait state.

30. The image forming apparatus according to claim 29, wherein when there is no print-job identification information associated with the job state information indicating any one of printing state and print wait state, the changing unit is configured to change one of a plurality of pieces of job state information indicating paused state stored in the storage unit to indicate print wait state.

* * * * *